US010746381B1

(12) United States Patent
Wronski et al.

(10) Patent No.: US 10,746,381 B1
(45) Date of Patent: Aug. 18, 2020

(54) SYSTEM AND METHOD FOR PROVIDING A RECESSED LUMINAIRE

(71) Applicant: Suzhou Rongwen Kubai Lighting System Corp., Ltd, Taicang (CN)

(72) Inventors: Grzegorz Wronski, Peachtree City, GA (US); Guo Zhengzu, Taicang (CN)

(73) Assignee: Suzhou Rongwen Kubai Lighting System Corp., Ltd., Taicang (CN)

( * ) Notice: Subject to any disclaimer, the term of this patent is extended or adjusted under 35 U.S.C. 154(b) by 0 days.

(21) Appl. No.: 16/168,758

(22) Filed: Oct. 23, 2018

Related U.S. Application Data

(60) Provisional application No. 62/738,793, filed on Sep. 28, 2018.

(51) Int. Cl.
*F21V 21/04* (2006.01)
*F21V 21/08* (2006.01)

(52) U.S. Cl.
CPC ..... *F21V 21/041* (2013.01); *F21V 21/08* (2013.01)

(58) Field of Classification Search
CPC ..... F21V 21/04; F21V 21/041
See application file for complete search history.

(56) References Cited

U.S. PATENT DOCUMENTS 5,758,959 A * 6/1998 Sieczkowski ..... F21S 8/026 362/148
7,673,841 B2 * 3/2010 Wronski ..... F21V 21/048 248/200.1
2019/0195475 A1 * 6/2019 Jones ..... F21V 21/048

* cited by examiner

*Primary Examiner* — Mary Ellen Bowman
(74) *Attorney, Agent, or Firm* — Smith Tempel; Steven P. Wigmore

(57) ABSTRACT

A method and system for providing an improved recessed luminaire includes providing the ability to rotate or shift the position of the junction box within the system. The improved system also provides an ability to shorten lengths of the hanger bar assemblies in an efficient manner during installation of the luminaire. A geometry of the end of the hangar bar assemblies may be modified to provide a more efficient design that also helps support fasteners. Additional improvements may include those for a spring to lock a door of the junction box; improvements for locking hanger bars to a plaster plate; improved mounting tabs for the plaster plate; an improved thermal protector case with enhanced coupling mechanisms; and improvements to a spring for locking a door of the junction box that improve compactness for the system to aid in shipping the system.

17 Claims, 45 Drawing Sheets

Section C-C

SYSTEM AND METHOD FOR PROVIDING A RECESSED LUMINAIRE

BACKGROUND

The "INESA Lighting Handbook" published by the Illuminating Engineering Society of North America, is incorporated by reference here in its entirety. As discussed in chapter seven of that handbook, a "luminaire" is a device for producing, controlling, and distributing light. It is typically a complete lighting unit that includes one or more lamps, sockets for positioning and protecting the lamps and for connecting the lamps to a supply of electric power, optical devices for distributing the light, and mechanical components for supporting or attaching the luminaire. Luminaires are also sometimes referred to as "light fixtures."

Luminaires are typically classified by their application, such as residential, commercial, or industrial. However, a particular luminaire can often be used in more than one application, depending upon its performance characteristics. For example, recessed downlights are used in both commercial and residential applications where they are typically mounted behind a ceiling wall with an opening to produce illuminance on the floor or workplace below.

Various support systems have been employed to carry recessed luminaires in buildings and other structures. For example, recessed fixtures are often suspended between joists, or other parallel support structures, on a pair of "hanger bars" or "bar hangers" extending between the joists. Similar hanger bar arrangements are used to suspend recessed downlights between the rails in a suspended, tile ceiling.

These conventional hanger bars are often formed in one-piece with a fixed length so as to provide adequate structural rigidity at a relatively low cost. Since the length of the hanger bar cannot be variably adjusted, its use is often limited to joists, or other supports, having a standard and consistent spacing.

As with single-piece hanger bars, two-piece hanger bars may be trimmed for use with smaller joist spacings. However, these hanger bar assemblies must generally be disassembled prior to altering their length. Furthermore, while such two-piece arrangements permit installation between supports or joists of various spacings, they generally suffer from a lack of stability that fails to provide adequate support for the suspended luminaire, especially when the hanger is installed in its fully-extended, or nearly fully-extended, position.

In addition to problems with conventional hanger bars, conventional luminaires often have issues with the location of the junction box as well as the ease in which a thermal protector case may be installed within a housing or can of the luminaire. Other problems with conventional luminaires, include, but are not limited to, mounting tabs attached to a plaster plate of the luminaire as well as how junction boxes are kept closed.

Generally, the space in which to install a luminaire comprising a recessed light fixture is limited, and so the time to install a recessed light fixture can be increased when parts of the light fixture (e.g., the luminaire, the luminaire housing) are cumbersome to install. Further, the space for each luminaire may be unique in that the space has different mounting options/structures to which fasten the luminaire.

What is needed in the art is a method and/or system for providing a luminaire in which a plurality of optional installation features are available for use by the installer to ease the installation of a luminaire where each mounting/physical location of a luminaire may be unique.

SUMMARY

A method and system for providing an improved recessed luminaire includes providing the ability to rotate or shift the position of the junction box within the system. The improved system also provides an ability to shorten lengths of the hanger bar assemblies in an efficient manner during installation of the luminaire. Hanger bar assemblies may comprise telescoping members where each member may be broken-off/removed from the assembly so that the bars may be shortened depending upon the unique space provided for a mount. Subsections of members may be bent and broken off from an entire assembly.

A geometry of the end of the hangar bar assemblies may be modified to provide a more efficient design that also helps support fasteners. Specifically, a first segment of the hanger bar is extended horizontally from the hanger bar end, while the second segment may be bent vertically down from the first segment. The fastener or nail may be held by partial loops, and in on exemplary embodiment, by three partial loops. The friction is between the inside loop surface and the nail outside surface.

An enhanced spring may be provided for locking a plaster plate with the hanger bar assemblies. Specifically, a "V"-shape part may act as a spring to compensate any clearances before bars are placed in a "locked" condition, where the locked condition is created by a locking screw.

Enhanced mounting tabs for a plaster plate may be provided. Specifically, improved mounting tabs may be bent downward from a wall of the plaster plate when hanger bars are not needed for a particular space/mount for a luminaire.

An improved thermal protector case which can be easily installed within a can of a luminaire may be provided. Specifically, an improved thermal protector case and improved coupling features/mechanisms on the top of the can/housing may be provided. The thermal protector case is easy to install on the inside of can/housing, while also maintaining an air-tight seal to comply with an industry standard for luminaires.

An improved spring for closing a door of a junction box may be provided. An improved spring for the junction box may be regressed in a cavity of the closable door. The end of the spring is not protruding beyond the door when the door of the junction box is in a closed position.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

In the drawings, like reference numerals refer to like parts throughout the various views unless otherwise indicated. For reference numerals with letter character designations such as "102A" or "102B", the letter character designations may differentiate two like parts or elements present in the same figure. Letter character designations for reference numerals may be omitted when it is intended that a reference numeral to encompass all parts having the same reference numeral in all figures. For clarity, not all components are shown on drawings; the flexible conduit is shown partially—ends only, electrical components as wires, a socket and a thermo-protector are not present on drawings.

All components disclosed are designed for sheet metal stamping processes. Metal stamping (also known in the art as pressing) is a process that utilize stamping presses and metal forming tools (dies) to transform flat metal sheets into shapes by forming a sheet metal placed between two halves of a press tool. Other manufacturing methods are also possible, and are included within the scope of this disclosure. Other methods include, but are not limited to, rolling, casting, molding, or milling, etc. as understood by one of ordinary skill in the art.

DETAILED DESCRIPTION

The word "exemplary" is used herein to mean "serving as an example, instance, or illustration." Any aspect described herein as "exemplary" is not necessarily to be construed as exclusive, preferred or advantageous over other aspects.

Figure 1:
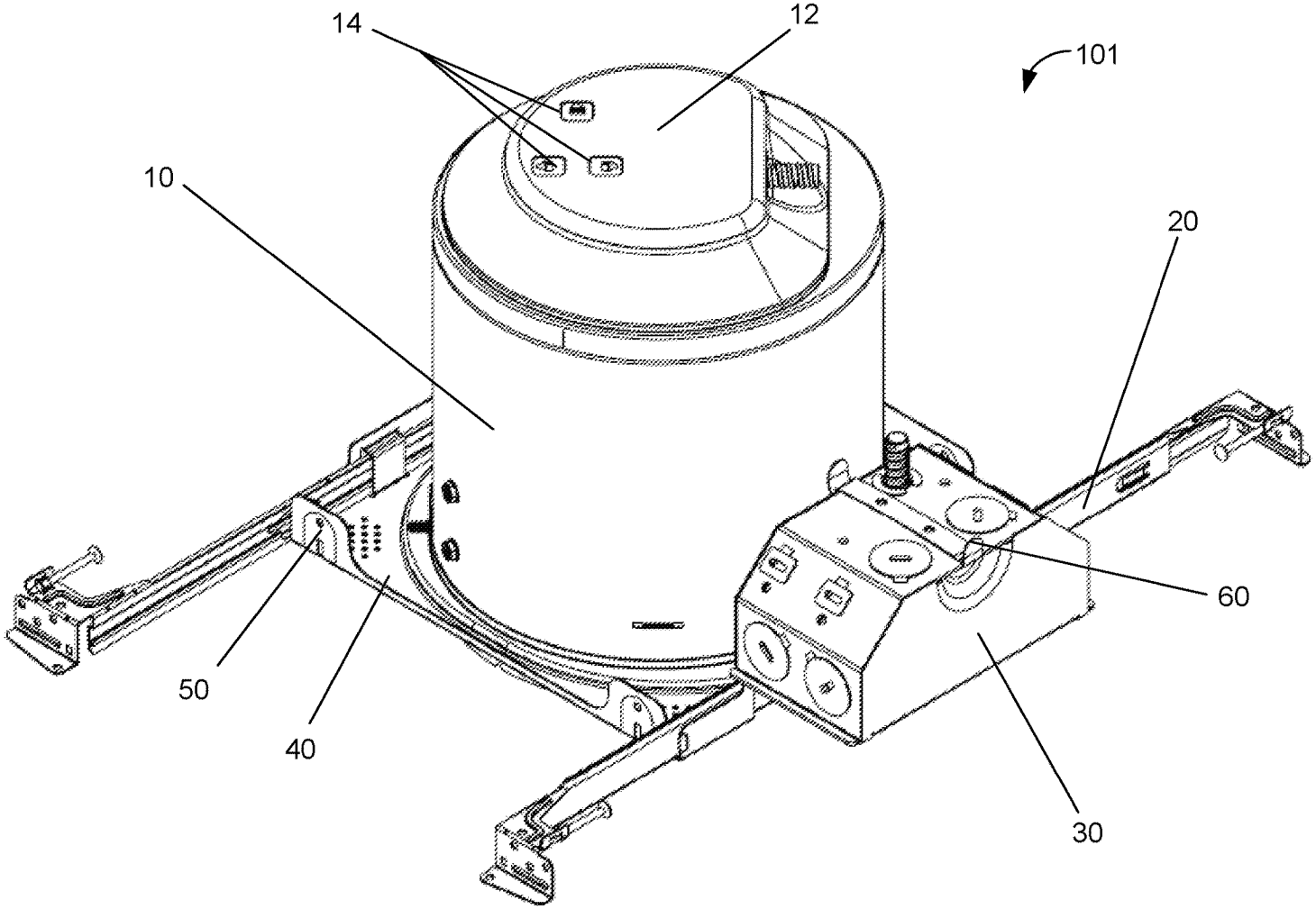
FIG. 1 is an isometric side view of a system for providing a recessed luminaire according to one exemplary embodiment.

Referring now to FIG. 1, this figure is an isometric side view of a system 101 for providing a recessed luminaire. The system 101 may comprise a housing or can 10 for containing a light as well as a plurality of hanger bar assemblies 20. The hanger bar assemblies 20 may be coupled to a plaster plate or frame 40. The plaster frame 40 may comprise mounting tabs 50.

The plaster frame 40 may support a junction box 30. The junction box 30 may have a spring 60 which may keep the junction box 50 in a closed state.

The system 101 may comprise at least seven different unique features/functions that may include, but are not limited to, (a) elements that contribute to a rotation/re-positioning of the junction box; (b) elements that facilitate the reduction in length of the hanger bar assemblies 20; (c) elements that provide unique fastener ends for each hanger bar assembly 20; (d) elements that facilitate the locking/coupling of sections forming each hanger bar assembly 20; (e) unique elements of the plaster frame 40 that form the mounting tables 50; (f) unique coupling features/mechanisms 14 on a top section 12 of can 10 that provide for a unique installation of a thermo-protector; and (g) unique elements forming an improved spring 60 for the junction box 30. The inventive system 101 has other features but the aforementioned seven will be explained in more detail below. An exemplary embodiment of the inventive system 101 may include all or any combination of these features.

Figure 2:
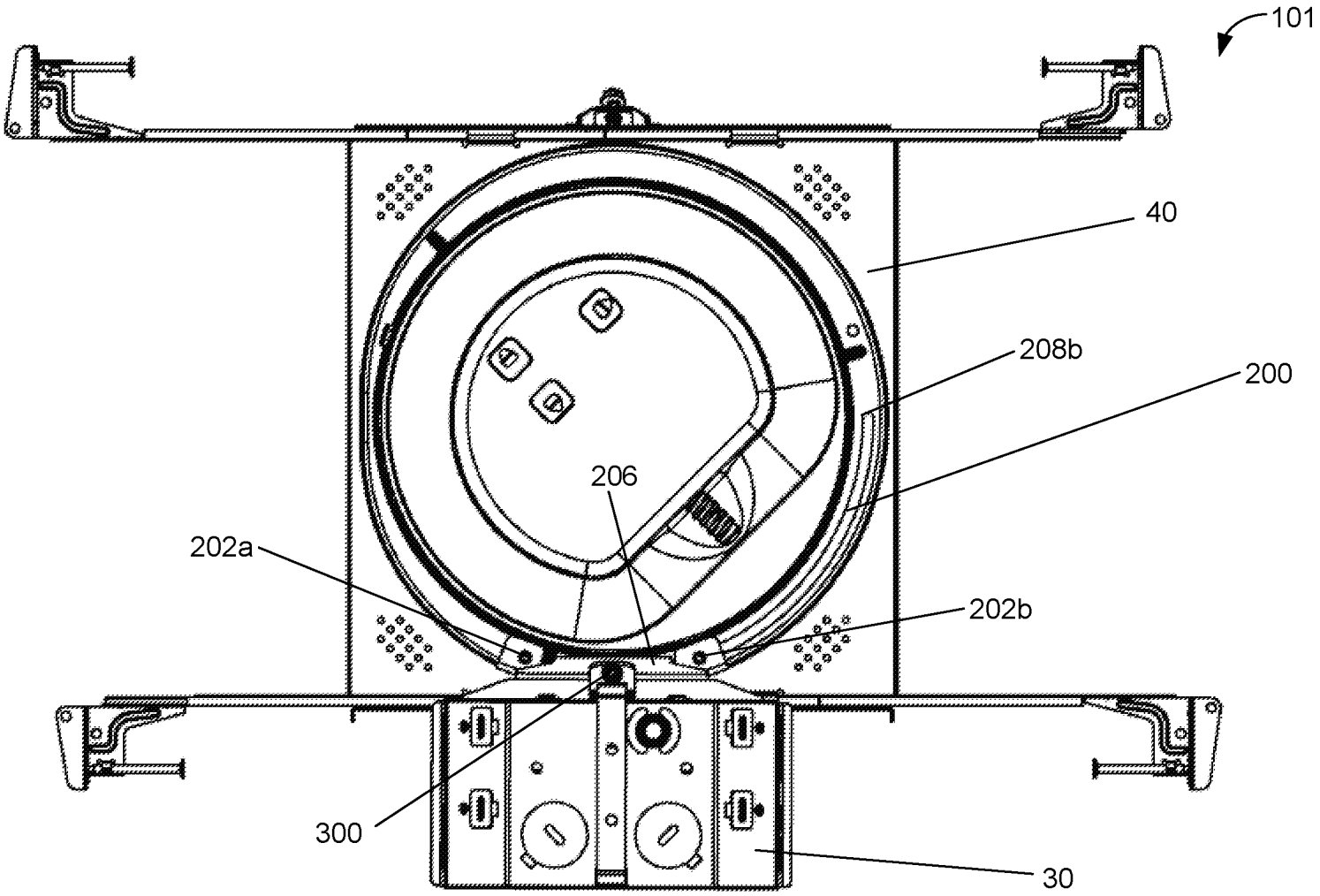
FIG. 2 illustrates a top view of the inventive system depicted in FIG. 1.

Referring now to FIG. 2, this figure illustrates a top view of the inventive system depicted in FIG. 1. The plaster frame 40 of system 101 may further comprise a slit or slot 200 so that the junction box 30 may be rotated at least by about 90.0 degrees as illustrated by FIGS. 4-8. The slot 200 may comprise a sector-shaped arch shape and it may comprise an arch that has a length that corresponds with 90.0 degrees of a circle. However, other arch lengths are possible and are included within the scope of this disclosure. Other arch lengths may be greater than or less than the illustrated 90.0 arch of FIG. 2.

The slot 200 may have a width dimension of between about 0.08 Inch (2 mm) and about 0.20 Inch (5.0 mm). According to one exemplary embodiment, the width dimension of the slot is about 0.014 Inch (3.6 mm). The plaster frame 40 may also have a thickness dimension between about 0.020 Inch (0.5 mm) and about 0.060 Inch (1.5 mm). According to one exemplary embodiment, the plaster frame 40 has a thickness of about 0.7 mm.

The junction box 30 may be held stationary/fixed within the slot 200 by a fastener 300 that attaches to an edge 206 of the junction box 30. The edge 206 may further comprise guide protrusions 202*a* and 202*b* that may slide along the slot 200 when the junction box 30 is moved along the slot 200. Each guide protrusion 202*a*, 202*b* may also couple with alignment apertures 204 [See FIG. 5A] near end points 208 of the slot 200 as will be described in more detail below.

Figure 3:
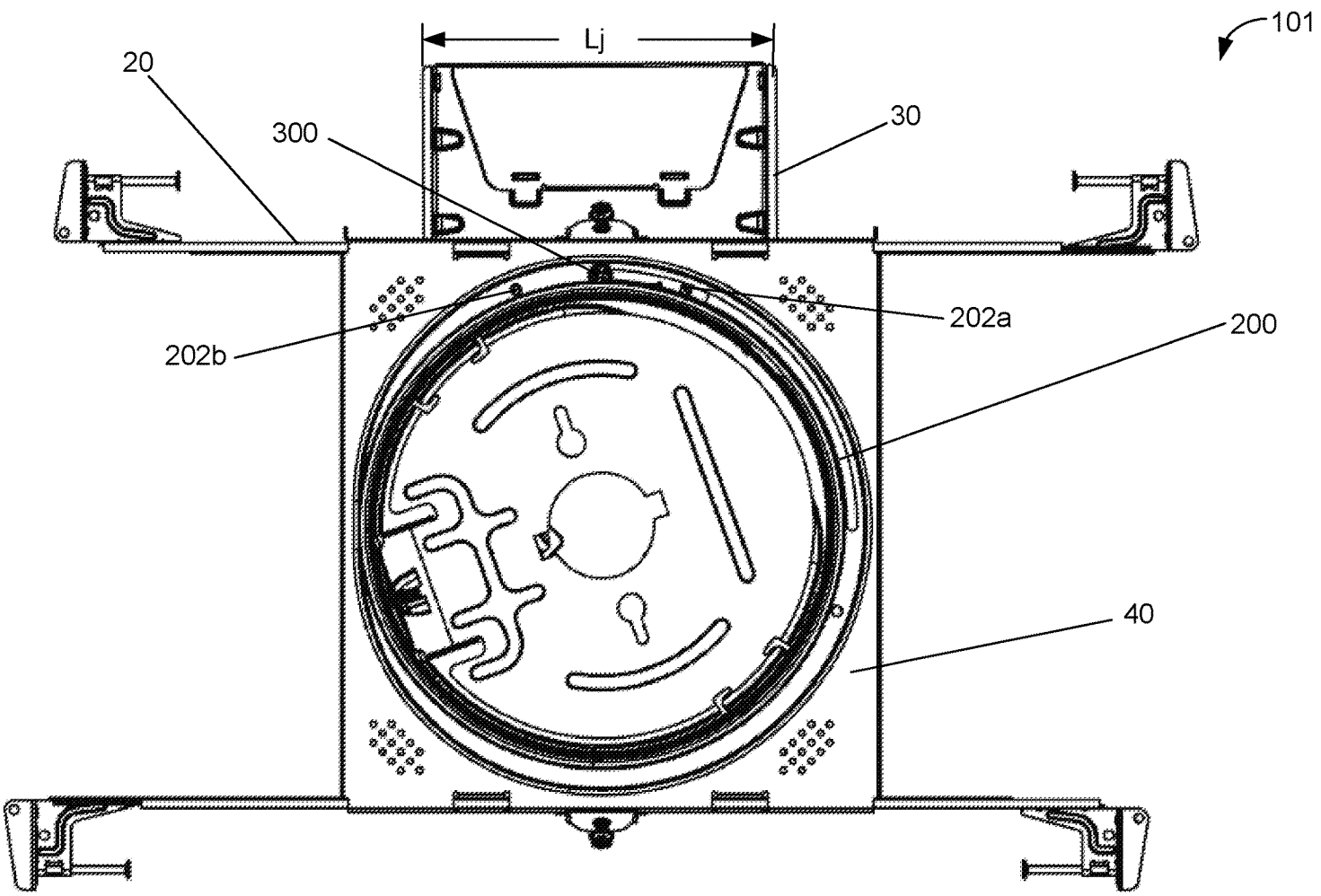
FIG. 3 illustrates a bottom view of the inventive system depicted in FIG. 1.

Referring now to FIG. 3, this figure illustrates a bottom view of the inventive system 101 depicted in FIG. 1. In this figure, a fastener 300 is illustrated which holds the junction box 30 at its current position. The fastener 300 penetrates through the slot 200 and engages an edge of the junction box 30. The fastener 300 may comprise a sheet metal screw, but other fasteners are possible and are included within the scope of this disclosure. The junction box 30 may have a length dimension Lj which is parallel with the direction in which the hanger bar assembly 20 extends while the junction box 30 is held in its current position illustrated in FIG. 3.

Figure 4:
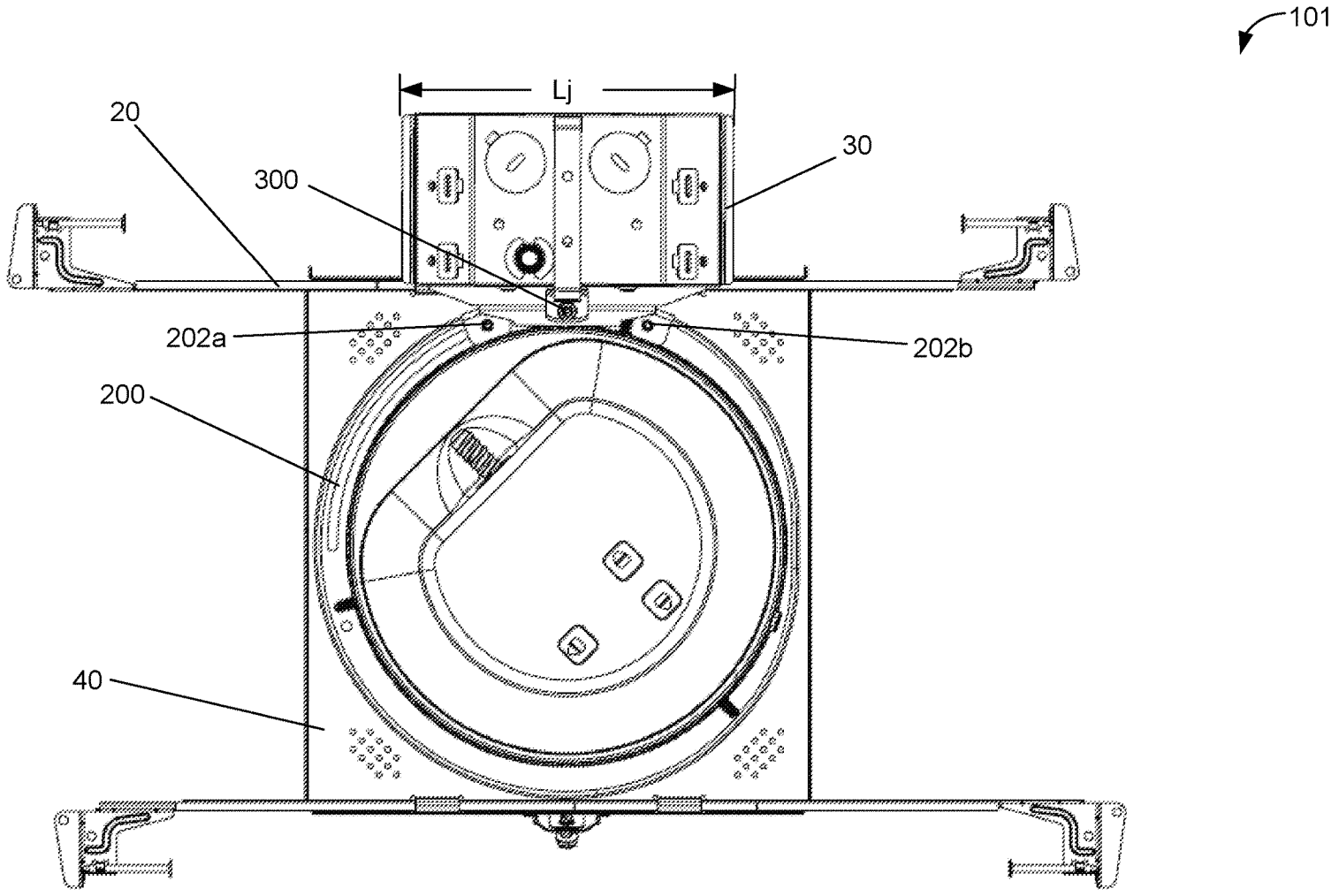
FIG. 4 illustrates another top view of the inventive system depicted in FIG. 1 and FIG. 2, however, this view illustrates the slot in an opposite corner of the plaster frame relative to the position shown in FIG. 2.

Referring now to FIG. 4, this figure illustrates another top view of the inventive system 101 depicted in FIG. 1 and FIG. 2, however, this view illustrates the slot 200 in an opposite corner of the plaster frame 40 relative to the position shown in FIG. 2. This figure, like FIGS. 2-3, shows the length dimension Lj of the junction box to be parallel to the direction in which the hanger bar assemblies 20 extend, similar to FIGS. 2-3.

Figure 5A:
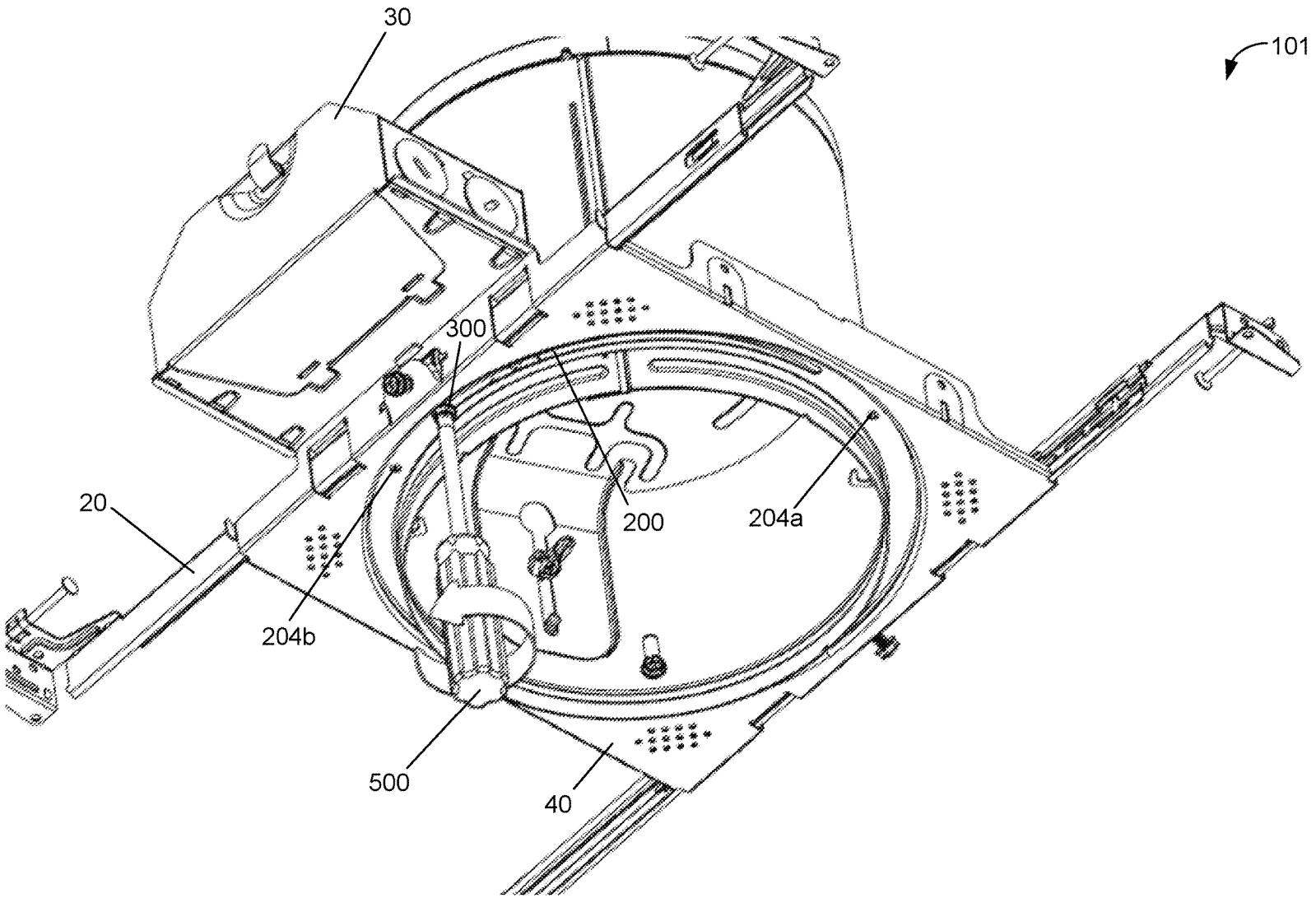
FIG. 5A illustrates a bottom isometric view of the system 101 and a tool that may be used to loosen the fastener that holds the junction box in its current position adjacent to the hanger bar assembly.

Referring now to FIG. 5A, this figure illustrates a bottom isometric view of the system 101 and a tool 500 that may be used to loosen the fastener 300 that holds the junction box 30 in its current position adjacent to the hanger bar assembly 20. The tool 500 may comprise a screw-driver. In the exemplary embodiment illustrated, the tool 500 is rotated counter-clockwise in order to rotate the fastener 300 in a counter-clockwise direction so that the fastener 300 is loosened relative to the slot 200 and such that the junction box 30 may slide along the slot 200.

The fastener 300 is usually not removed completely from its connection to the junction box 30 in order to re-position the junction box 30 along the curved slot 200. Instead, the fastener 300 is loosened to allow the junction box 30 to slide in the direction of the slot 200 such that the fastener remains within the slot 200 during the movement of the junction box 30 along the direction of the curved slot 200.

Also illustrated in FIG. 5A are two alignment apertures 204*b* and 204*a* which are positioned at end points relative to the ends of the slot 200. The guide protrusions 202*a*, 202*b* of the junction box 30 penetrate through the apertures 204*a* and 204*b* when the junction box 30 is positioned at either end position of the slot 200. The guide protrusions 202*a*, 202*b* are formed by a stamping process in which a round rod may press through the edge 206 of the junction box 30. Each protrusion 202*a*, 202*b* may have an internal depth/height of about 0.03 of an inch when viewing a protrusion 202 from a side of the edge 206 that is pressed-in to form the protrusion 202. However, other depths/heights are possible and are included within the scope of this disclosure.

Figure 5B:
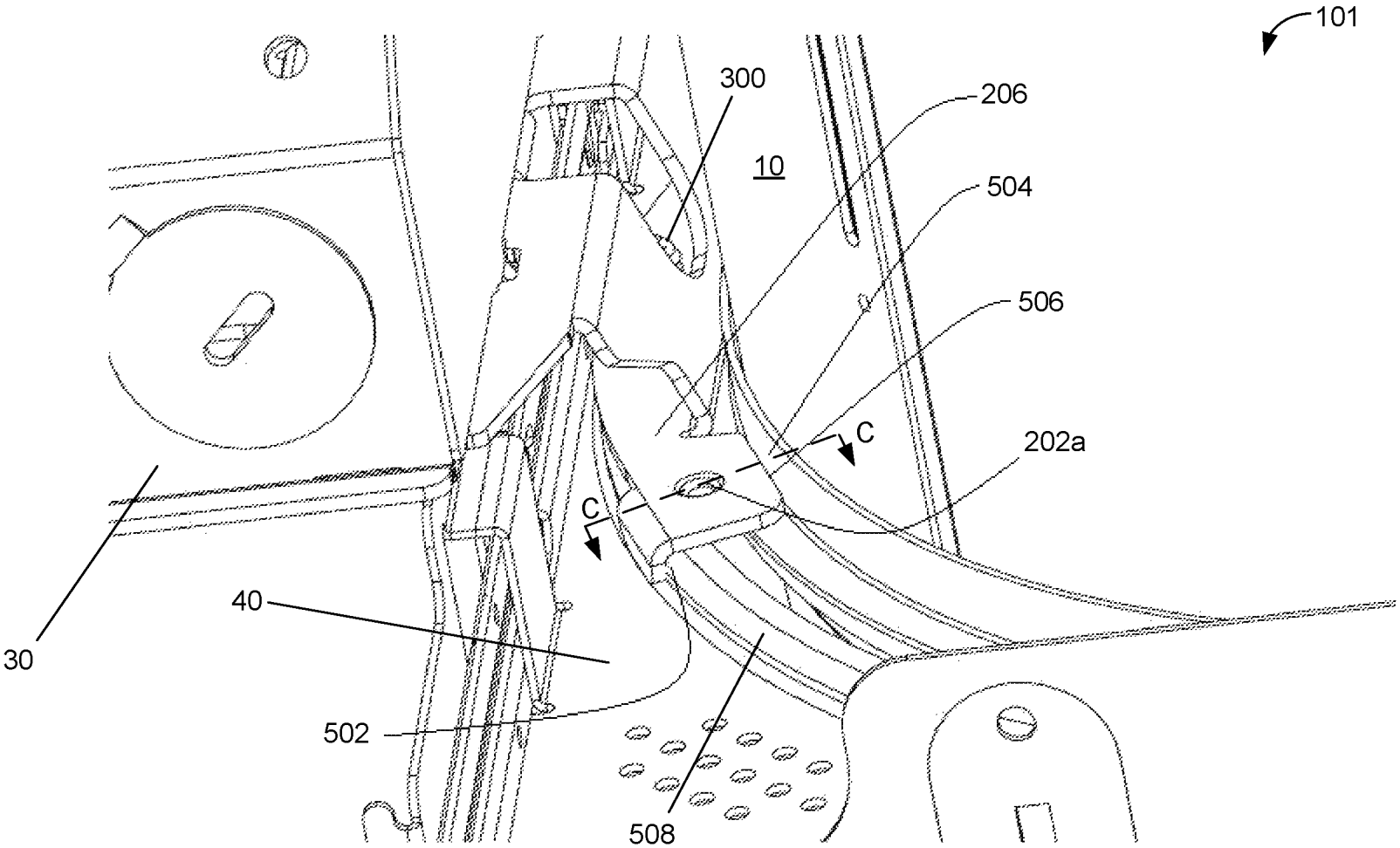
FIG. 5B illustrates a side, isometric view of the edge of the junction box and how the protrusions engage with the slot.

Referring now to FIG. 5B, this figure illustrates a side, isometric view of the edge 206 of the junction box 30 and how the protrusions 202 engage with the slot 200. As shown in this figure, the edge 206 of the junction box 30 may further comprise an outer, angled/slanted engagement portion 502 ("outer" relative to the slot 200 and a geometric center of plaster plate 40 not shown) that slides and contacts a first wall 508 that protrudes from a surface of the plaster plate 40. The outer, angled engagement portion 502 may be adjacent to each protrusion 202.

The edge 206 may further comprise an inner angled/slanted section 506 ("inner" relative to the slot 200 and a geometric center of plaster plate 40 not shown) that engages a second wall 504 that is positioned on an outer, lower portion of the housing/can 10. The inner angled section 506 may also be positioned adjacent to each protrusion 202 and it may slide along the second wall 504 as the junction box 30 is translated/moved within the slot 200. FIG. 5B only shows the outer, angled engagement portion 502 and the inner angled section 506. A second outer, angled engagement portion 502 and a second inner angled section 506 are provided for the second protrusion 202*b*, which is not visible in this FIG. 5B.

Figure 5C:
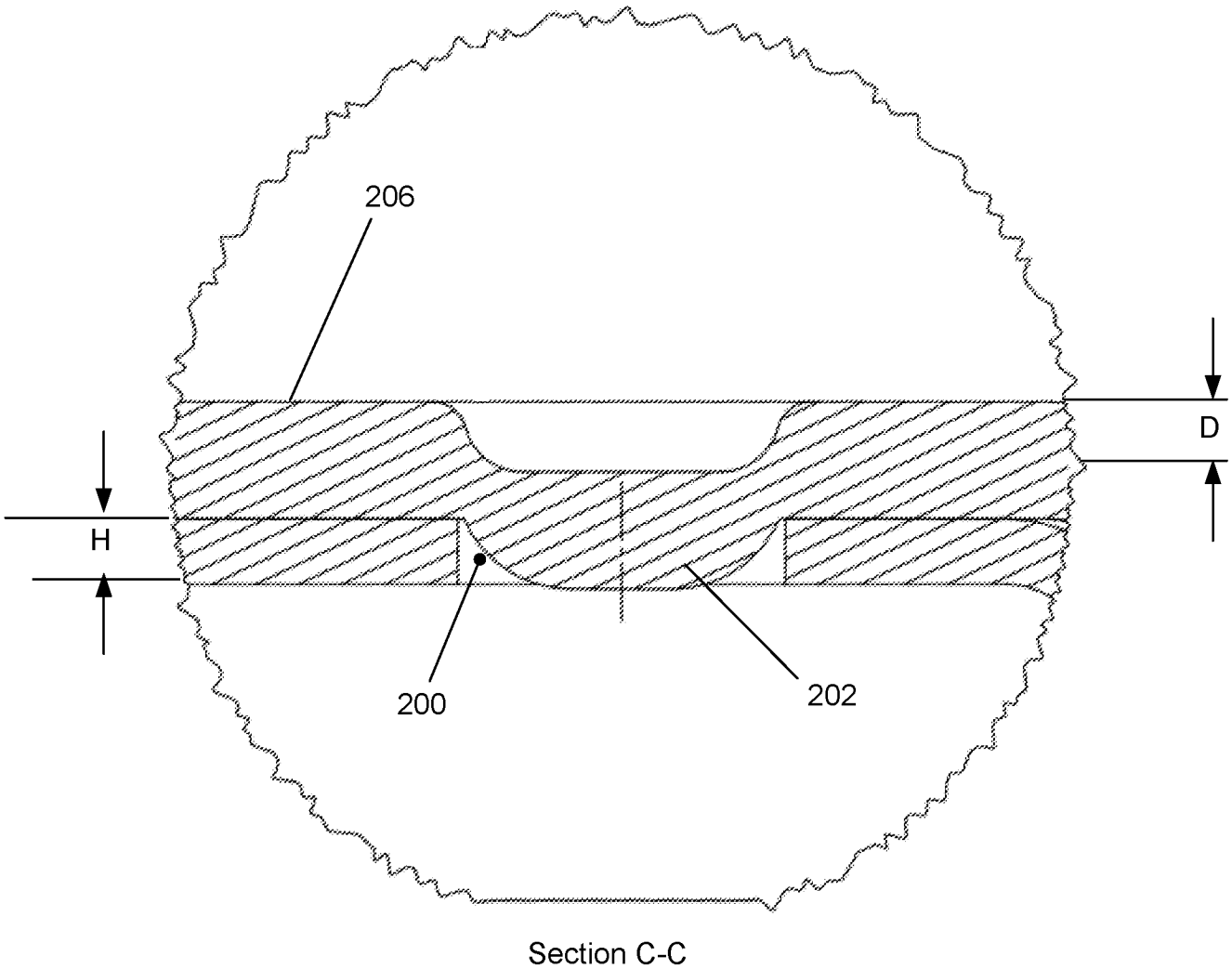
FIG. 5C illustrates a cross-sectional view taken along the cut line C-C in FIG. 5B for the protrusions of the junction box.

FIG. 5C illustrates a cross-sectional view taken along the cut line C-C in FIG. 5B for the protrusions 202 of the junction box 30. As noted previously, each protrusion 202 may have a depth dimension D or height dimension H. The depth dimension D and height dimension H are substantially equal and may comprise a magnitude between about 0.03 of an inch when viewing a protrusion 202 from a side of the edge 206 that is pressed-in to form the protrusion 202. However, other depths/heights are possible and are included within the scope of this disclosure as understood by one of ordinary skill in the art.

Figure 5D:
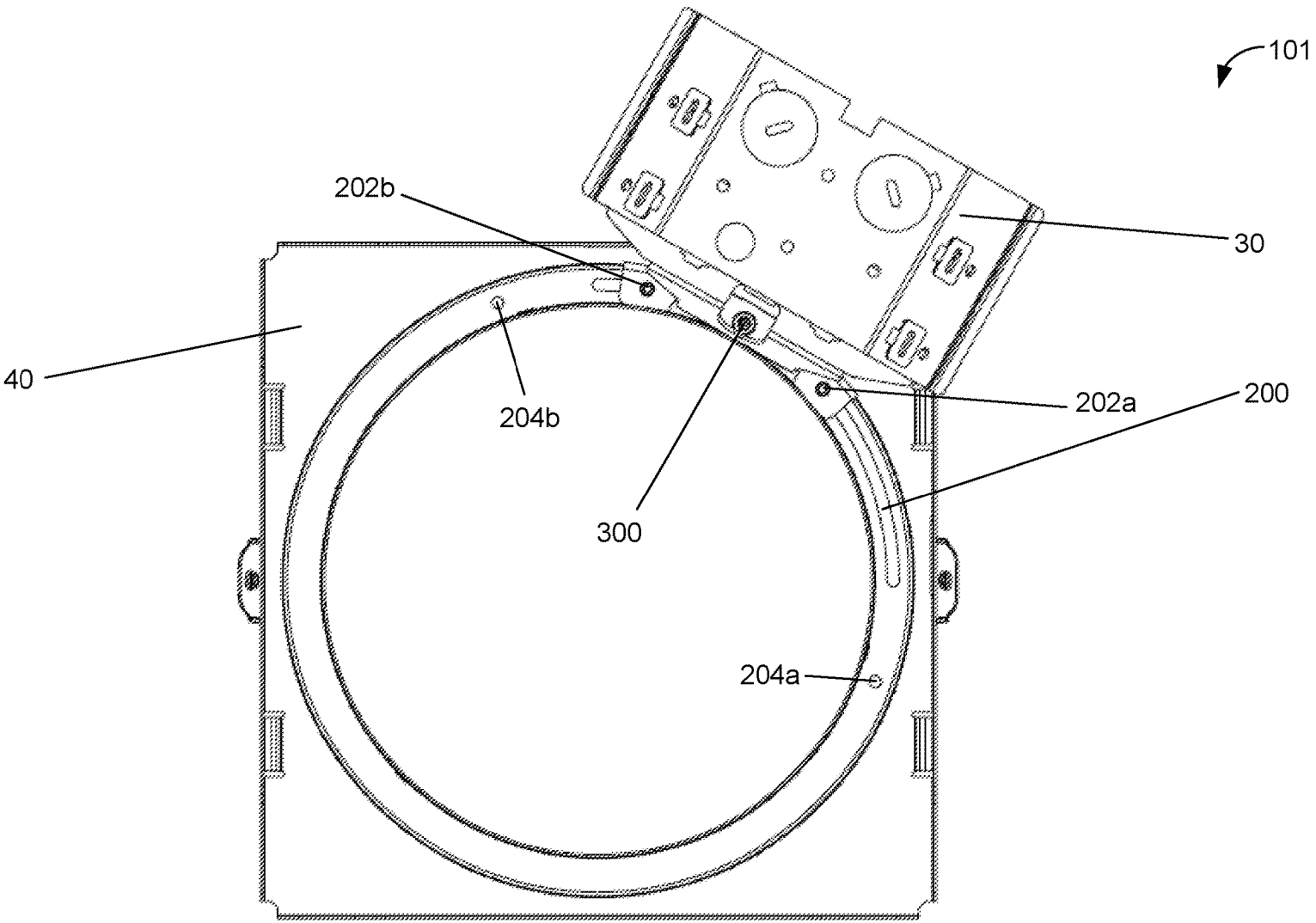
FIG. 5D illustrates a top view of the system after the fastener has been loosened and the junction box has translated/moved along the slot.

Referring now to FIG. 5D, this figure illustrates a top view of the system 101 after the fastener 300 has been loosened and the junction box 30 has translated/moved along the slot 200. In this view, the two alignment apertures 204*a*, 204*b* are clearly visible and correspond with protrusions 202*a*, 202*b*. As noted previously, when the junction box 30 is translated to either end position of the slot 200, at least one protrusion 202 may penetrate through an alignment aperture 204 such that the luminaire installer knows the junction box 30 has reached the correct and final position along the slot 200.

Figure 6:
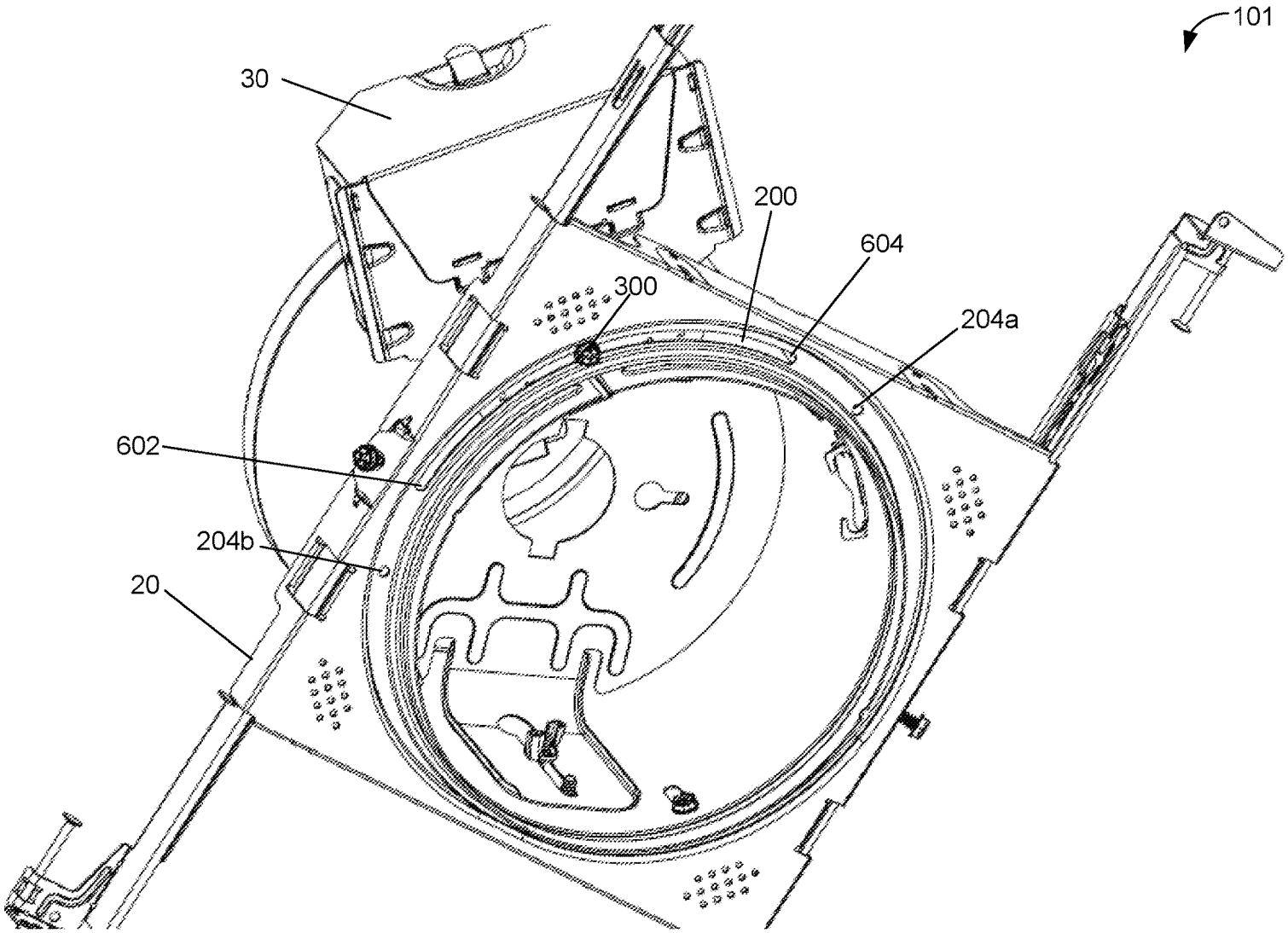
FIG. 6 illustrates a bottom isometric view of the system after the fastener has been loosened and where the junction box has been rotated about forty-five degrees along the slot relative to the position illustrated in FIG. 5.

Referring now to FIG. 6, this figure illustrates a bottom isometric view of the system 101 after the fastener 300 has been loosened and where the junction box 30 has been rotated about forty-five degrees along slot 200 relative to the position illustrated in FIG. 5. Also illustrated in FIG. 6 are end positions 602, 604 of slot 200. In FIG. 5, the junction box 30 was located at end position 602. In FIG. 6, the fastener 300 is illustrated half-way between end positions 602 and 604. Usually, the junction box 30 can be moved between end positions 602 and 604 while the entire system 101 is fixed between beams in a ceiling of a building structure [i.e. see fixed system 101 of FIG. 24 described below].

Figure 7:
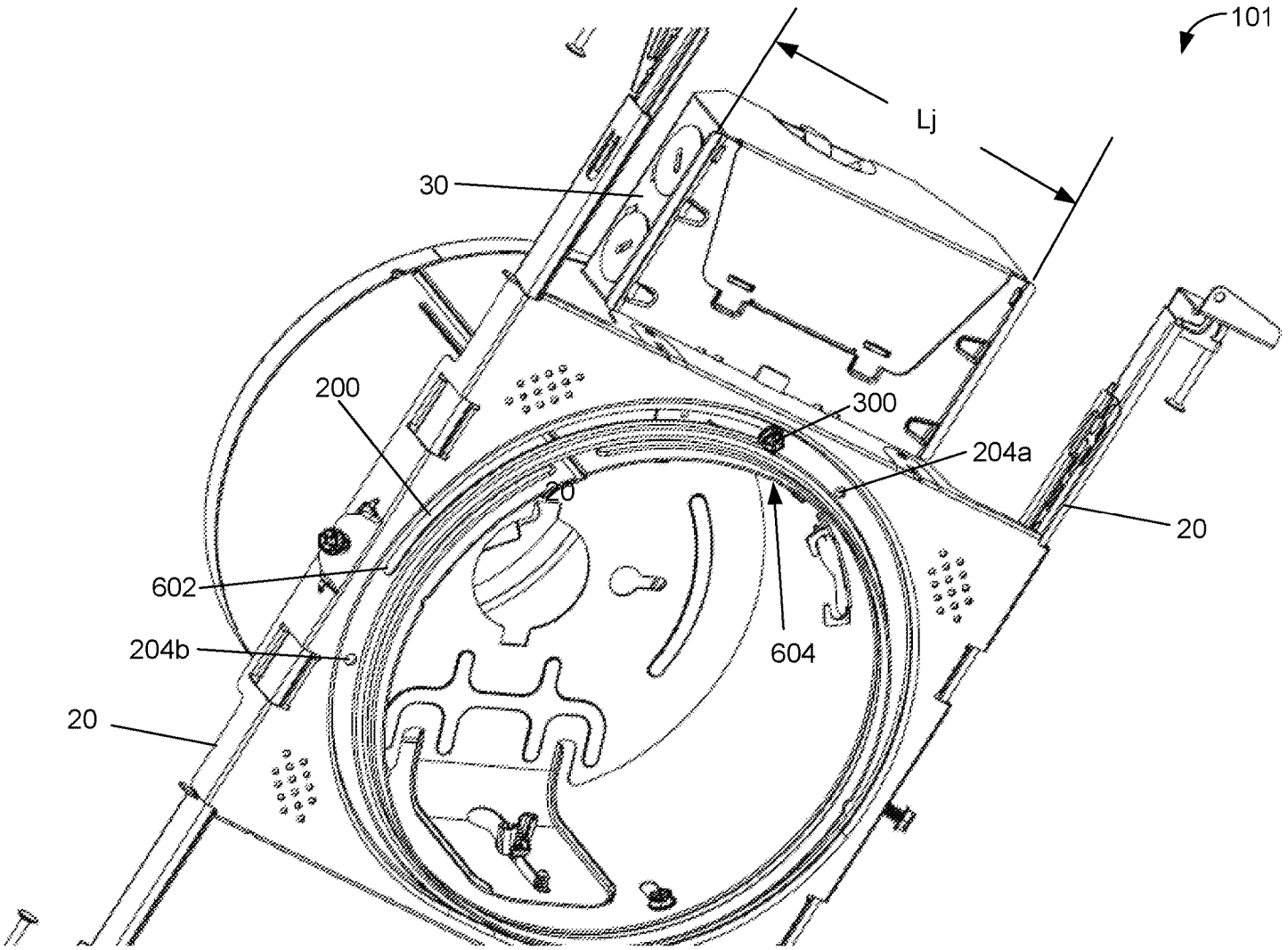
FIG. 7 illustrates a bottom isometric view of the system after the fastener has been loosened and where the junction box has been rotated about ninety degrees along the slot relative to the position illustrated in FIG. 6.

Referring now to FIG. 7, this figure illustrates a bottom isometric view of the system 101 after the fastener 300 has been loosened and where the junction box 30 has been rotated about ninety degrees along slot 200 relative to the position illustrated in FIG. 6. In this position, the fastener 300 may be tightened such that the head of the fastener 300 contacts the slot 200 and pulls an edge of the junction box 30 firmly against regions adjacent to the slot 200 such that the junction box 30 is firmly positioned at end position 604 relative to the slot 200. The fastener 300 may be tightened with a hand tool 500, such as a hand-driven screw driver as illustrated in FIG. 5.

At position 604 along slot 200, the length dimension Lj of the junction box 30 is at about a 90.0 degree angle relative to the direction in which the two hanger bars 20 extend. Allowing this rotation of the junction box 30 from position 602 to position 604 and vice-versa allows the system 101 to adjust to variable wiring positions/angles when the wires carrying electrical power for the light within the housing 10 can be at various angles relative to the hanger bars 20.

Figure 8:
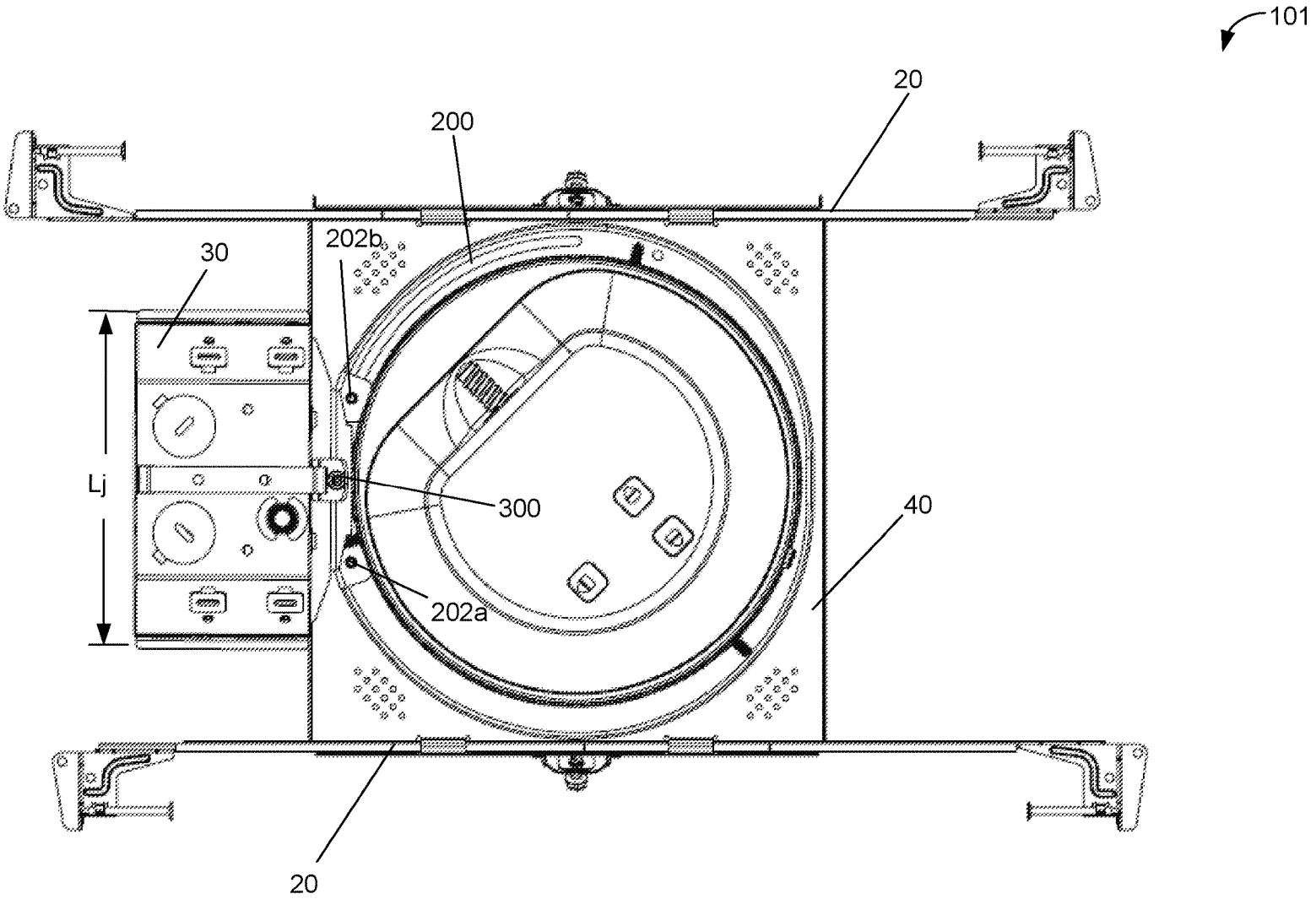
FIG. 8 illustrates the junction box re-positioned in a location ninety degrees relative to the original position of the junction box as illustrated in FIG. 4.

Referring now to FIG. 8, this figure illustrates the junction box 30 re-positioned in a location ninety degrees relative to the original position of the junction box as illustrated in FIG. 4. As noted above, the length dimension Lj of the junction box 30 is now at a ninety degree angle relative to the direction in which the hanger bar assemblies 20 may extend. The inventive system 101 is not limited to curved slots 200 covering only ninety degree angles. It is possible to extend the slot 20 for angles greater than or less than 90.0 degrees. However, as understood by one of ordinary skill in the art, if an angle greater than 90.0 degrees is contemplated for the slot 200, then additional reinforcing structures/elements may be needed for the plaster plate 40 in order to prevent potential failure/bending of the plate 40.

Figure 9A:
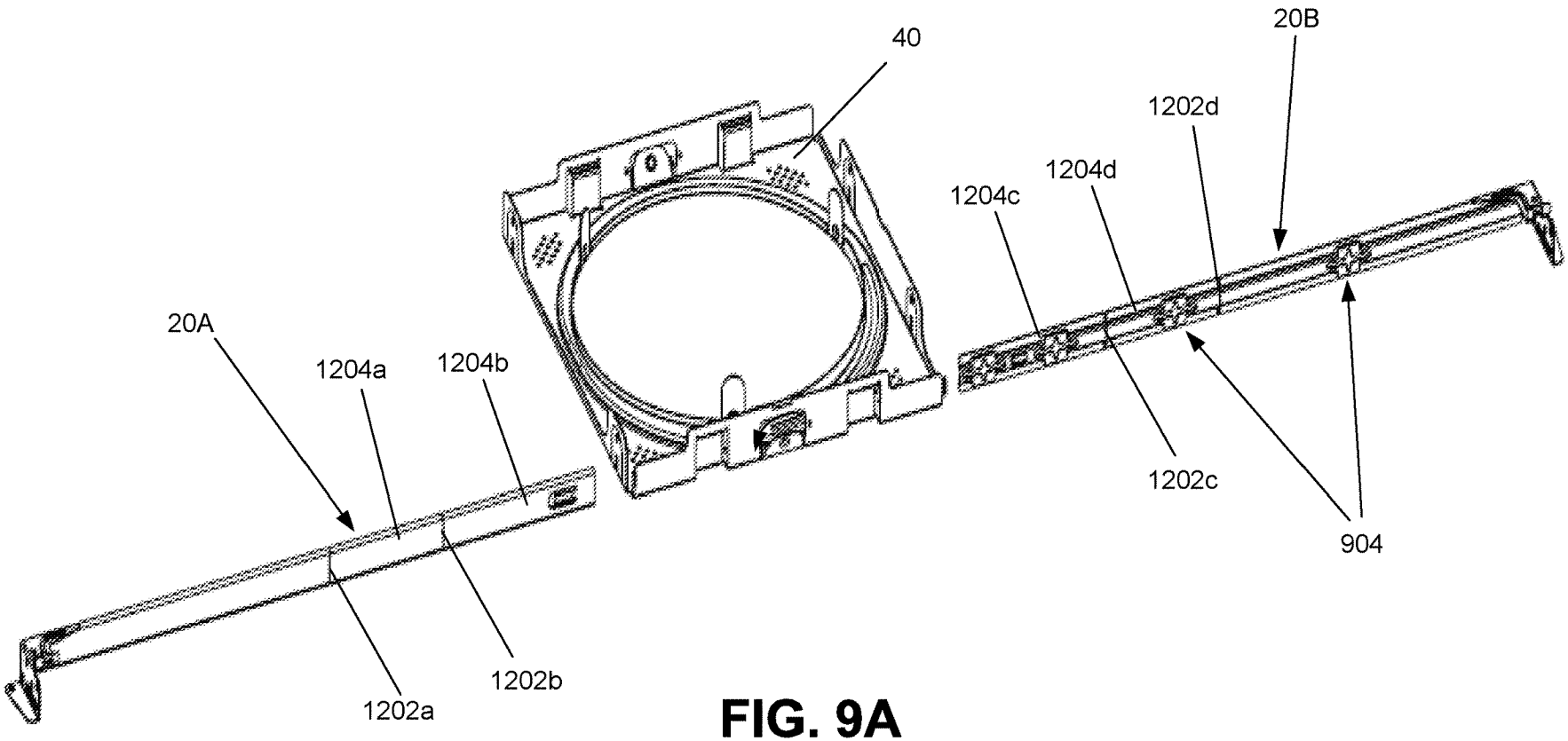
FIG. 9A illustrates a top isometric view of a plaster plate and the disassembly of a single hanger assembly which comprises two sections: a closed channel section and an open channel section.

Referring now to FIG. 9A, this figure illustrates a top isometric view of a plaster plate 40 and the disassembly of a single hanger assembly 20 which comprises two sections: a closed channel section 20A and an open channel section 20B. The open channel section 20B may further comprise bump-outs 904 described in further detail below. The closed channel section 20A mates with the open channel section 20B in order to form a single telescoping hanger assembly 20.

Figure 9B:
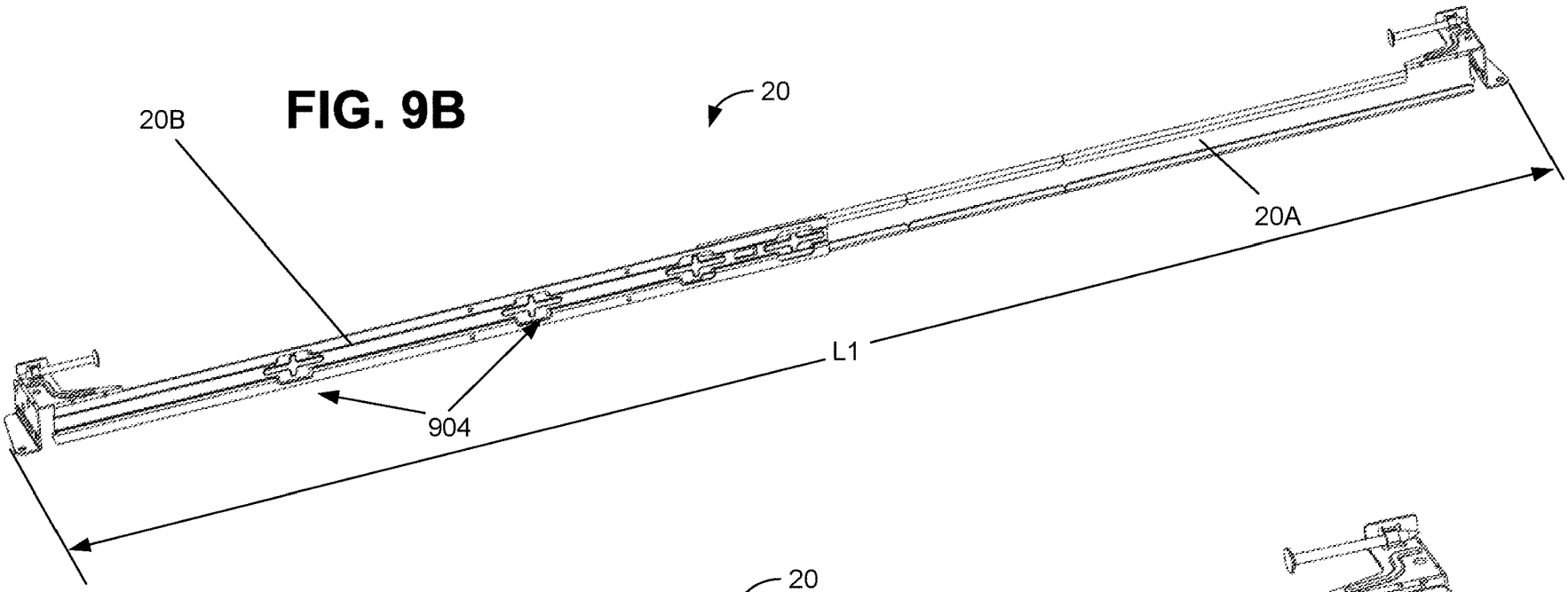
FIG. 9B illustrates a single hanger assembly in which an open channel section has mated with a closed channel section and is positioned such that the hanger assembly is in a fully extended state.
Figure 9C:
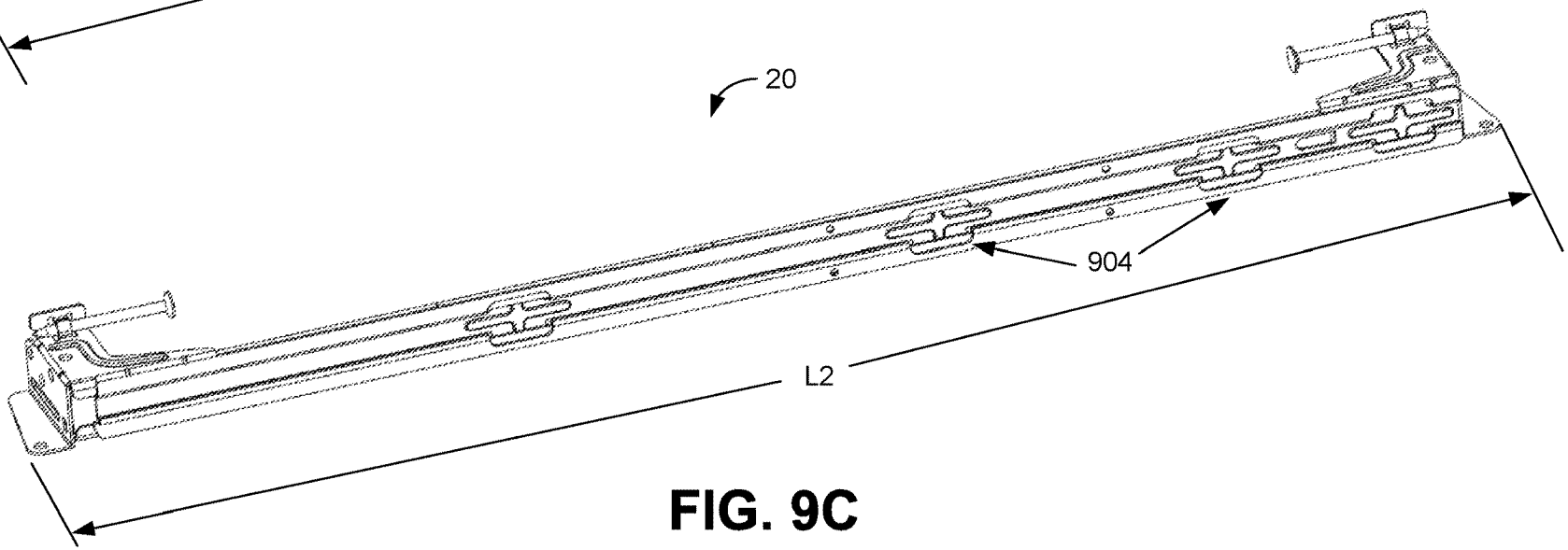
FIG. 9C illustrates a single hanger assembly in which an open channel section has mated with a closed channel section and is positioned such that the hanger assembly is in a fully contracted state.

That is, the closed channel section 20A and open channel section 20B mate together and slide along a shared length when mated together as illustrated in FIGS. 9B and 9C described below. Usually, a single hanger assembly 20 will slide through portions of the plaster plate 40 such that a single hanger assembly supports one side of the plaster plate. A plaster plate will generally have two hanger assemblies 20 for supporting two separate sides [See prior FIGS. 1-8].

Each channel section 20A, 20B has subsections 1204 which are divided according to score/cut lines 1202. Specifically, closed channel section 20A has two score lines 1202*a* and 1202*b* which provide for two subsections 1204*a* and 1204*b*. Meanwhile, open channel section 20B has two score lines 1202*c* and 1202*d* which provide for two subsections 1204*c* and 1204*d*. Each of these subsections 1204 may be removed from an entire channel section 20.

The first subsections 1204*b*, 1204*c* of channel sections 20A, 20B are each about 3.5 Inches long while second subsections 1204*a*, 1204*d* of channel section 20B are each about 2.5 inches long. The system 101 with full length hanger bar assemblies 20 (as illustrated in FIG. 1 with subsections 1204 not removed) may be installed to between supporting structures (i.e. ceiling beams) having a spacing from about 13.5 Inches to about 24.25 Inches. When the first subsections 1204*b*, 1204*c* of channel sections 20A, 20B removed, the spacing distance is adjustable between about 10.0 Inches to about 17.0 inches. When the second two subsections 1204*a*, 1204*d* of both channel sections 20A, 20B are removed, the distance is adjustable between about 7.5 Inches to 10.0 inches.

The score lines 1202*a*, 1202*b*, 1202*c*, 1202*d* are stamped into one side (outside surface) of each channel section 20A, 20B. The depth of each score line 1202 may be between about 0.005 to about 0.010 of an inch. Additional or fewer score lines 1202 forming additional or fewer subsections 1204 are possible and are included within the scope of this disclosure. How each subsection 1204 is removed from the larger channel section 20 is described in more detail below in connection with FIGS. 10-17.

Referring now to FIG. 9B, this figure illustrates a single hanger assembly 20 in which an open channel section 20B [left side] has mated with a closed channel section 20A [right side] and is positioned such that the hanger assembly is in a fully extended state. The open channel section 20B has bump-outs 904 which engage sections/elements of the closed channel section 20A. According to this exemplary embodiment, the hanger assembly 20 is positioned in a fully extended state. In the fully extended state, the hanger assembly 20 has a length dimension L1. The length dimension L1 may be between about 24.25 inches and about 24.50 inches, and preferably is about 24.3 inches. However, other extended lengths L1 are possible and are included within the scope of this disclosure.

Referring now to FIG. 9C, this figure illustrates a single hanger assembly 20 in which an open channel section 20A has mated with a closed channel section 20B and is positioned such that the hanger assembly 20 is in a fully contracted state. The open channel section 20B has bump-outs 904 which engage sections/elements of the closed channel section 20A. According to this exemplary embodiment, the hanger assembly 20 is positioned in a fully contracted state. In the fully contracted state, the hanger assembly 20 has a length dimension L2. The length dimension L2 may be between about 13.0 inches and 14.0 inches, and preferably is about 13.25 inches. However, other fully contracted lengths L1 are possible and are included within the scope of this disclosure.

Figure 9D:
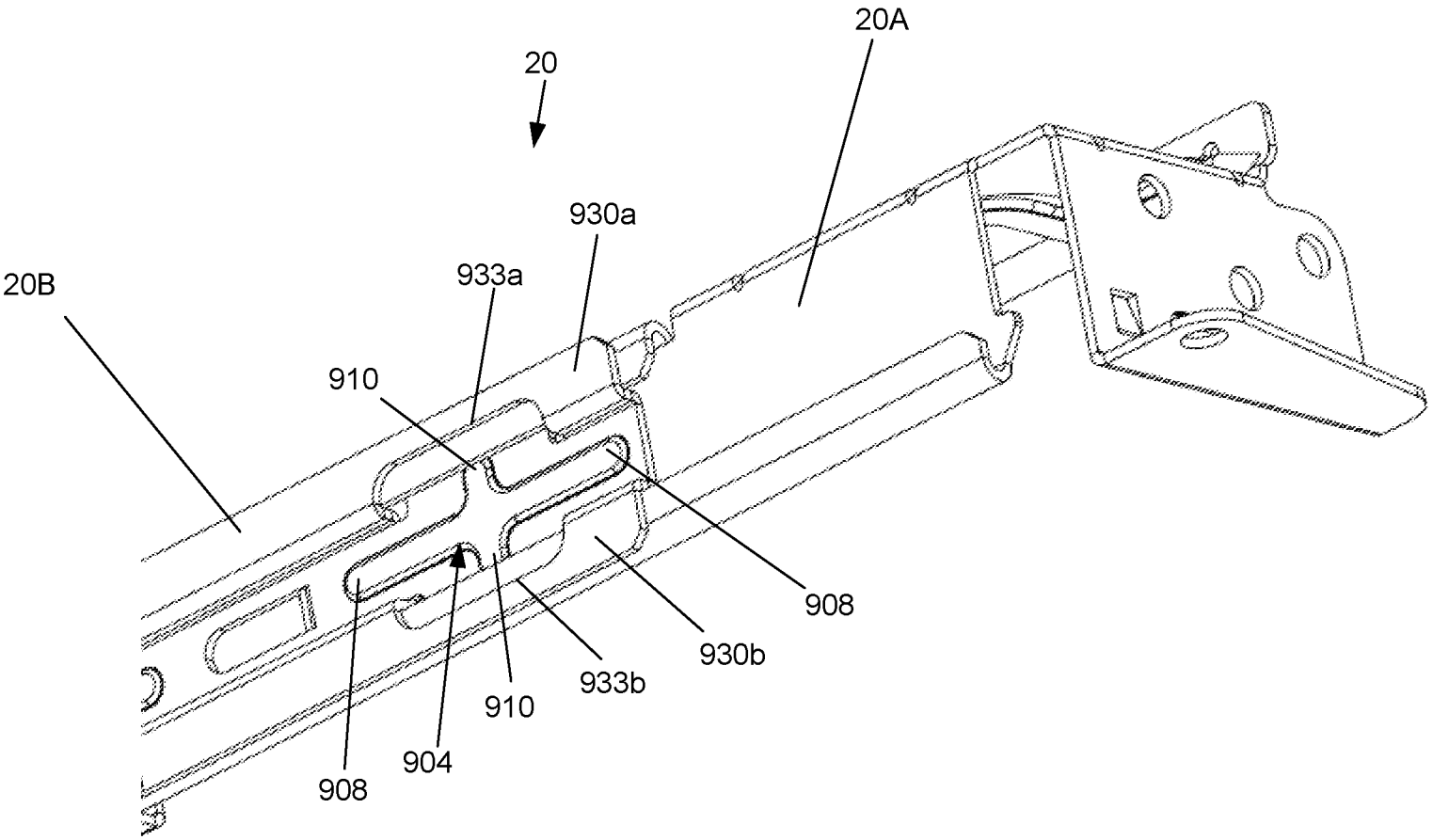
FIG. 9D illustrates a side, isometric view of a single hanger bar assembly.

Referring now to FIG. 9D, this figure illustrates a side, isometric view of a single hanger bar assembly 20. The single hanger bar assembly 20 is formed by an open channel section 20B and a closed channel section 20A. The open channel section 20B may comprise bump-outs 904 for engaging with the closed channel section 20A. The open channel section 20B may further comprise an upper wall 930*a* with cut-out 933*a*. The open channel section 20B may also comprise a lower wall 930*b* which also has a cut-out section 933*b*. Each cut-out section 933 may comprise a "U-shape." The cut-out sections 933 of the wall sections 930 of the open channel section 20B may be formed generally around each region/location which has bump-outs 904.

Each bump-out 904 of an open channel section 20B may comprise vertical sections 910 that engage portions of the closed section 20A. Each bump-out of an open channel section 20B may further comprise horizontal sections 908 which do not engage the open channel section 20A. The horizontal sections 908 of each bump-out 904 may increase the strength of the open channel section 20B at its location. Meanwhile, each vertical section 910 of a bump-out 904 may increase strength of the open channel section 20B at its location as well as providing contact points/engagement points with the closed channel section 20A.

Figure 9E:
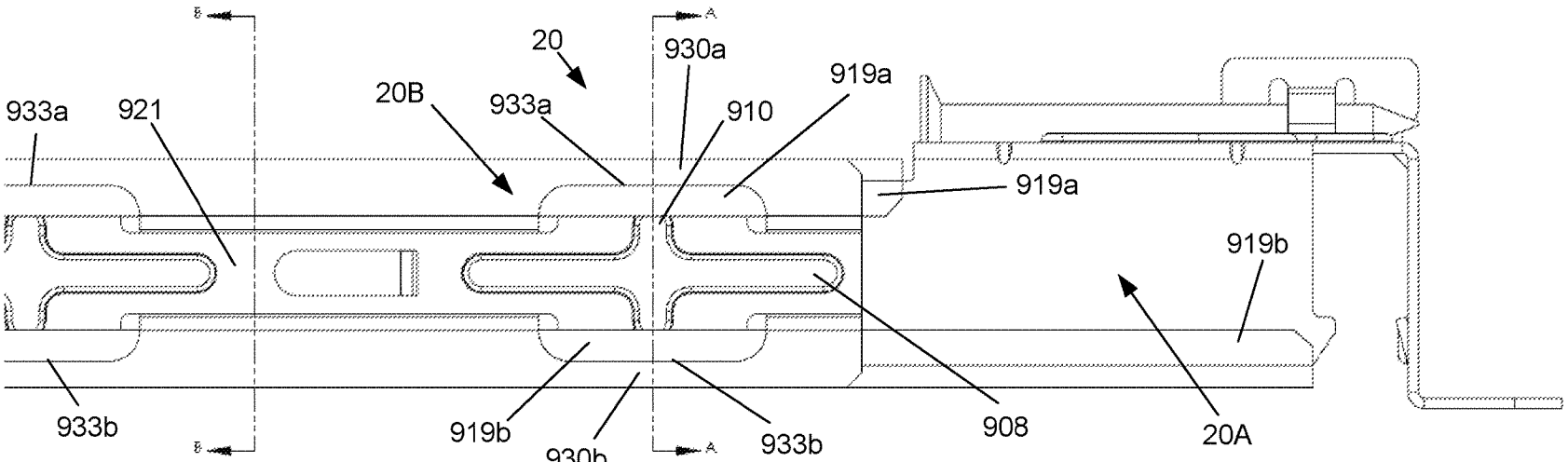
FIG. 9E illustrates a side view of a single hanger bar assembly according to one exemplary embodiment.
Figure 9G:
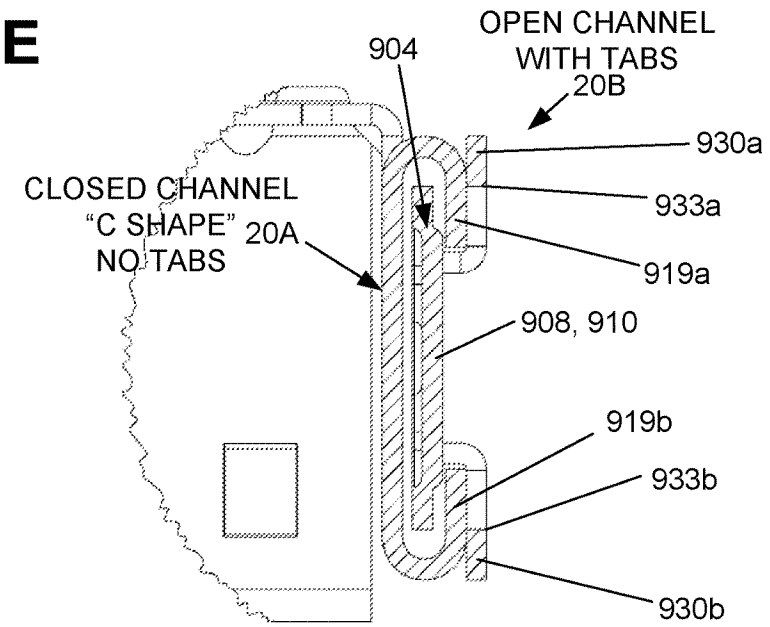
FIG. 9G illustrates a cross-sectional view of the hanger bar assembly of FIG. 9E taken along the cut line A-A of FIG. 9E.
Figure 9F:
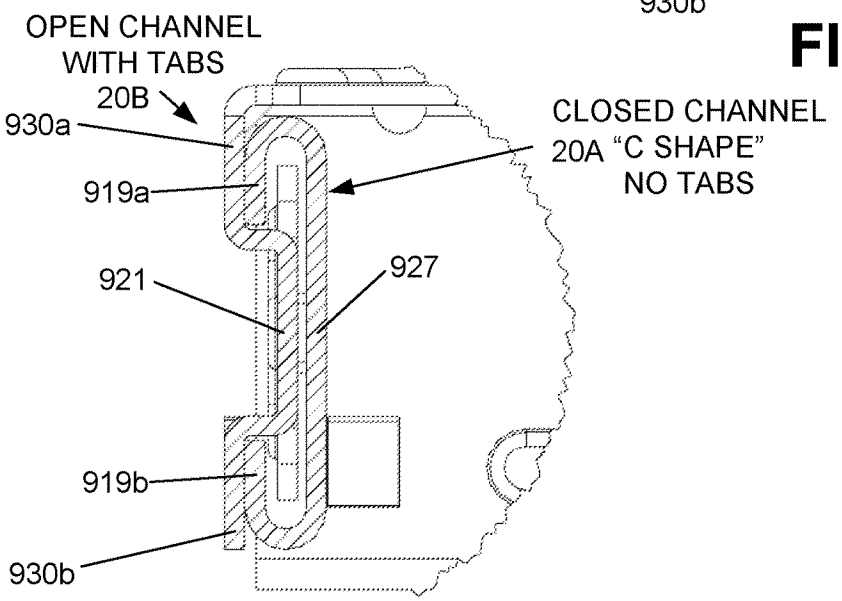
FIG. 9F illustrates a cross-sectional view of the hanger bar assembly of FIG. 9E taken along the cut line B-B of FIG. 9E.

Referring now to FIG. 9E, this figure illustrates a side view of a single hanger bar assembly 20 according to one exemplary embodiment. FIG. 9E illustrates how the closed channel section 20A has two curved wall sections 919*a*, 919*b*. These curved wall sections 919*a*, 919*b* help form the "C-shaped" cross-section of the closed channel section 20A as illustrated in FIGS. 9F and 9G described below. FIG. 9E also shows a central bottom portion 921 of the open channel section 20B which is further illustrated in the cross-sectional view of FIG. 9F.

Referring now to FIG. 9F, this figure illustrates a cross-sectional view of the hanger bar assembly 20 of FIG. 9E taken along the cut line B-B of FIG. 9E. The closed channel section 20A has a "C-shaped" cross-section where the first and second wall sections 919*a*, 919*b* form end portions of the "C-letter" geometry. The bottom portion 921 of the open channel section 20B is also shown which is close proximity to a mid-section 927 of the closed channel 20A. The upper and lower wall sections 930 of open channel section 20B contact and slide along the first and second wall sections 919*a*, 919*b* of the closed channel section 20A.

Referring now to FIG. 9G, this figure illustrates a cross-sectional view of the hanger bar assembly 20 of FIG. 9E taken along the cut line A-A of FIG. 9E. This figure demonstrates how the bump-outs 904 are created within the open channel section 20B where one side of the open channel 20B is stamped or pressed out to form the bump-outs 904. Each bump-out 904 has a "cross-shape" (see FIG. 9E) and may be formed by a cross-shaped stamping tool.

Figures 9H, 9I, 9J, 9K:
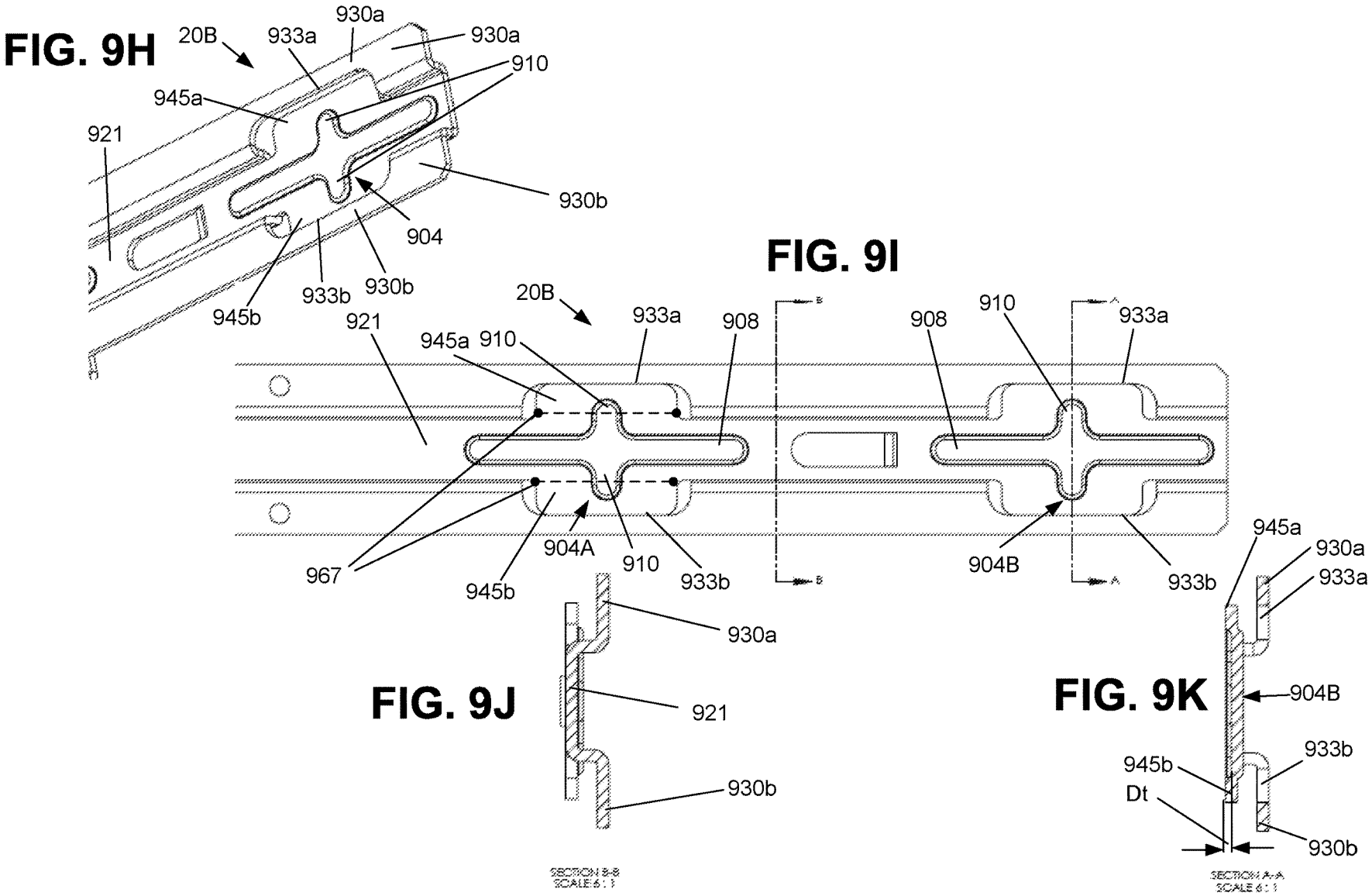
FIG. 9H is a side, isometric view of a single open channel section that is used to form a hanger bar assembly.
FIG. 9I is a side view of a single open channel section that is used to form a hanger bar assembly.
FIG. 9J illustrates a cross-sectional view of the single open channel section of FIG. 9I taken along the cut line B-B of FIG. 9I.
FIG. 9K illustrates a cross-sectional view of the single open channel section of FIG. 9I taken along the cut line A-A of FIG. 9I.

Referring now to FIG. 9H, this figure is a side, isometric view of a single open channel section 20B that is used to form a hanger bar assembly 20. This figure shows the detail of the bump-outs 904 more clearly as well as the cut-out sections 933 of each wall 930. The cut-out sections 933 generally have a rectangular shape which surround each bump-out 904. This figure also shows rectangular sections 945*a*, 945*b* which extend above the bottom portion 921 of open channel section 20A and provide support for the vertical sections 910 of each bump-out 904.

These rectangular sections 945*a*, 945*b* shown in FIG. 9H correspond/generally track the rectangular or U-Shape cut-out sections 933 that exist in a geometric plane above the rectangular sections 945*a*, 945*b*. The rectangular sections 945*a*, 945*b* as well as the vertical sections 910 of the bump-outs 904 generally engage the curved wall sections 919*a*, 919*b* of the closed channel section 20A [See FIG. 9G].

Referring now to FIG. 9I, this figure is a side view of a single open channel section 20B that is used to form a hanger bar assembly 20. According to this view, two bump-outs 904A,B are illustrated. Usually, each open channel section 20B will have about four bump-outs 904 [See FIG. 9A] to engage an open channel section 20A [not visible in FIG. 9I, but see FIG. 9A]. However, other amounts of bump-outs 904 are possible and are within the scope of this disclosure as understood by one of ordinary skill in the art.

In FIG. 9I, phantom geometrical lines 967 have been provided to help identify the rectangular sections 945*a*, 945*b* discussed above in connection with FIG. 9H. These phantom geometrical lines 967 are provided to define the rectangular sections 945*a*, 945*b* relative to the bottom portion 921 of the open channel section 20B. As noted above, the rectangular sections 945*a*, 945*b* as well as the vertical sections 910 of the bump-outs 904 generally engage the curved wall sections 919*a*, 919*b* of the closed channel section 20A [not visible in FIG. 9I, but see FIG. 9G].

Referring now to FIG. 9J, this figure illustrates a cross-sectional view of the single open channel section 20B of FIG. 9I taken along the cut line B-B of FIG. 9I. In this figure, the walls 930*a* of the open channel section 20B are more visible and this view shows the relative height/depth between the walls 930 and the bottom section 921 of the open channel section 20B.

Referring now to FIG. 9K, this figure illustrates a cross-sectional view of the single open channel section 20B of FIG. 9I taken along the cut line A-A of FIG. 9I. In this figure, the cut-out sections 933 are more visible. As noted previously, these cut-out sections 933 are formed in each wall 930 and are generally formed to circumscribe each of the bump-outs 904. However, it is noted that the horizontal 908 of each bump-out generally extend beyond a length formed by the cut-out sections 933.

Each bump-out 904 formed in an open channel section 20B may have a depth/distance dimension Dt. That is, each horizontal portion 908 and vertical portion may have this Dt dimension. This Dt dimension may have a magnitude between about 0.01 and about 0.03 of an inch. However, other magnitudes for this Dt dimension are possible and are included within the scope of this disclosure.

Figure 10:
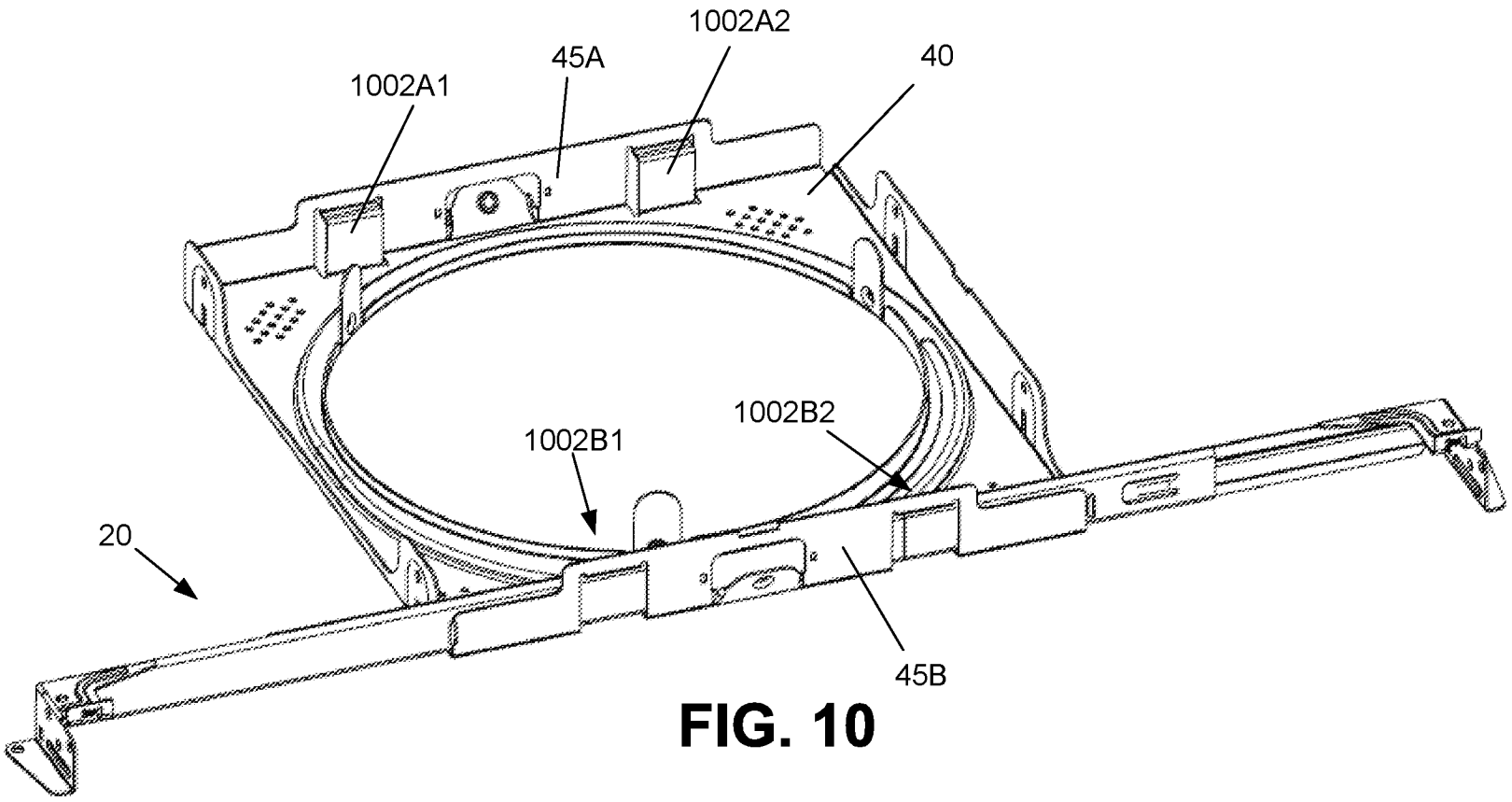
FIG. 10 illustrates another top isometric view of a plaster plate but with a single hanger assembly in an assembled state and partially contracted with respect to its telescoping action of the closed channel section mating with the open channel section.

Referring now to FIG. 10, this figure illustrates another top isometric view of a plaster plate 40 but with a single hanger assembly 20 in an assembled state and partially contracted with respect to its telescoping action of the closed channel section mating with the open channel section. As illustrated in FIG. 10, the plaster plate 40 may comprise two walls 45A, 45B. Each wall 45 of plaster plate 40 may comprise two enveloping sections 1002 through which two channel sections 20A, 20B may penetrate therethrough. Specifically, the first wall 45A of plaster plate may comprise two enveloping sections 1002A1 and 1002A2. The second wall 45B may comprise two enveloping sections 1002B1 and 100262 for receiving one or two channel sections 20A, 20B of a single hanger assembly 20.

Figure 11:
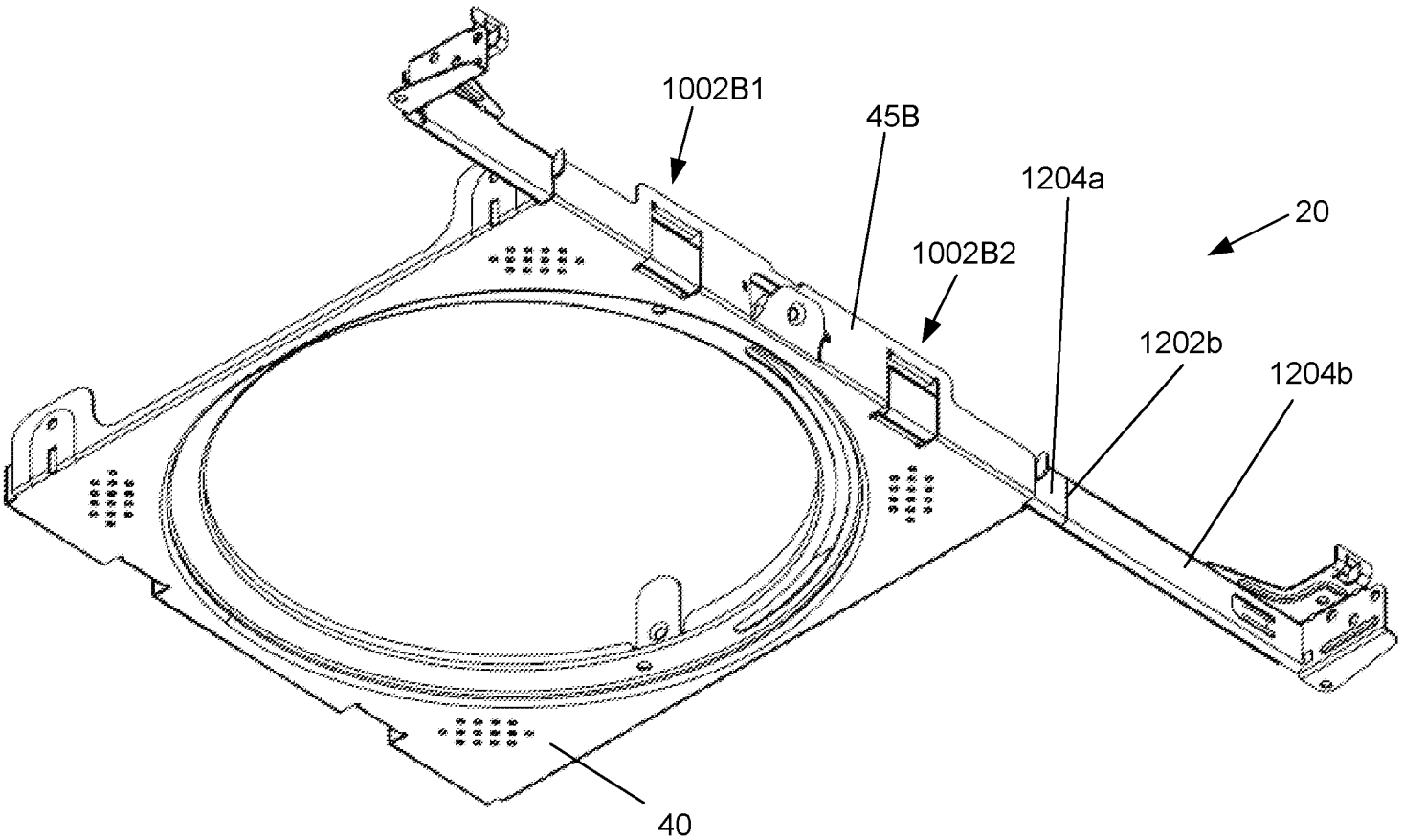
FIG. 11 illustrates a bottom isometric view of the plaster plate of FIG. 10 and the single hanger assembly in an assembled state and partially contracted with respect to its telescoping action of the closed channel section mating with the open channel section.

Referring now to FIG. 11, this figure illustrates a bottom isometric view of the plaster plate 40 of FIG. 10 and the single hanger assembly 20 in an assembled state and partially contracted with respect to its telescoping action of the closed channel section mating with the open channel section. Similar to FIG. 10, this FIG. 11 illustrates how the single hanger assembly 20 engages with one side of the plaster plate 40 and specifically wall 45 which has enveloping sections 1002B1 and 100262 for receiving sections of the hangar assembly. When both channel sections 20A, 20B are in a near fully contracted state or fully contracted relative to the telescoping action, in this position the last segment 1204*b* of closed channel section 20A shown in FIGS. 11-12 is not mated with bump-outs 904 or rectangular sections 945 shown in FIGS. 9C, 9H and 9I.

Figure 12:
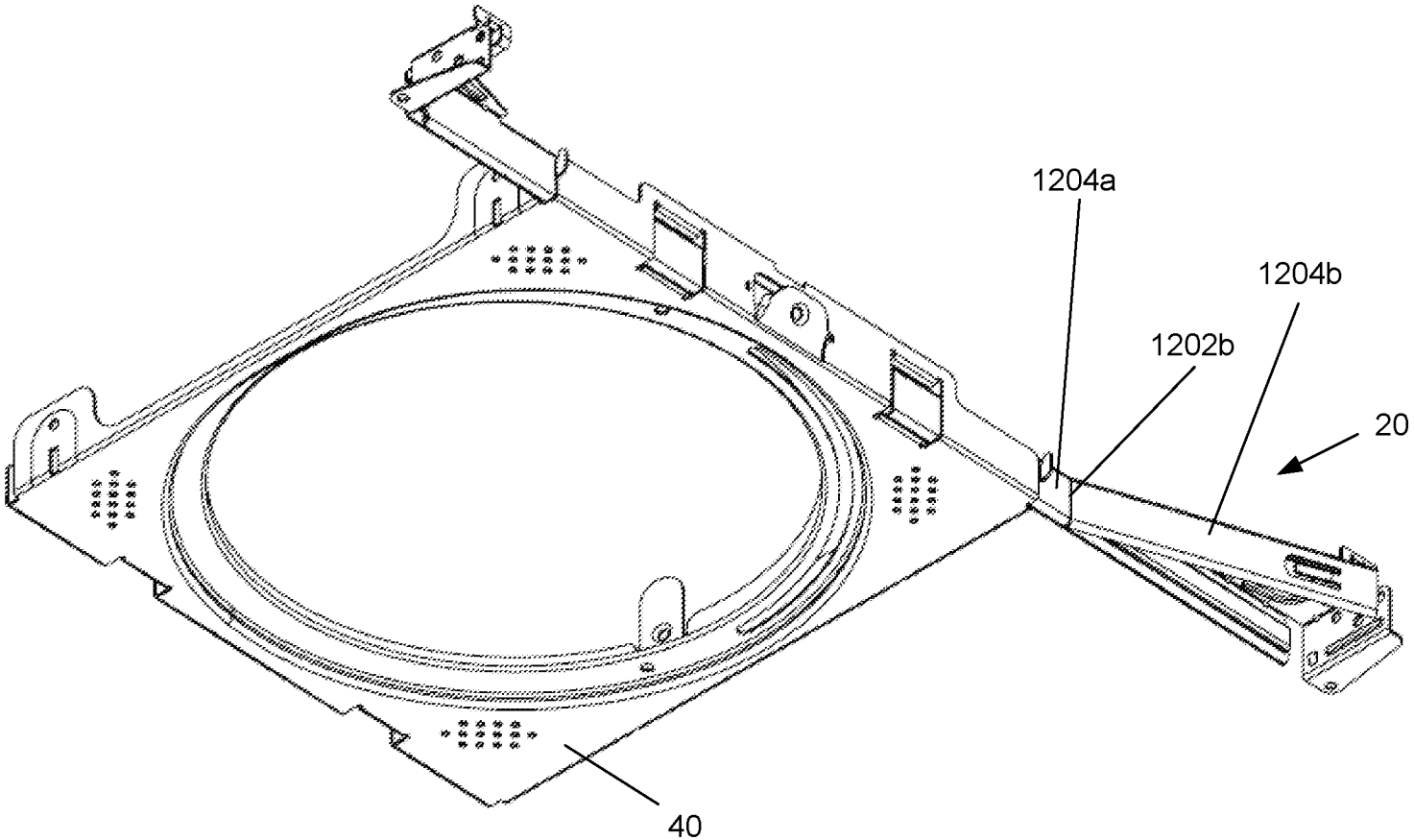
FIG. 12 illustrates a bottom isometric view of the plaster plate of FIG. 10 similar to that illustrated in FIG. 11, however, a subsection of a closed channel section of a single hanger assembly is being deflected/bent for eventual removal from the system.

Referring now to FIG. 12, this figure illustrates a bottom isometric view of the plaster plate 40 of FIG. 10 similar to that illustrated in FIG. 11, however, in this figure, a subsection 1204*b* of a closed channel section 20A is being deflected/bent for eventual removal from the system 101 along the score line 1202*b*. Specifically, first subsection 1204*b* of channel section 20A is being bent/deflected along a score/cut line 1202*b*. Score lines 1202 of each channel section 20 have been described above in connection with FIG. 9A. As noted above, when both channel sections 20A, 20B are in a near fully contracted state or fully contracted state relative to the telescoping action, in this position the last segment 1204*b* of closed channel section 20A shown in FIG. 12 is not mated with bump-outs 904 or rectangular sections 945 shown in FIGS. 9C, 9H and 9I.

Figure 13:
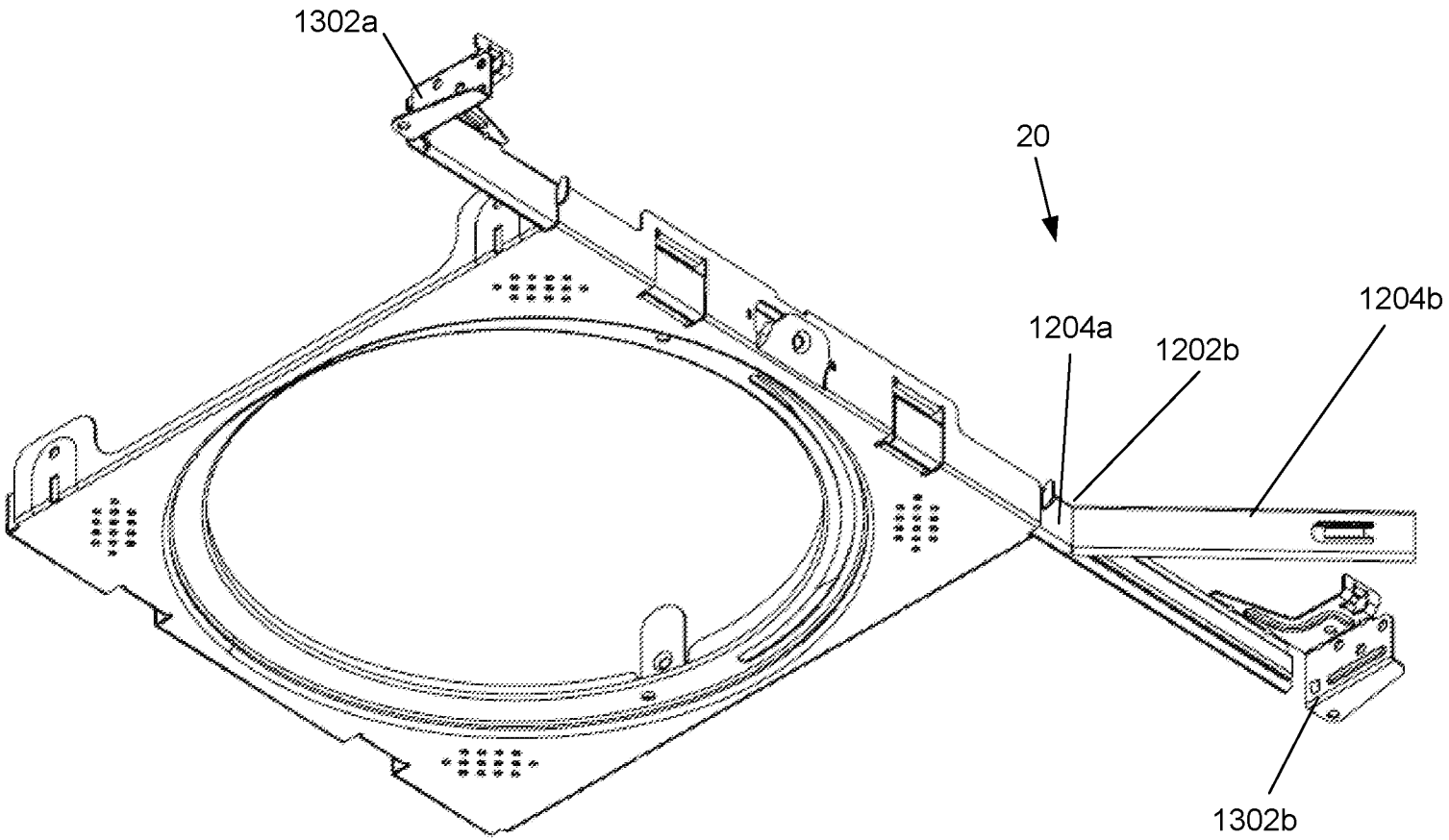
FIG. 13 illustrates a bottom isometric view of the plaster plate similar to that illustrated in FIG. 12, however, in this figure, the subsection of the closed channel section is deflected/bent even further along the score line relative to FIG. 12.

The score lines 1202 allow an luminaire installer to remove subsections 1204 of each channel section 20A, 20B during installation of the system 101. Referring now to FIG. 13, this figure illustrates a bottom isometric view of the plaster plate 40 similar to that illustrated in FIG. 12, however, in this figure, the subsection 1204*b* of the closed channel section 20A is deflected/bent even further along the score line 1202*b* relative to FIG. 12.

The first subsection 1204*b* is closest to a first end 1302*b* of the hanger bar assembly 20. The first subsection 1204*b* is furthest from a second end 1302*a* of the hanger bar assembly 20.

A fully contracted state for the hangar bar assembly 20 having telescoping action relative to channel sections 20A, 20B exists when all subsections/segments 1204 of each channel section 20A, 20B illustrated in FIGS. 9B and 9C are present and when subsections/segments 1204 for both channel sections 20A, 20B are contacting each other. In this fully contracted state relative to the telescoping action of the hanger bar assembly 20 [or in a state slightly expanded from full contraction relative to the telescoping action; such a state slightly expanded from the full contraction state is one that cannot be longer than a predetermined distance—which is about 0.5 an inch according to one exemplary embodiment], the only segment/subsection 1204 of the hanger bar assembly 20 which can be removed when all segments/subsections 1204 are present is subsection/segment 1204*b* of closed channel section 20A. However, other predetermined distances for those beyond the full contraction state are possible and are included within the scope of this disclosure.

Subsection 1204*b* of closed channel section 20A is the only segment 1204 which can be removed first from the hanger bar assembly 20 because, when the hanger bar assembly 20 is in the fully contracted state or in a state slightly expanded from this fully contracted state, in this position the last segment 1204*b* of closed channel section 20A shown in FIG. 12 is not mated with bump-outs 904 or rectangular sections 945 shown in FIGS. 9C, 9H and 9I, described above.

After subsection 1204*b* is removed from the closed channel section 20A as the first segment that can be removed, a luminaire installer has a choice on which may be the next subsection/segment 1204 to remove from the hanger bar assembly 20 formed by the two channel sections 20A, 20B. At the luminaire installer's option, the next subsection/segment that can be removed can either be subsection 1204*a* of the closed channel section 20A or subsection 1204*c* of the open channel section 20B [as illustrated in FIG. 14 described below].

Figure 14:
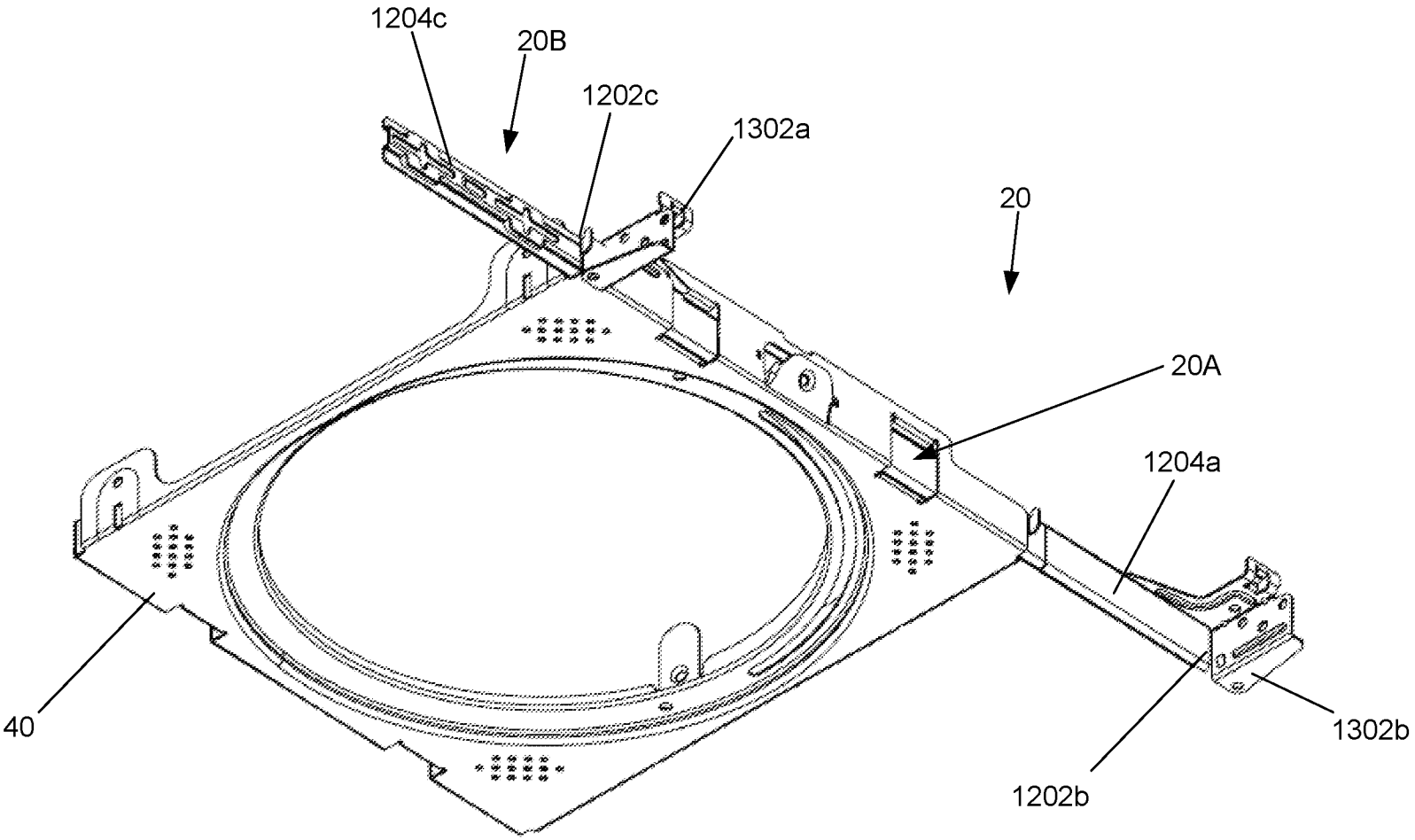
FIG. 14 illustrates the hanger bar assembly with the first subsection of channel section removed and the second end of hanger assembly repositioned closer to plaster plate.

Referring now to FIG. 14, this figure illustrates the hanger bar assembly 20 with the first subsection 1204*b* of channel section 20A removed and the second end 1302*a* of hanger assembly 20 repositioned closer to plaster plate 40. With the first subsection 1204*b* removed, this allows the closed channel section 20A to move/translate along the open channel section 20B so that the first end 1302 of the hanger bar assembly 20 may be moved very close to the plaster plate 40.

This movement of the closed channel section 20A exposes the first subsection 1204*c* of the open channel section 20B.

Figure 15:
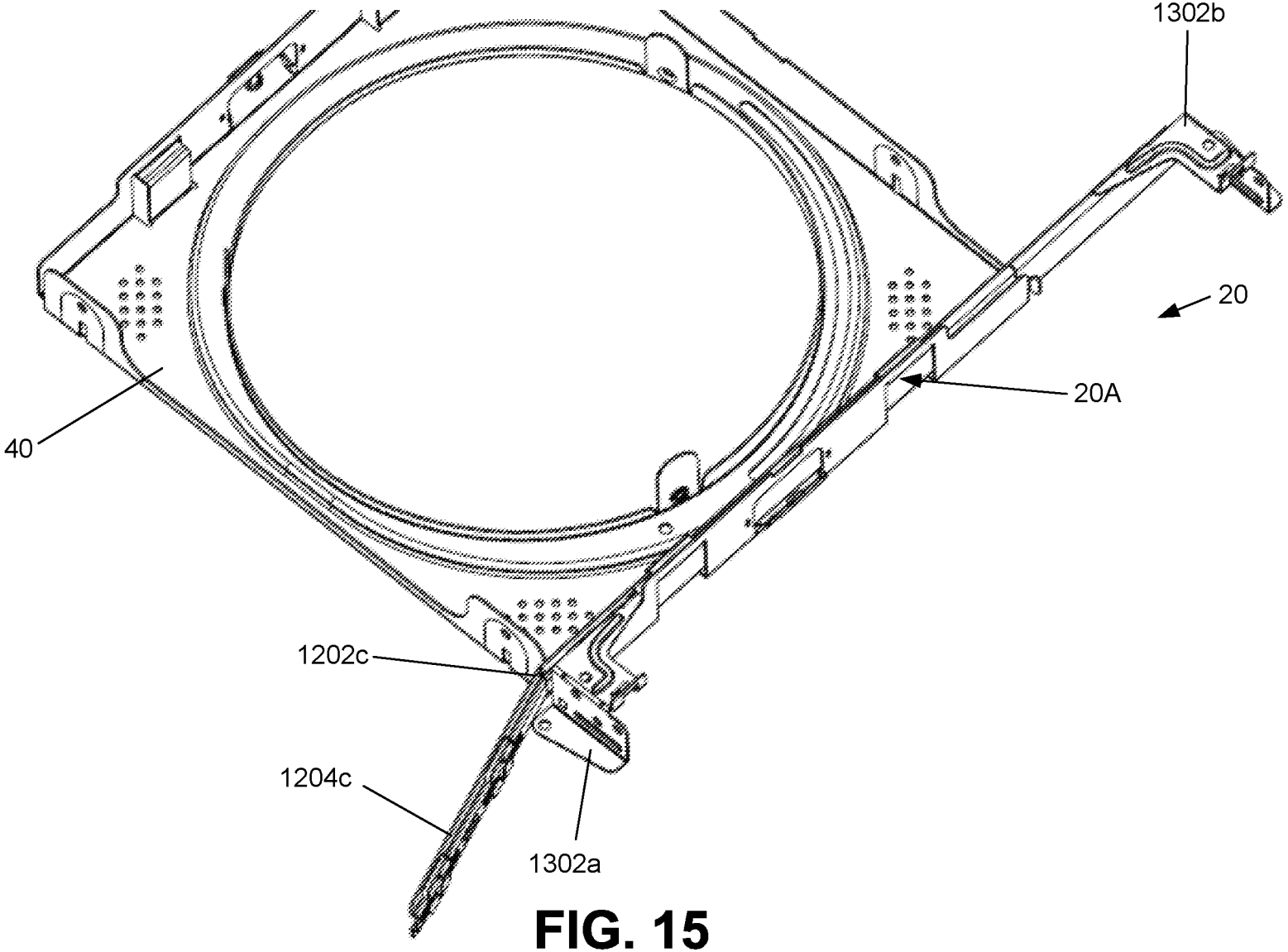
FIG. 15 illustrates the first subsection of the open channel section being deflected/bent along its corresponding score/cut line such that it can be removed from the hanger bar assembly.

Referring now to FIG. 15, this figure illustrates the first subsection 1204*c* of the open channel section 20B being deflected/bent along its corresponding score/cut line 1202*c* such that it can be removed from the hanger bar assembly 20. By removing first subsection 1204*c* of the open channel section 20B and the first subsection 1204*b* of the closed channel section 20A [See FIG. 13 describe above], a luminaire installer has effectively shortened a length of the hanger bar assembly 20 corresponding to the length of these two subsections 1204*b*, 1204*c*. As noted above in connection with FIG. 9A, each of these two subsections may have an effective length of about 3.5 inches. Thus, by removing both of these two subsections 1204*b*, 1204*c*, a luminaire installer has reduced a length of the hanger bar assembly 20 by about 3.5 inches.

Figure 16:
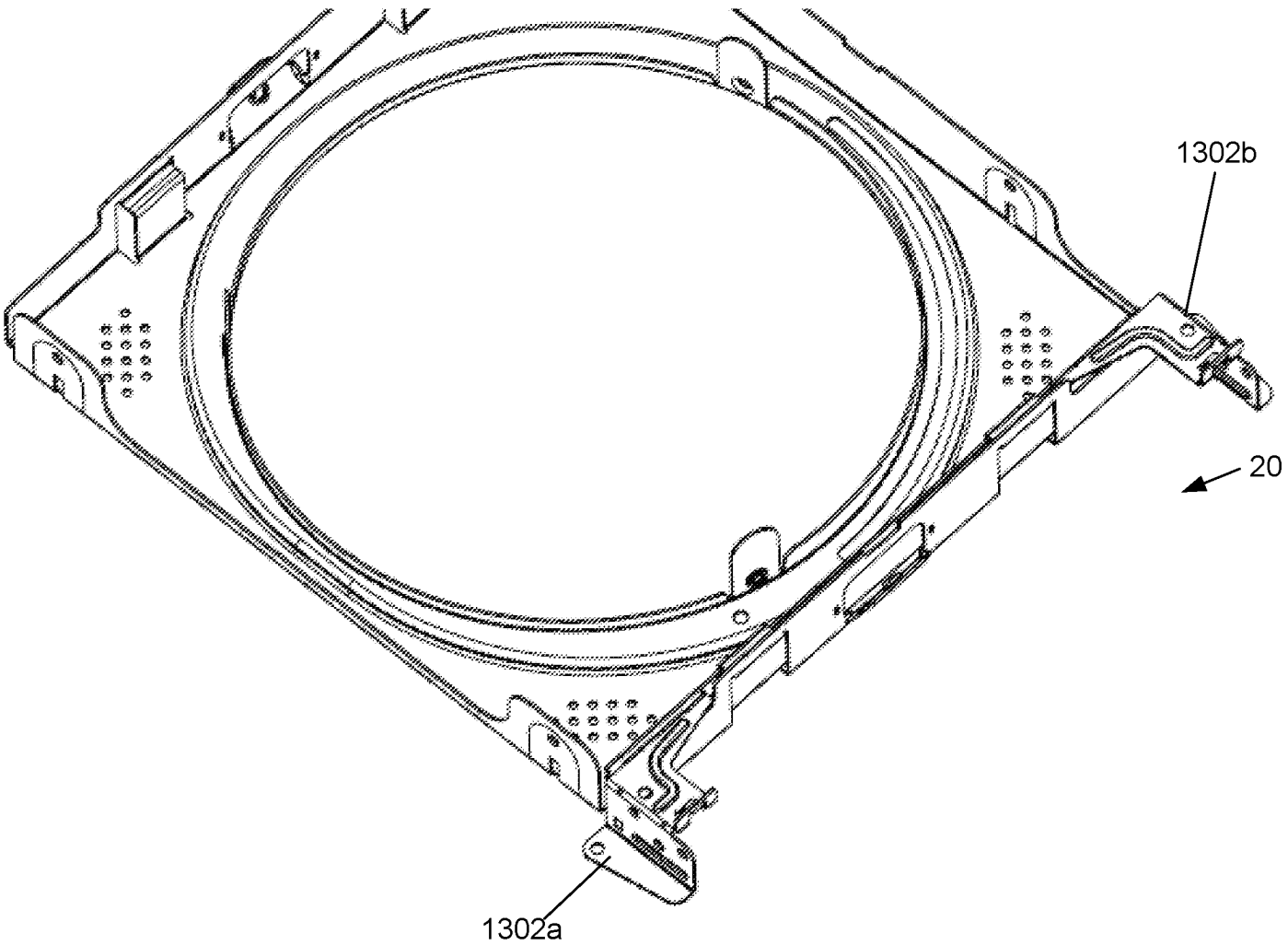
FIG. 16 illustrates a top view of a hanger bar assembly with all four subsections removed from the two channel sections that form the hanger bar assembly.

Referring now to FIG. 16, this figure illustrates a top view of a hanger bar assembly with all four subsections 1204*a-d* removed from the two channel sections 20A, 20B that form the hanger bar assembly 20. As noted previously, first subsections 1204*b*, 1204*c* may have an exemplary length of about 3.5 inches while second subsections may have an exemplary length of about 2.5 inches. Thus, with the first and second subsections removed from the hanger bar assembly 20, then the length of the hanger bar assembly 20 has been decreased by about 6.0 inches.

Figure 17:
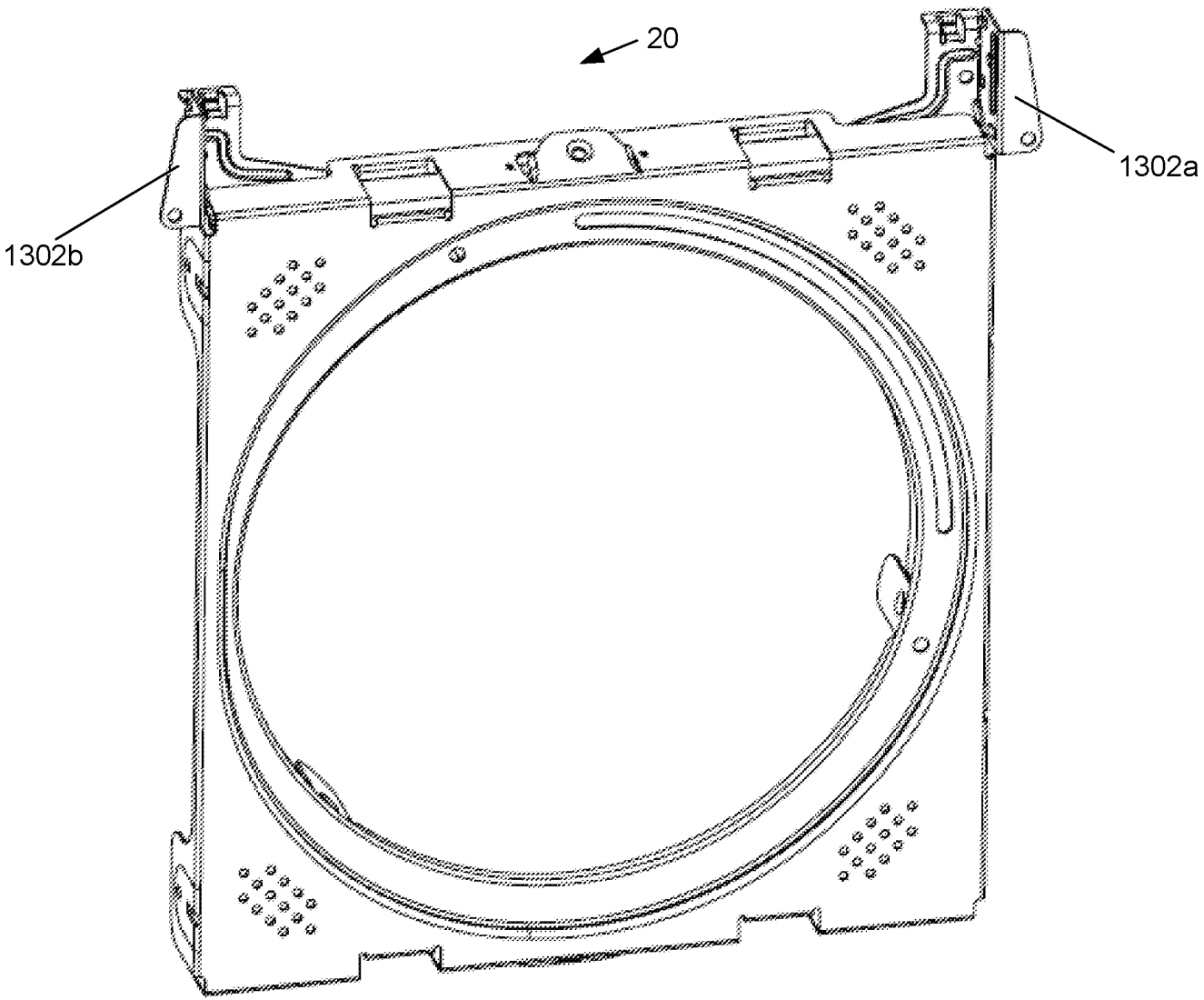
FIG. 17 illustrates a top view of the hanger bar assembly of FIG. 16 in which all four subsections have been removed from the two channel sections that form the hanger bar assembly.

Referring now to FIG. 17, this figure illustrates a top view of the hanger bar assembly of FIG. 16 in which all four subsections 1204*a-d* removed from the two channel sections 20A, 20B that form the hanger bar assembly 20. According to the exemplary embodiments of FIG. 16 and FIG. 17, this reduction in a length of the hanger bar assembly 20 allows the system 101 to be mounted in very tight spacings between support structures (i.e. ceiling beams).

Figure 18:
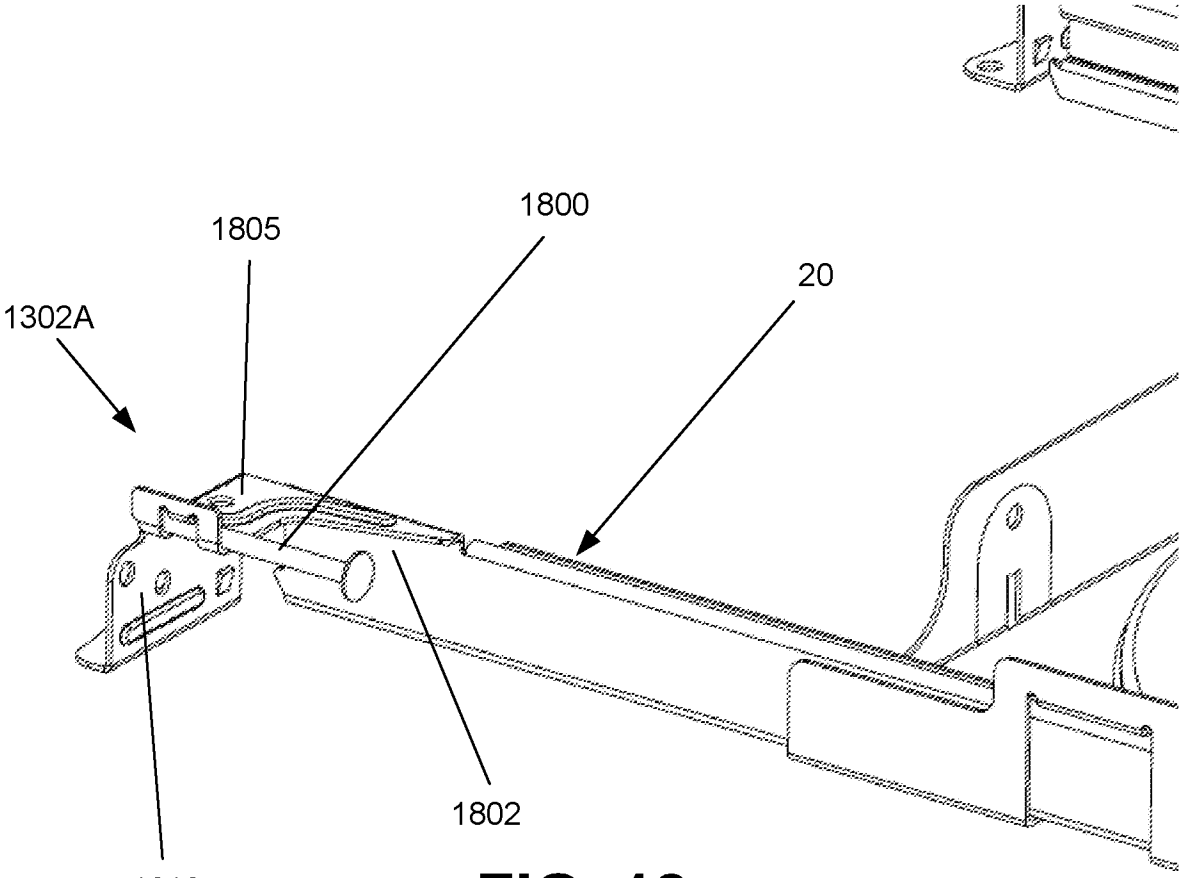
FIG. 18 illustrates a side isometric view of one end of a hanger bar assembly that includes a first segment that supports a fastener and a second segment that extends from the first segment.

Referring now to FIG. 18, this figure illustrates a side isometric view of one end section 1802 of a hanger bar assembly 20 that includes a first segment 1805 that supports a fastener 1800 and a second segment 1810 that extends from the first segment 1805. According to one exemplary embodiment, the end section 1802, the first segment 1805, and second segment 1810 are of a unitary construction made from a single piece of material, such as sheet metal. The first segment 1805 may be formed by bending it from the end section 1802 of the closed channel section 20A by an angle of about 90.0 degrees. That is, when viewing FIG. 18, the closed channel section 20A of hanger bar assembly 20 may define a vertical geometrical plane.

Meanwhile, the first segment 1805 may be bent at about 90.0 degrees relative to the vertical geometrical plane such that the first segment 1805 forms a horizontal geometric plane relative to the vertical geometric plane. Along this horizontal plane defined by the first segment 1805, the first segment 1805 may support and hold the fastener 1800.

Figure 19A:
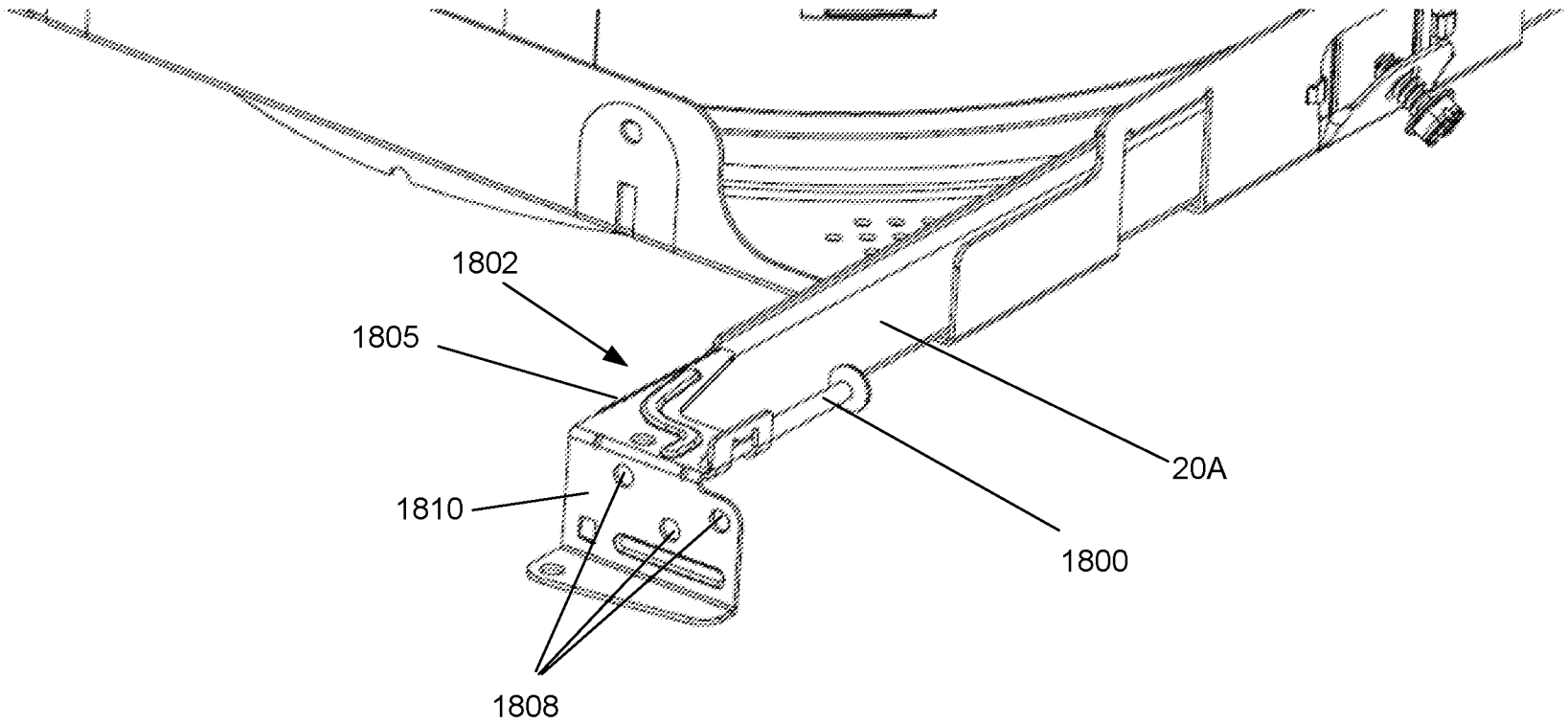
FIG. 19A illustrates another isometric view of one end of the hanger assembly but at a different presentation angle compared to FIG. 18.

Referring now to FIG. 19A, this figure illustrates another isometric view of one end section 1802 of the hanger assembly 20 but at a different presentation angle compared to FIG. 18. As seen in this view of the hanger assembly 20, the second segment 1810 may comprise a plurality of apertures 1808. The apertures 1808 may comprise a circular geometry, however, other shapes are possible, such as elliptical, rectangular, square, etc. Such other exemplary shapes are included within the scope of this disclosure. These apertures 1808 may receive ends of other fasteners (not illustrated). Other fasteners may include nails. The fasteners are not limited to nails, and thus, other fasteners may be used such as, but not limited to, screws, rivets, etc.

Figure 19B:
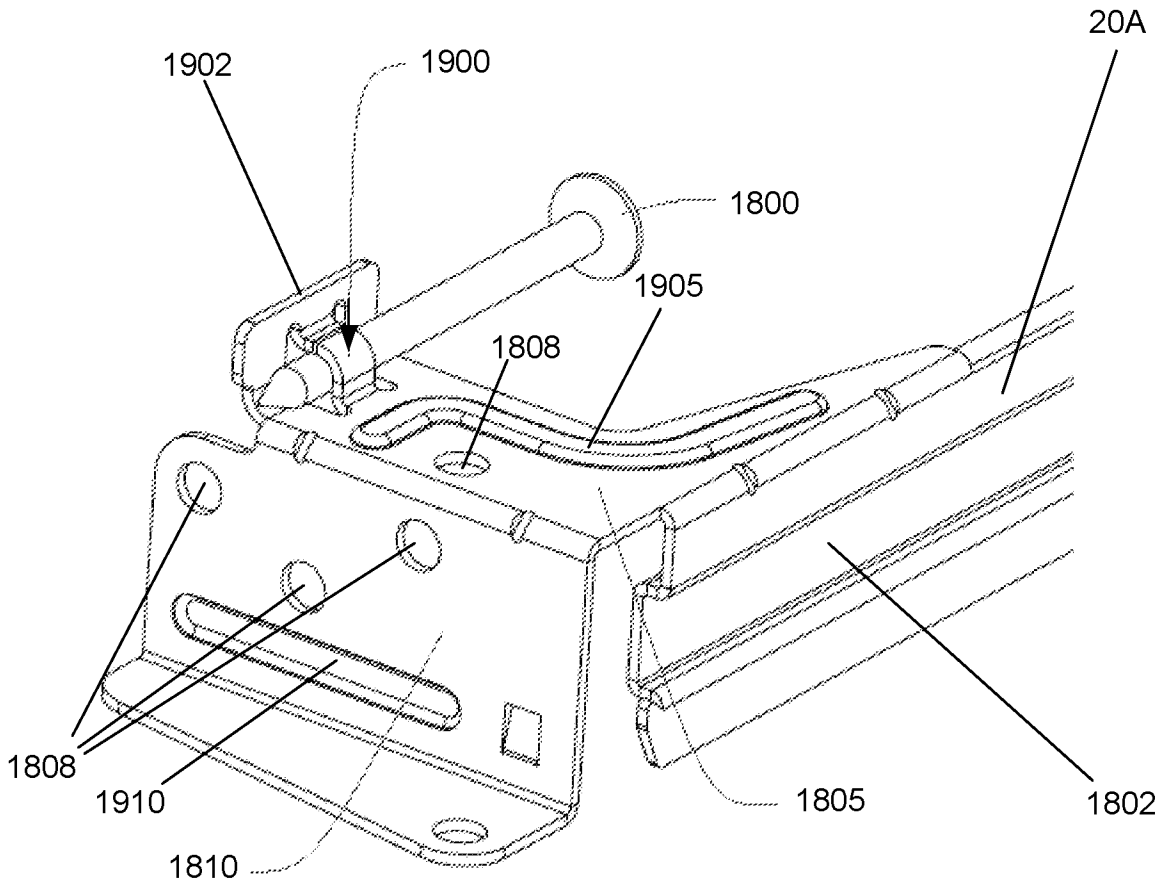
FIG. 19B illustrates another isometric view of one end of the hanger assembly but at a different presentation angle compared to FIG. 19A.

Referring now to FIG. 19B, this figure illustrates another isometric view of one end section 1802 of the hanger assembly 20 but at a different presentation angle compared to FIG. 19A. According to this view, further details of the first segment 1805 which supports the fastener 1800 are more visible. The first segment may comprise a friction-based holding member 1900 that envelopes/surrounds the fastener 1800. The friction-based holding member 1900 may comprise a plurality of sub-segments made from the first segment 1805 of the hanger bar assembly 20.

Specifically, the friction-based holding member 1900 may comprise at least three curved segments formed from the first segment 1805. The friction-based holding member 1900 holds the fastener 1800 in place, but the fastener may rotate and/or translate/move-through the holding member 1900. The first segment 1805 may further comprise an edge portion 1902 which is formed from the first segment 1805 and which is coupled to the friction-based holding member 1900. The edge portion 1902 of the first segment 1805 may extend at about 90.0 degrees relative to the first segment 1805. The edge portion 1902 may define a vertical geometric plane which is parallel to the geometric plane defined by the closed channel section 20A. The ninety degree angle for the edge portion 1902 is optimal for manufacturing but other orientations of the edge portion 1902 are possible; from about 0.0 to about 180 degrees, for example.

The first segment 1805 may further comprise a first rib section 1905 that extends along a surface of the first segment 1805. As shown in FIG. 19B, the first rib section 1905 may have a height/thickness that extends above a geometric plane defined by the remaining surface of the first segment 1805. This first rib section 1905 may be formed by stamping a surface of the first segment 1805 which is on the side opposite to the surface shown in FIG. 19B.

To form the first rib section 1905, the opposite side of the first segment 1805 (not visible in FIG. 19B) is stamped with a depth of about 0.02 of an inch. The rib section 1905 may have geometrical center line along its length that mirrors the perimeter/outer geometry of the first segment 1805. The first rib section 1905 provides additional strength/reinforcement for the entire first segment 1805.

The second segment 1810 having apertures 1808 and which extends at a 90.0 degree angle relative to the first segment 1805 also has a second rib section 1910. The second rib section 1910 is formed in a similar manner like that of the first rib section 1805. However, for this second rib section 1910 the side visible in this view is stamped by a tool. Thus, the second rib section 1910 has a depth which extends below the geometric plane defined by the remaining surface of the second segment 1810 visible in FIG. 19B. To form the second rib section 1905, the side visible in FIG. 19B is stamped with a depth of about 0.02 of an inch. The second rib section 1910 also provides additional strength/reinforcement for the entire second segment 1810.

Figure 20:
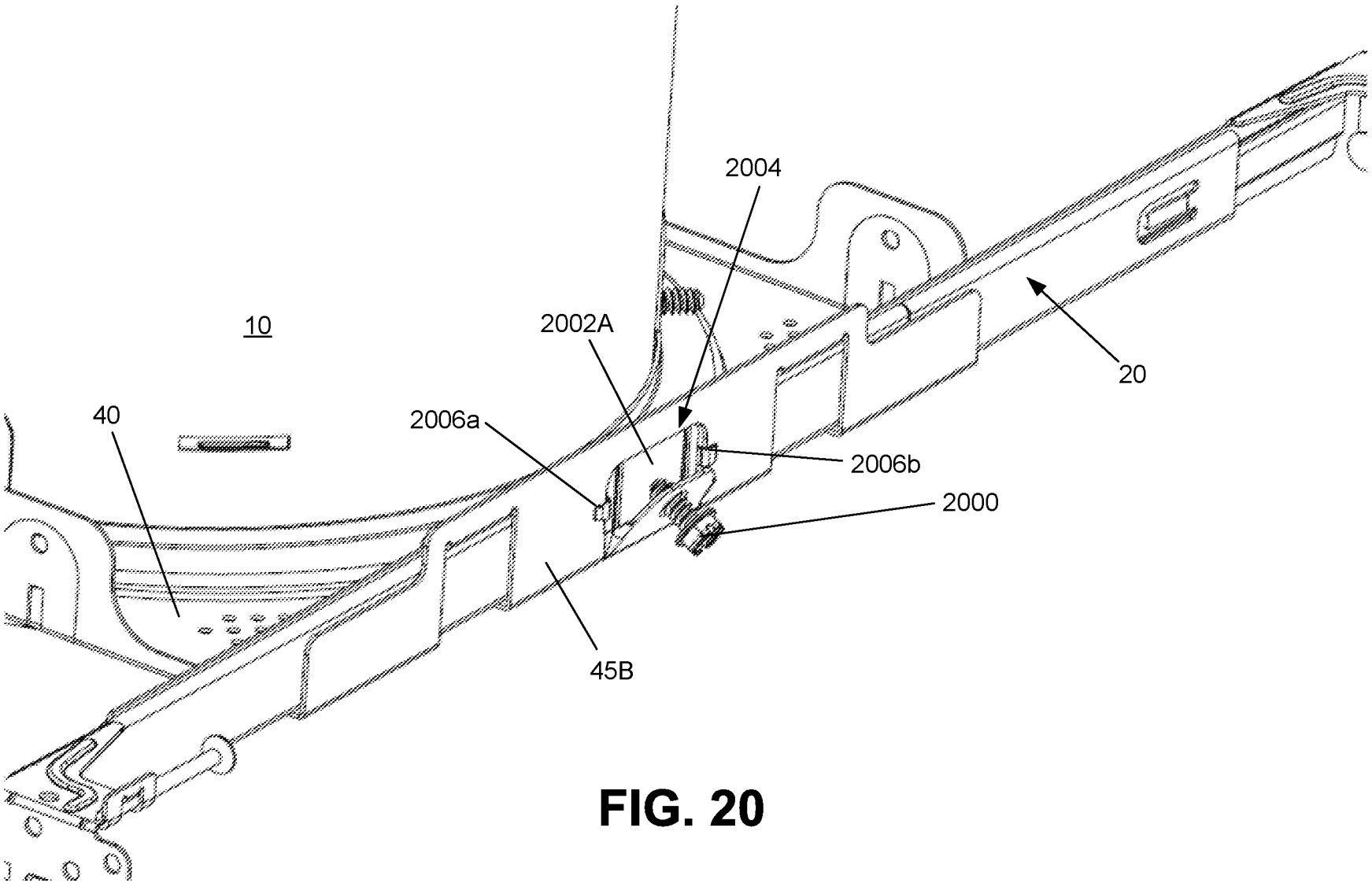
FIG. 20 illustrates a side, isometric view of plaster plate which has a wall with an aperture which receives a fastener.

Referring now to FIG. 20, this figure illustrates a side, isometric view of plaster plate 40 which has a wall 45B with an aperture 2104 which receives a locking fastener 2000. The locking fastener 2000 may comprise a machine screw. However, other fasteners are possible and are included within the scope of this disclosure. The locking fastener 2000 is used to "lock" the plaster plate 40 against a surface of the hanger bar assembly 20.

The wall 45B of the plaster plate 40 may have a rectangular aperture 2004 which receives a spring clip 2002. The spring clip 2002A may be a separate structure relative to the wall 45B. The spring clip 2002A may be coupled to the wall 45B with tabs 2006*a*, 2006*b*.

Figure 21:
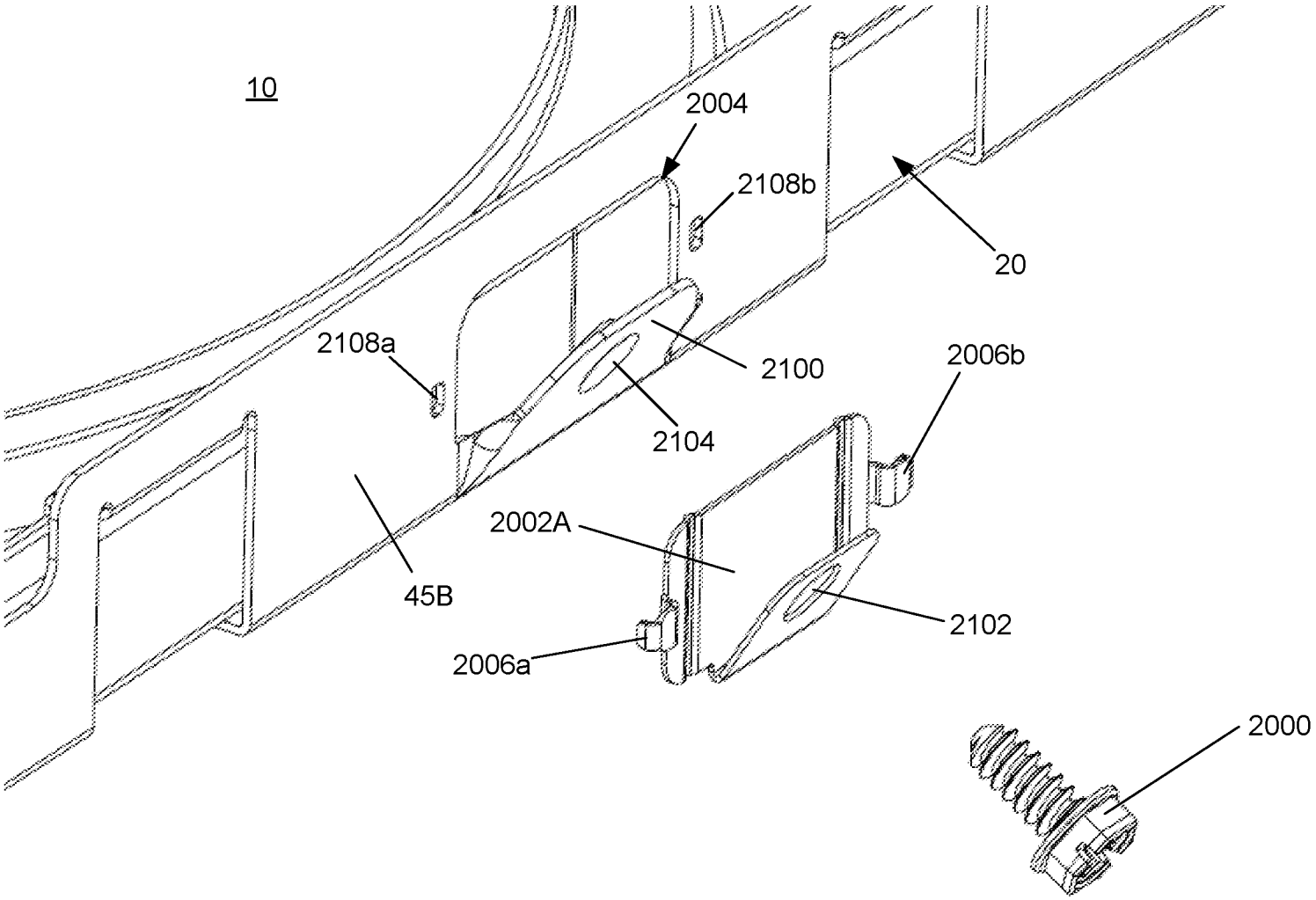
FIG. 21 illustrates a side, isometric view of plaster plate in which the spring clip and locking fastener are presented separate from the wall.

Referring now to FIG. 21, this figure illustrates a side, isometric view of plaster plate 40 in which the spring clip 2002A and locking fastener 2000 are presented separate from the wall 45B. Further details of how the spring clip 2002A is coupled to the wall 45B are shown in this figure. Particularly, apertures 2108*a*, 2108*b* that are positioned in the wall 45B are now visible. These apertures 2108*a*, 2108*b* are designed to receive the tabs 2006*a*, 2006*b* of the spring clip 2002. According to another exemplary embodiment, the wall 45B may Apertures 2108 and tabs 2006

The wall 45B further comprises a wall sub-section 2100 that is formed from the wall 45B. To form this wall sub-section 2100, it could be bent or stamped from the wall 45B. This wall-subsection 2100 also has an aperture 2104 designed to line up with the aperture 2102 of the spring clip 2002A. The aperture 2104 of the wall sub-section 2100 and the aperture 2102 of the spring clip 2002A are designed to receive and engage with the locking fastener 2000.

The spring clip 2002A may compensate for any clearances before hanger bar assemblies 20 are put into a "locked" condition with the locking fastener 2000. The number and sizes of clearances between parts within the system before the locking fastener 2000 is tightened may depend on positions of the bars 20, and clearances between bars 20 and the plaster frame 40, and particularly depending on the tolerances of the enveloping sections 1002 of the wall 45B illustrated in FIG. 10 and described above.

Figure 22:
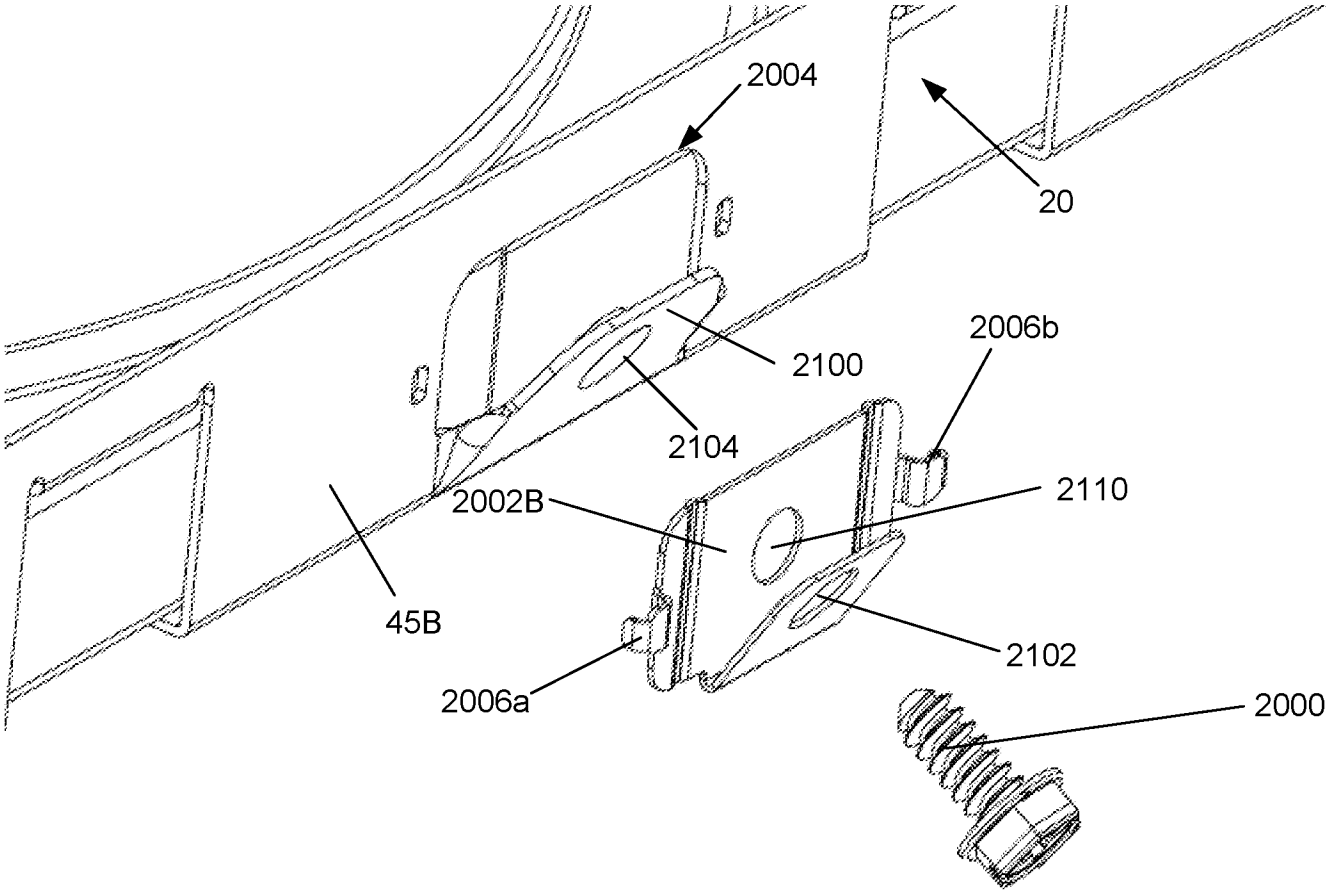
FIG. 22 illustrates a side, isometric view of plaster plate in which the spring clip and locking fastener are presented separate from the wall similar to FIG. 21.

Referring now to FIG. 22, this figure illustrates a side, isometric view of plaster plate 40 in which the spring clip 2002B and locking fastener 2000 are presented separate from the wall 45B similar to FIG. 21. FIG. 21 and FIG. 22 are very similar, therefore, only the differences between these two figures will be describe below. Particularly, in this FIG. 22, the spring clip 2002B has an additional aperture 2110 compared to its other aperture 2102. This additional aperture 2110, like the other aperture 2102, also receives the fastener 2000. This additional aperture 2110 allows the fastener 2000 to penetrate through spring clip 2002B such that it may contact a surface of the hanger bar assembly 20 directly.

Figure 23:
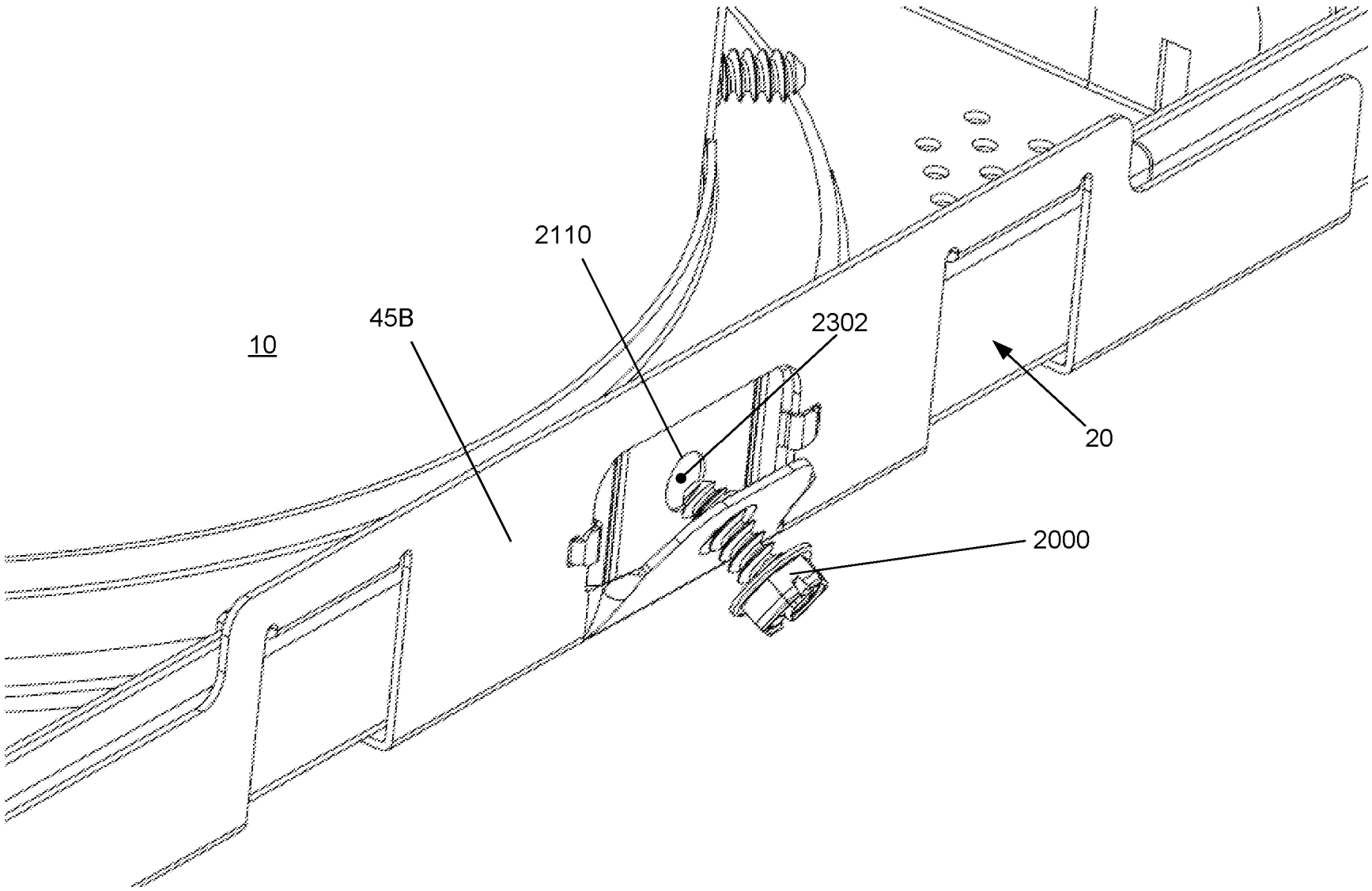
FIG. 23 illustrates the exemplary embodiment of the locking fastener of FIG. 22 but in an assembled state.

Referring now to FIG. 23, this figure illustrates the exemplary embodiment of the locking fastener 2000 of FIG. 22 but in an assembled state. The additional aperture 2110, as explained above, allows the locking fastener 2000 to pass through the spring clip 2002B such that the fastener 2000 may directly contact a surface of the hanger bar assembly 20 at a contact point 2302. In this way, the fastener 2000 may couple the wall 45B of the plaster plate 40 more securely and directly to the hanger bar assembly 20.

Figure 24:
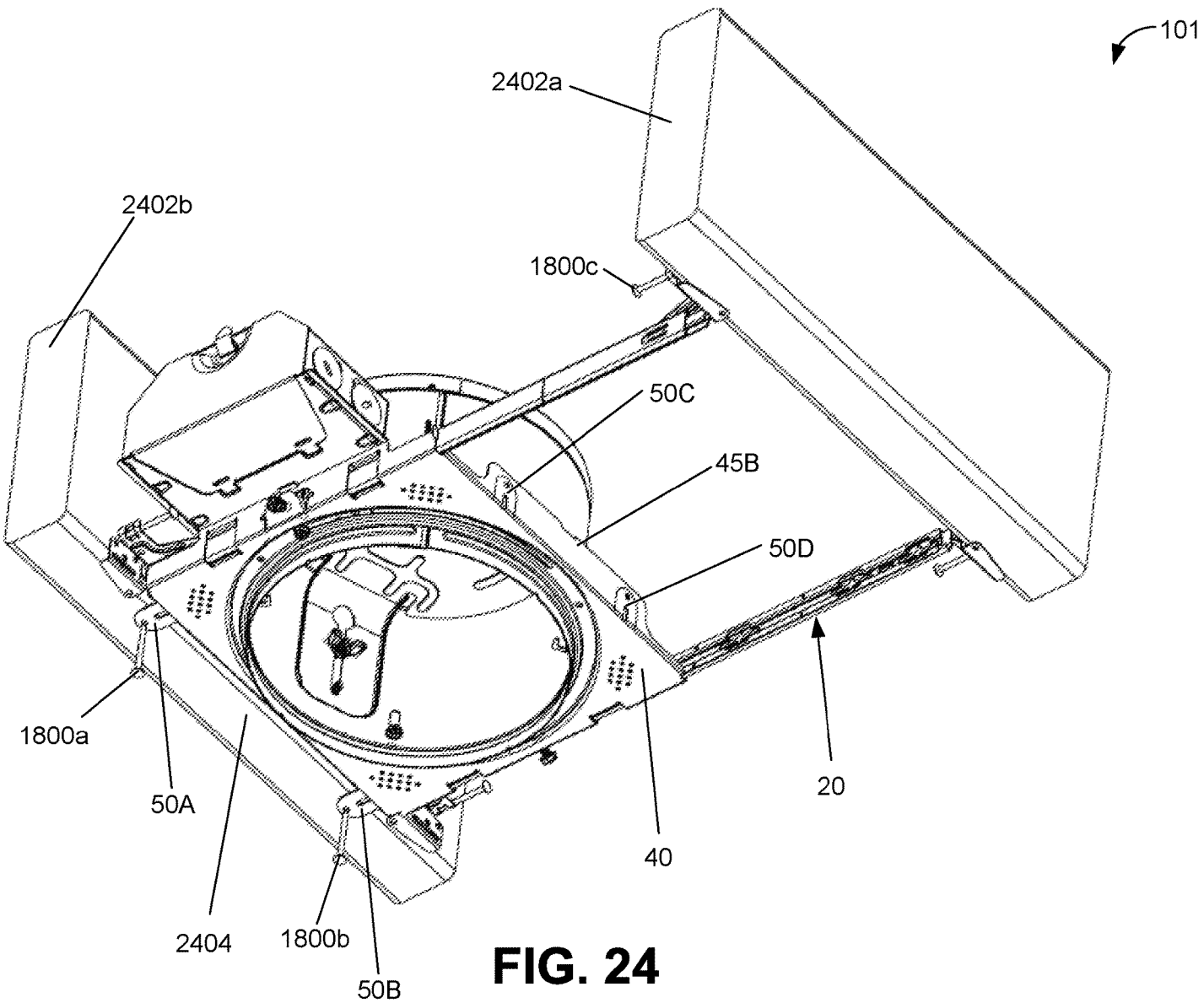
FIG. 24 illustrates a bottom, isometric view of the system where one side of the system has the hanger bar assemblies in a completely contracted state, while on the opposite side, the hanger bar assemblies are in an extended state.

Referring now to FIG. 24, this figure illustrates a bottom, isometric view of the system 101 where one side of the system 101 has the hanger bar assemblies 20 in a completely contracted state, while on the opposite side, the hanger bar assemblies 20 are in an extended state. According to this exemplary embodiment of the system 101, the system 101 is fastened/coupled to a first ceiling beam 2402*b* with mounting tabs 50A, 50B. Mounting tabs 50A, 50B were bent away/downward from a wall 45B (not visible) of the plaster plate 40 so that the tabs 50A, 50B can contact a side 2404 of the ceiling beam 2402*b* that faces downward relative to a ceiling. Each tab 50A, 50B may receive a respective fastener 1800*a*, 1800*b*. These fasteners 1800 may comprise nails, however, other fasteners 1800 are possible and are within the scope of this disclosure.

Meanwhile, the other side of the system 101 may have the hanger bar assemblies 20 in an extended state so that fasteners 1800, like fastener 1800*c* may be couple an end of a hanger bar assembly 20 to the second beam 2402*a*. The mounting tabs 50C, 50D on this side of the system 101 may remain in a position that is flush/within the wall 45B of the plaster plate 40.

Figure 25:
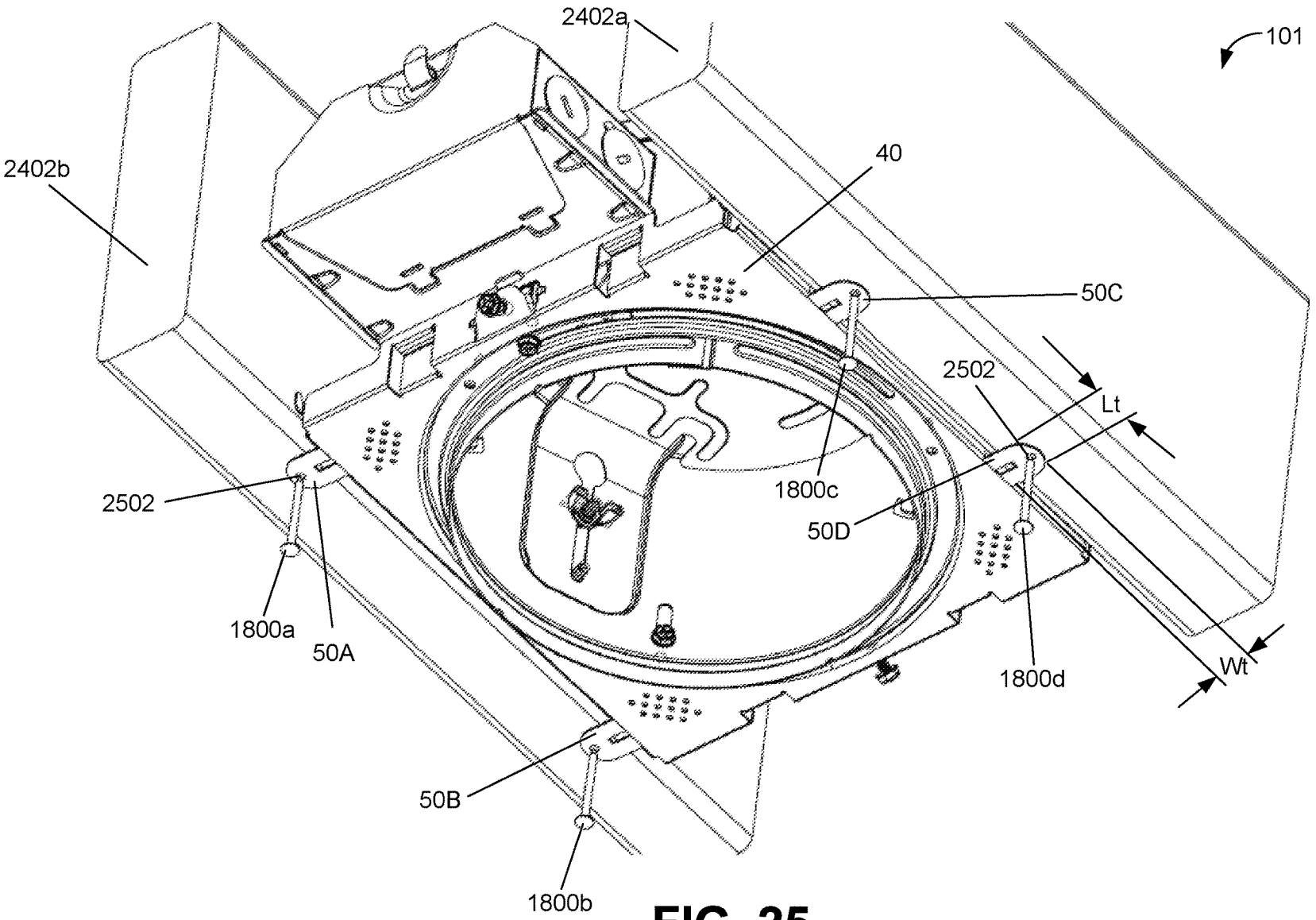
FIG. 25 illustrates a bottom, isometric view of the system where both sides of the system have the hanger bar assemblies removed so that both sets of mounting tabs that extend from walls of the plaster plate may be used for mounting the system to two beams.

Referring now to FIG. 25, this figure illustrates a bottom, isometric view of the system 101 where both sides of the system 101 have the hanger bar assemblies 20 removed so that both sets of mounting tabs 50A, 50B, 50C, 50D that extend from walls 45 of the plaster plate 40 may be used for mounting the system to two beams 2402. FIG. 25 is very similar to FIG. 24, therefore, only the differences between these two figures will be described. According to this exemplary embodiment, all four mounting tabs 50 are bent down from their respective walls 45 of the plaster plate 40. In this way, four fasteners 1800*a-d* may penetrate the apertures 2502 of each respective mounting tab 50.

Each mounting tab 50 may have a length dimension Lt and a width dimension Wt. The length dimension Lt may comprise between about 0.25 and about 1.0 inch while the width dimension may comprise between about 0.5 and about 1.5 inches. Each aperture 2502 may comprise a round shape, but other geometries, such as, but not limited to square, rectangular, etc. are possible and within the scope of this disclosure. For circular apertures 2502, the diameter may comprise between about 0.10 and about 0.20 of an inch. However, other dimensions are possible and are within the scope of this disclosure as understood by one of ordinary skill in the art.

Figure 26:
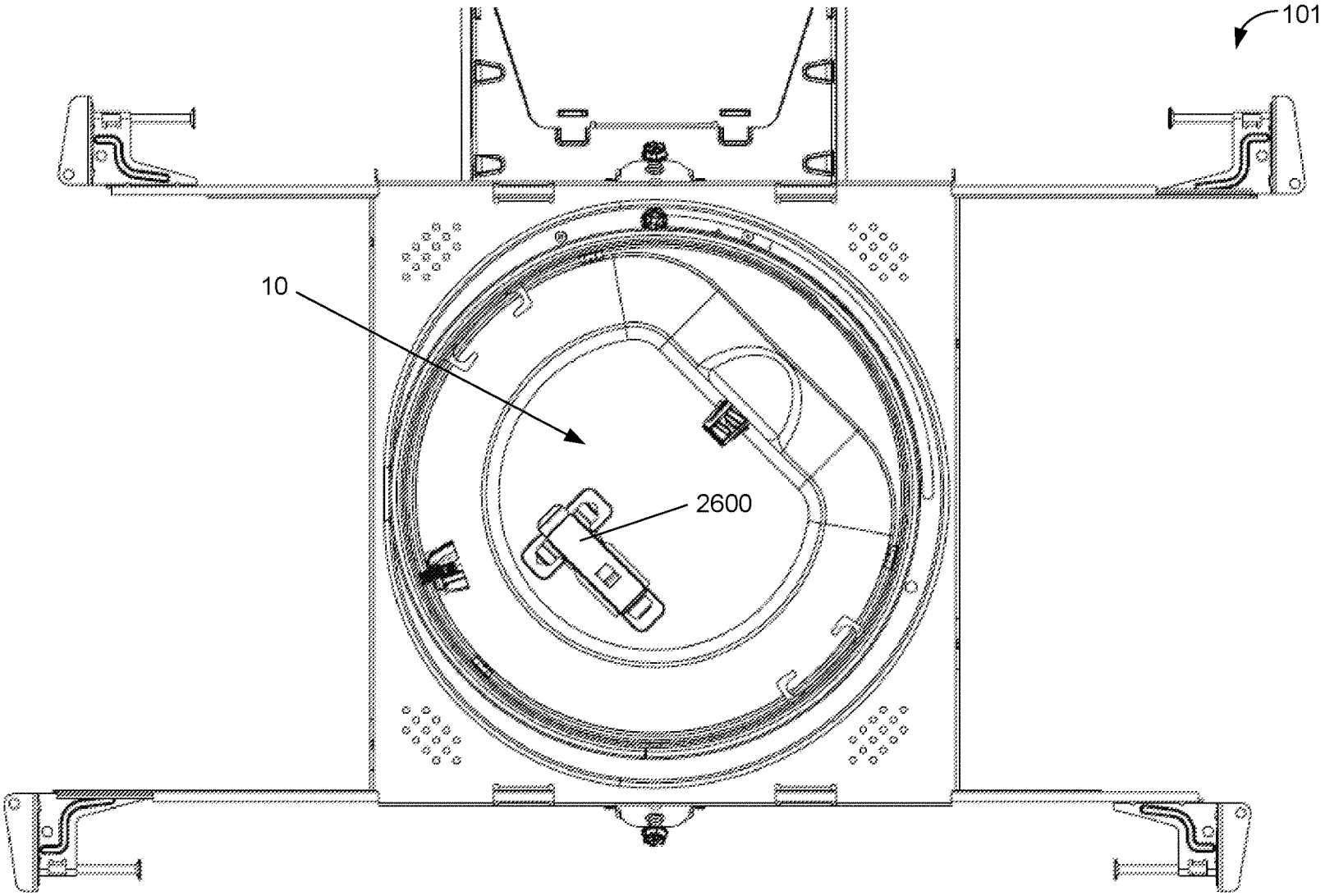
FIG. 26 illustrates a bottom view of the system and particularly, a thermal protector case mounted on the inside of can/housing.

Referring now to FIG. 26, this figure illustrates a bottom view of the system 101 and particularly, a thermal protector case 2600 mounted on the inside of can/housing 10. A thermal protector case 2600 is a housing for thermal sensing electronics/circuits/sensors (hereafter, "thermal sensor") as understood by one of ordinary skill in the art. Thermal sensors prevent the overheating of the can/housing when a lighting device is installed within the system 101. When a thermal sensor detects a predetermined temperature, it may deactivate power to the lighting device within the can/housing 10 until the predetermined temperature is no longer detected by the sensor.

Figure 27:
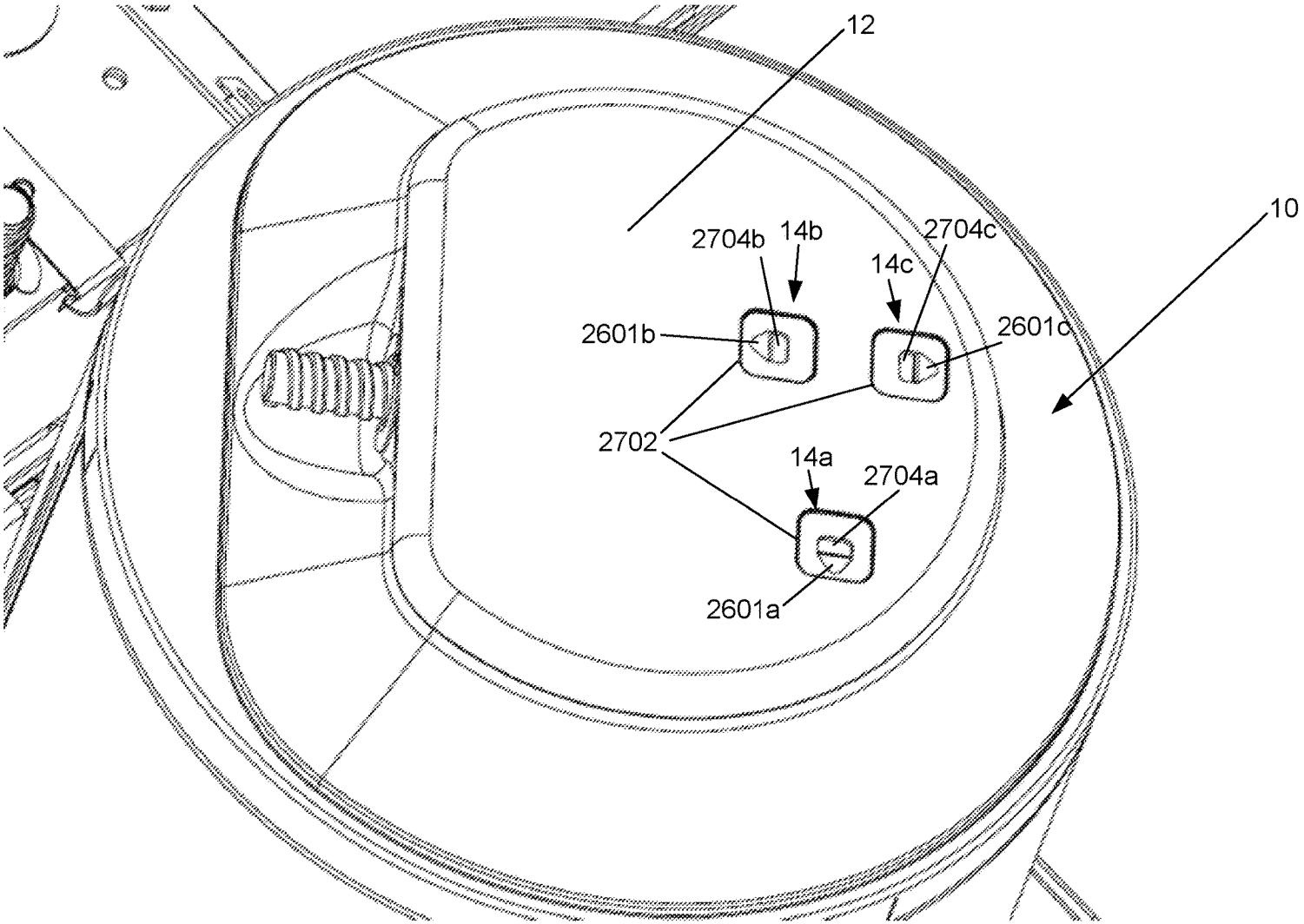
FIG. 27 illustrates a top, isometric view of can/housing and some details of the coupling mechanisms of the thermal protector case.

Referring now to FIG. 27, this figure illustrates a top, isometric view of can/housing 10 and some details of the coupling mechanisms 14 for the thermal protector case 2600. The coupling mechanisms 14 may comprise apertures 2704 and tabs 2601. Specifically, the thermal protector case 2600 (not visible in FIG. 27, but see FIG. 26) has a set of three tabs 2601*a-c* which penetrate apertures 2704*a*, 2704*b*, 2704*c* of the top section 12 of the can 10. The tabs 260 may each comprise a triangular shape. However, other shapes are possible and are included within the scope of this disclosure.

The tabs 2601*a*, 2601*b*, 2601*c* and apertures 2704 are positioned within indentations/recessed regions 2702 of the top section 12 of the can 10. The indentations/recessed regions 2702 may comprise a square-like shape with rounded corners. However, other shapes for indentations/recessed regions 2702 are possible and are included within the scope of the invention. Further, the recessed regions 2702 are optional as understood by one of ordinary skill in the art. They are designed to protect the tabs 2601*a-c* from unintentional detachment.

Figure 28:
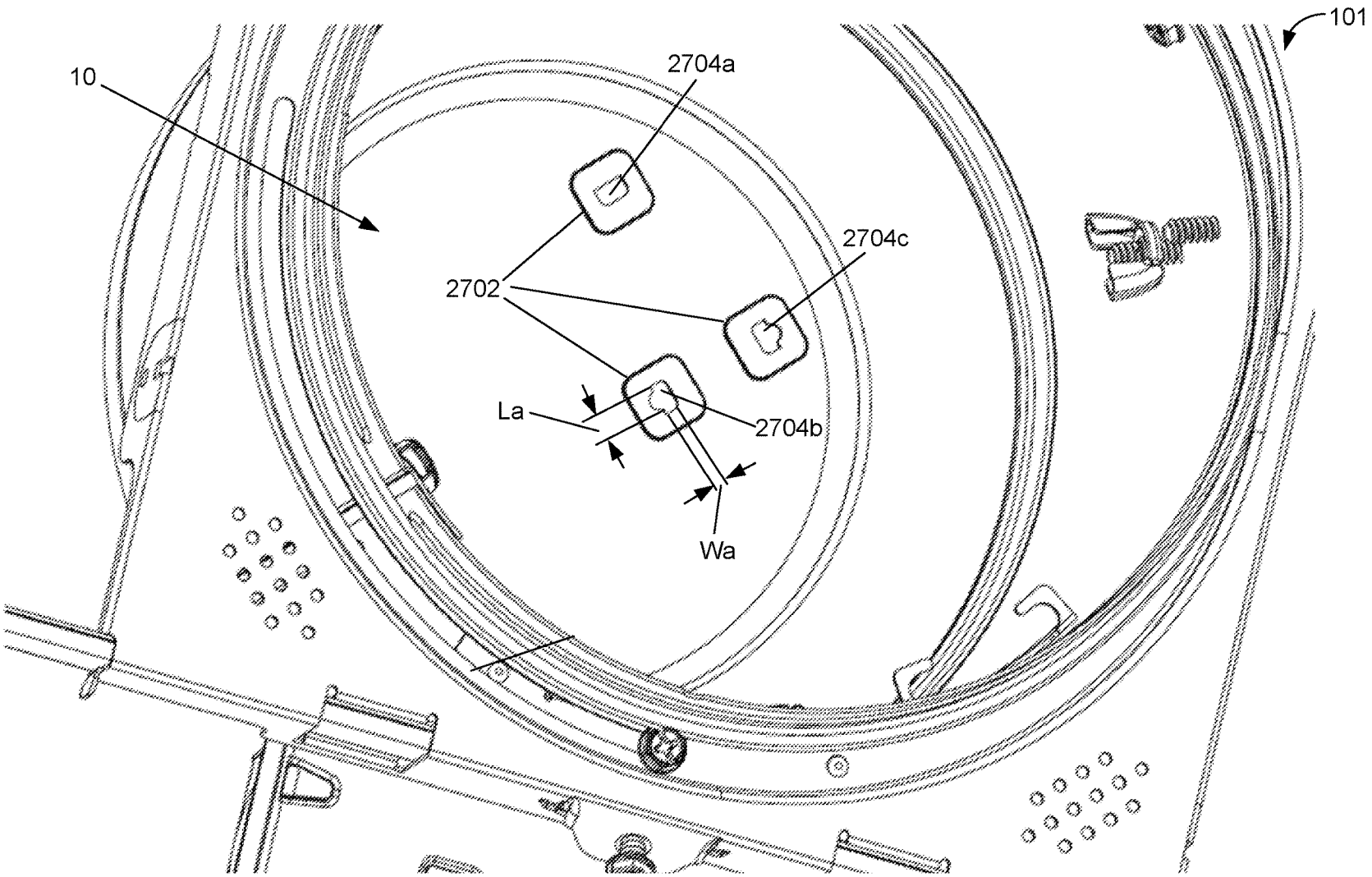
FIG. 28 illustrates another isometric, bottom view of the can/housing similar to FIG. 26 but with the thermal protector case removed.

Referring now to FIG. 28, this figure illustrates another isometric, bottom view of the can/housing 10 similar to FIG. 26 but with the thermal protector case 2600 removed (not visible). In this exemplary embodiment, the shapes of the apertures 2704 are more discernible. Two of the apertures 2704*b*, 2704*c* may have polygonal shape in which a portion of each aperture 2704*b*, 2704*c* has a rectangular section and a portion of each aperture 2704*b*, 2704*c* has a semi-circular section. Meanwhile, one aperture 2704*a* of the three apertures 2704 has a slightly different shape relative to the other two: the single aperture 2704*a* has a generally rectangular shape but with rounded corners. The rounded corners and semi-circular sections described above are optional and can be changed as desired as understood by one of ordinary skill in the art.

The apertures 2704 may have a length dimension La and width dimension Wa. The length dimension La may have a magnitude between about 0.10 and about 0.30 of an inch while the width dimension may have a magnitude between about 0.10 and about 0.30 of an inch. However, other magnitudes are possible for these dimensions and they are included within the scope of this disclosure.

Figure 29:
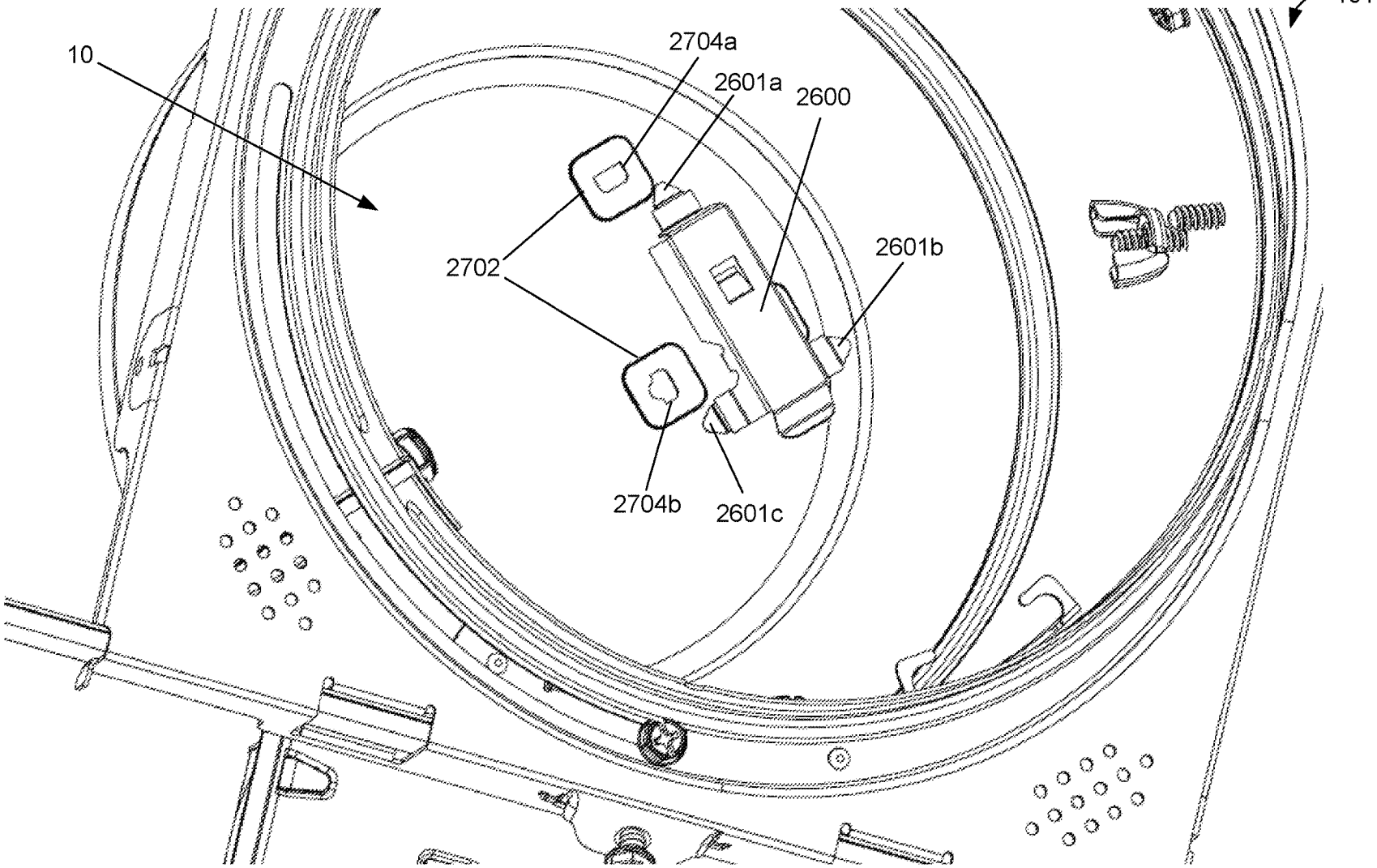
FIG. 29 illustrates another isometric, bottom view of the can/housing similar to FIG. 26 but with the thermal protector case being positioned closer to its final locked position on the housing/can.

Referring now to FIG. 29, this figure illustrates another isometric, bottom view of the can/housing 10 similar to FIG. 26 but with the thermal protector case 2600 being positioned closer to its final locked position on the housing/can 10. The tabs 2601*a*-2601*c* of the thermal protector case 2600 are easily seen in this FIG. 26. These tabs 2601*a*-2601*c* are inserted into the apertures 2704*a-c* [aperture 2704*c* is not visible in FIG. 29, but see FIG. 28].

Figure 30:
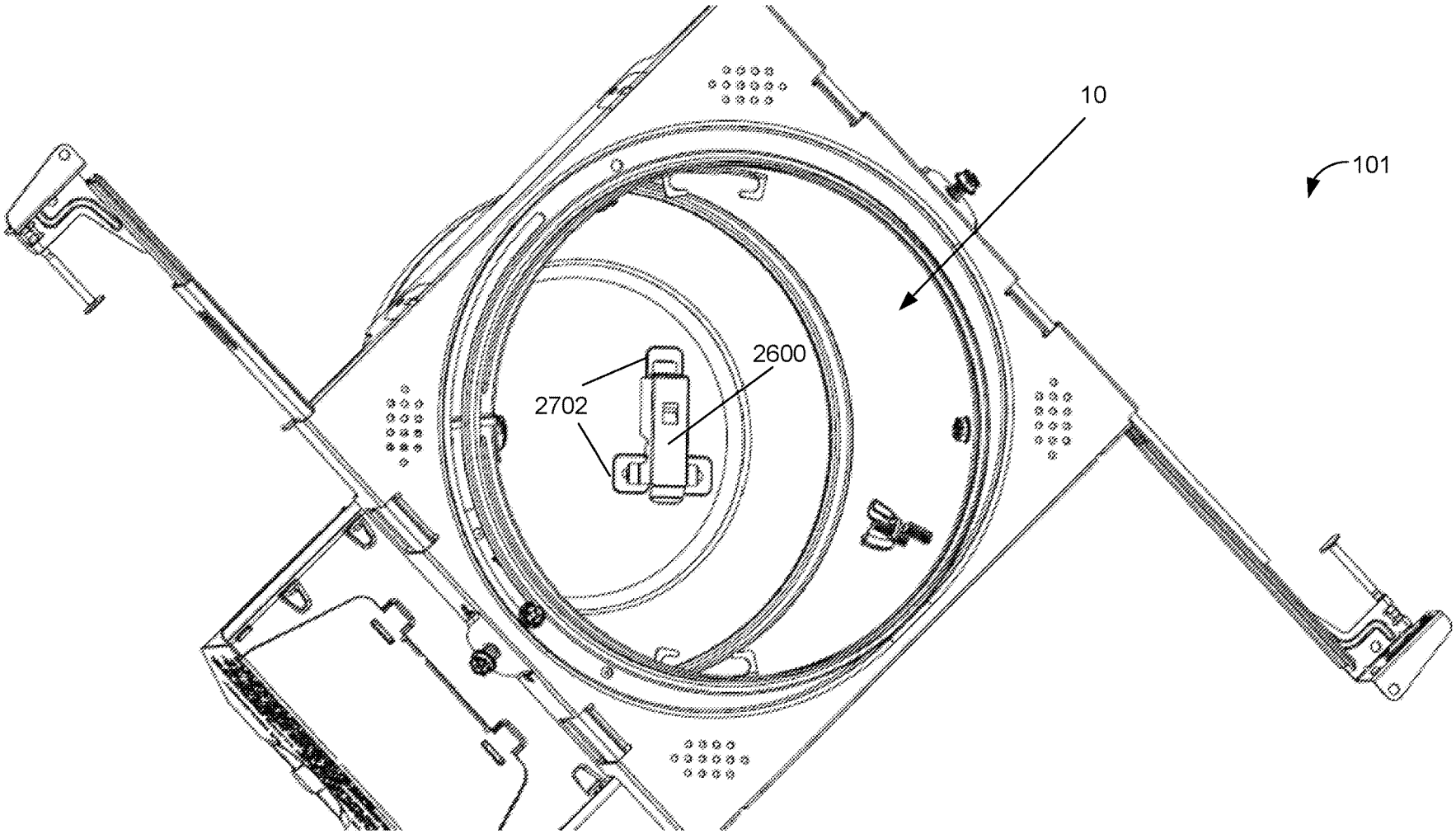
FIG. 30 illustrates another isometric, bottom view of the can/housing 10 similar to FIG. 29 but with the thermal protector case positioned in its final locked position on the housing/can.

Referring now to FIG. 30, this figure illustrates another isometric, bottom view of the can/housing 10 similar to FIG. 29 but with the thermal protector case 2600 positioned in its final locked position on the housing/can 10. Because of the unique apertures 2704 of the housing 10 [not visible in FIG. 30 but see FIG. 28] and unique tabs 2601 provided on the thermal protector case 2600, the thermal protector case 2600 is easier to install on the inside of can/housing 10, while also maintaining a substantially air-tight seal. The arms 2602*a-c* may provide the substantially air-tight seal condition.

Figure 31:
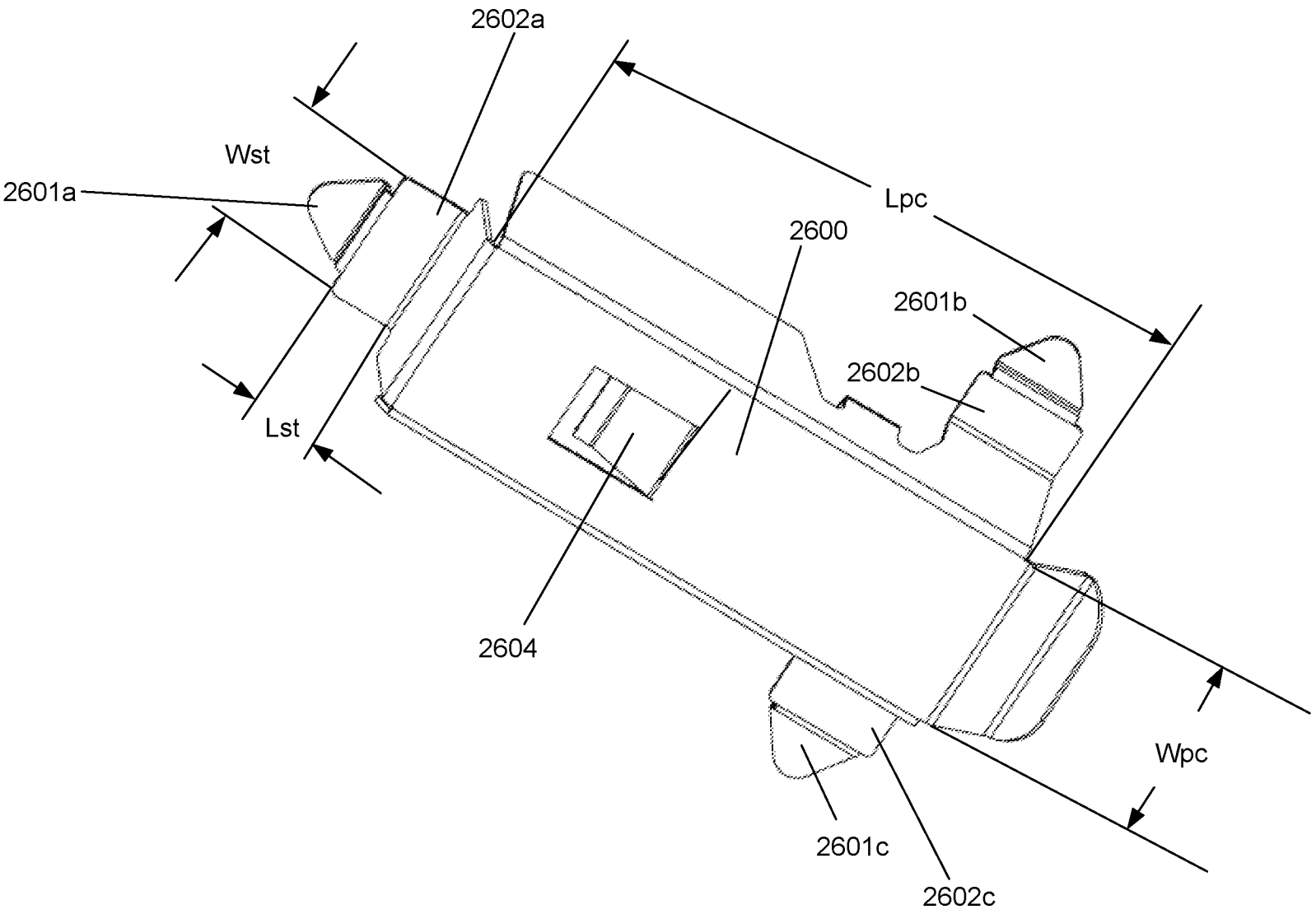
FIG. 31 illustrates a bottom, outside isometric view of the thermal protector case.

Arms 2602*a-c* may block/cover openings 2704*a-c* shown on FIGS. 29 and 31. As understood by one of ordinary skill in the art, the substantially air-tight seal condition for recessed luminaires is defined by the standard ASTM E283—Standard Test Method for Determining Rate of Air Leakage Through Exterior Windows, Curtain Walls, and Doors Under Specified Pressure Differences Across the Specimen—adapted by UL for Air Leakage Testing for Recessed Lighting Products, as understood by one of ordinary skill in the art.

Referring now to FIG. 31, this figure illustrates a bottom, isometric view of the thermal protector case 2600 which shows the side of the case 2600 when it is connected to the housing 10. In this figure, arms 2602 which support tabs 2601 are more clearly seen. The arms 2602*a-c* usually need to be same size or slightly larger then openings 2704*a-c* These arms 2602 may have a length dimension Lst and a width dimension Wst. Both the length dimension Lst and the width dimension Wst need to be larger than the dimensions Wa and La for the apertures 2704, as understood by one of ordinary skill in the art. However, other exemplary magnitudes are possible and are included within the scope of this disclosure.

A main section of the thermal protector case 2600 may also have a length dimension Lpc and a width dimension Wpc. The length dimension Lpc may have a magnitude between about 1.0 and about 1.5 inches and the width dimension Wpc may have a magnitude between about 0.30 and about 0.50 of an inch. However, other exemplary magnitudes are possible and are included within the scope of this disclosure.

The thermal protector case 2600 further comprises a central tab 2604. Central tab 2604 is designed to push and apply pressor to the sensor (not shown) such that the sensor comes in direct contact with a surface of the housing 10 so that temperature of the surface of the housing 10 is accurately measured by the sensor.

Figure 32:
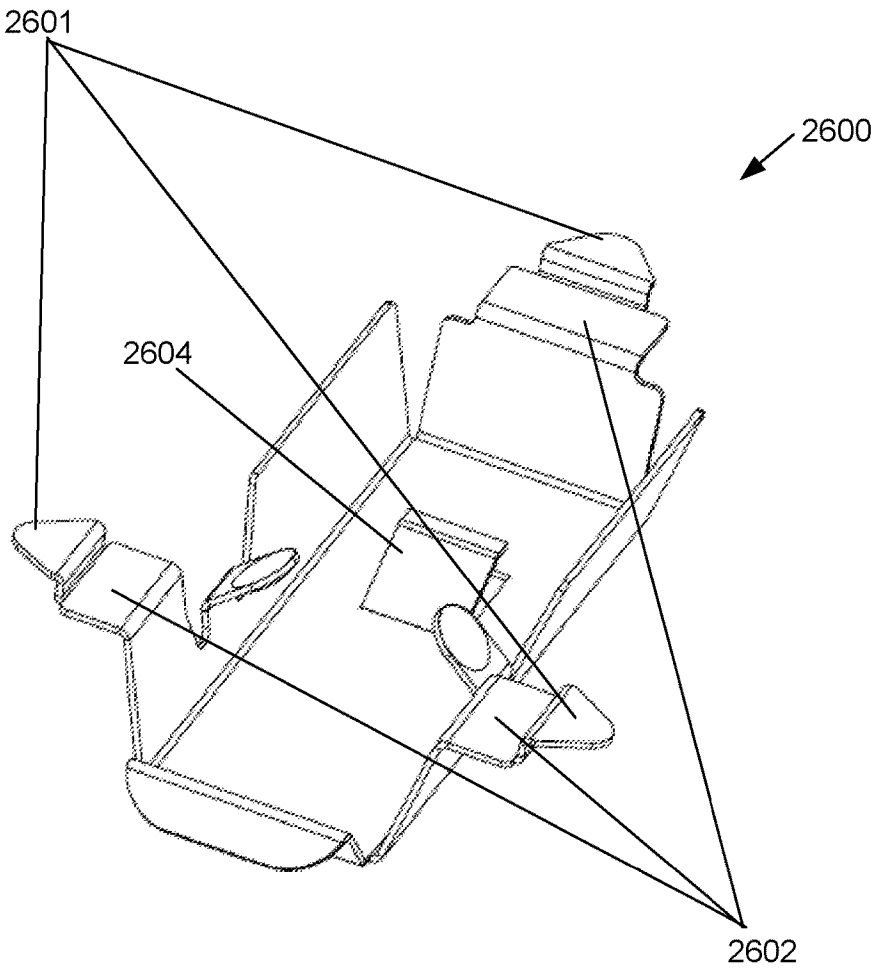
FIG. 32 illustrates a top, internal/inside, isometric view of the thermal protector case.

Referring now to FIG. 32, this figure illustrates a top, isometric view of the thermal protector case 2600 which shows the side of the case 2600 that faces housing 10 and is usually not visible when the case 2600 is connected to the housing 10. In this FIG. 32, it is apparent that arms 2602 that support tabs 2601 contact the inside of the housing 10 when the protector case 2600 is coupled to the housing 10. Similarly, it is apparent that the tabs 2601 penetrate through the apertures 2704 [not visible in FIG. 31, but see FIG. 30] when the protector case 2600 is coupled to the top/roof of housing 10.

Figure 33:
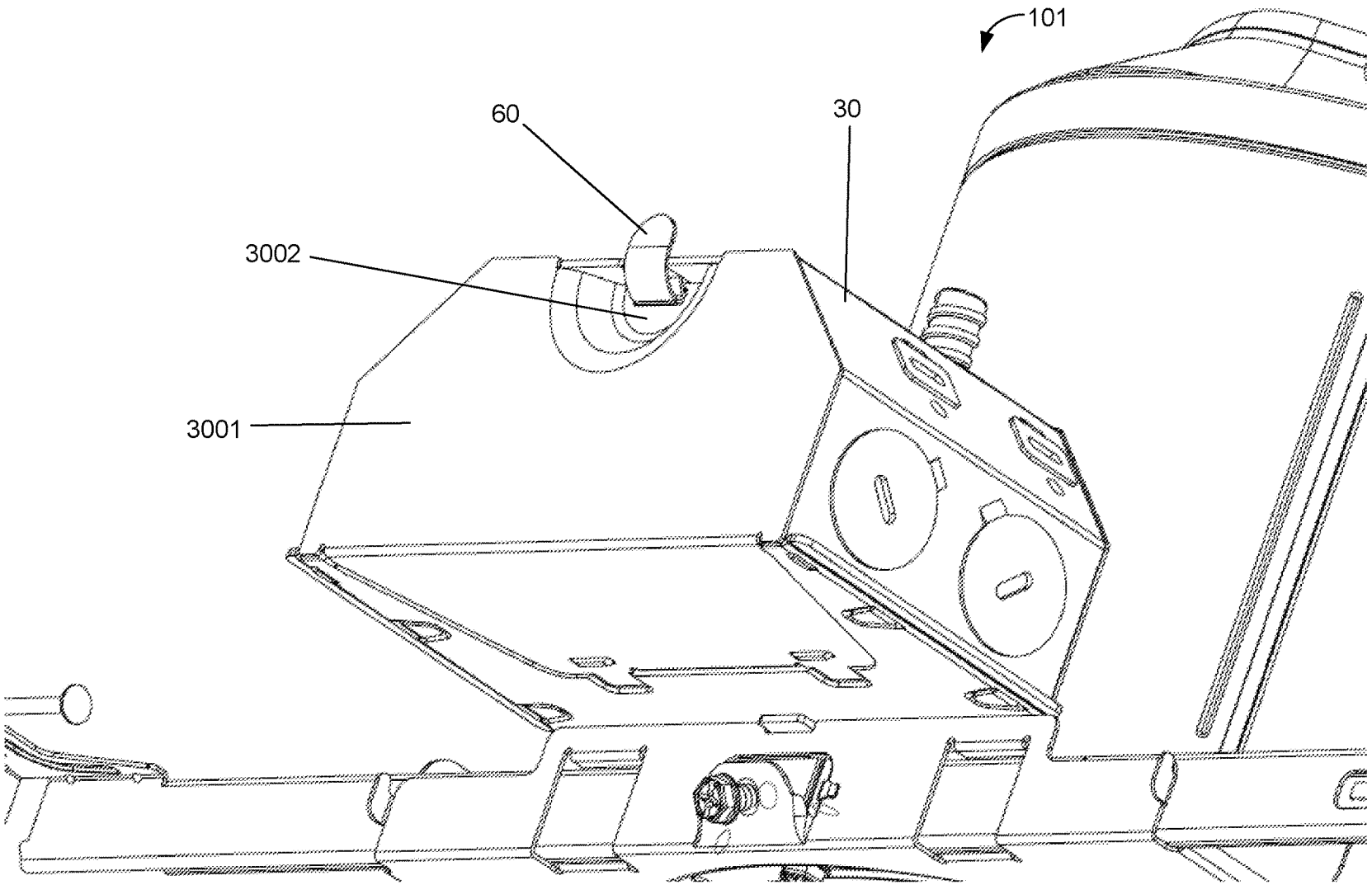
FIG. 33 illustrates a side, isometric view of the junction box and further details of a spring used to keep a door of the junction box closed.

Referring now to FIG. 33, this figure illustrates a side, isometric view of the junction box 30 and further details of a spring 60 used to keep a door 3001 of the junction box 30 closed. The end of spring 60 does not extend beyond a cavity 3002 of a door 3001. Specifically, the end of the spring 60 is not protruding beyond the door 3001 when the door 3001 is in a vertical position.

Figure 34:
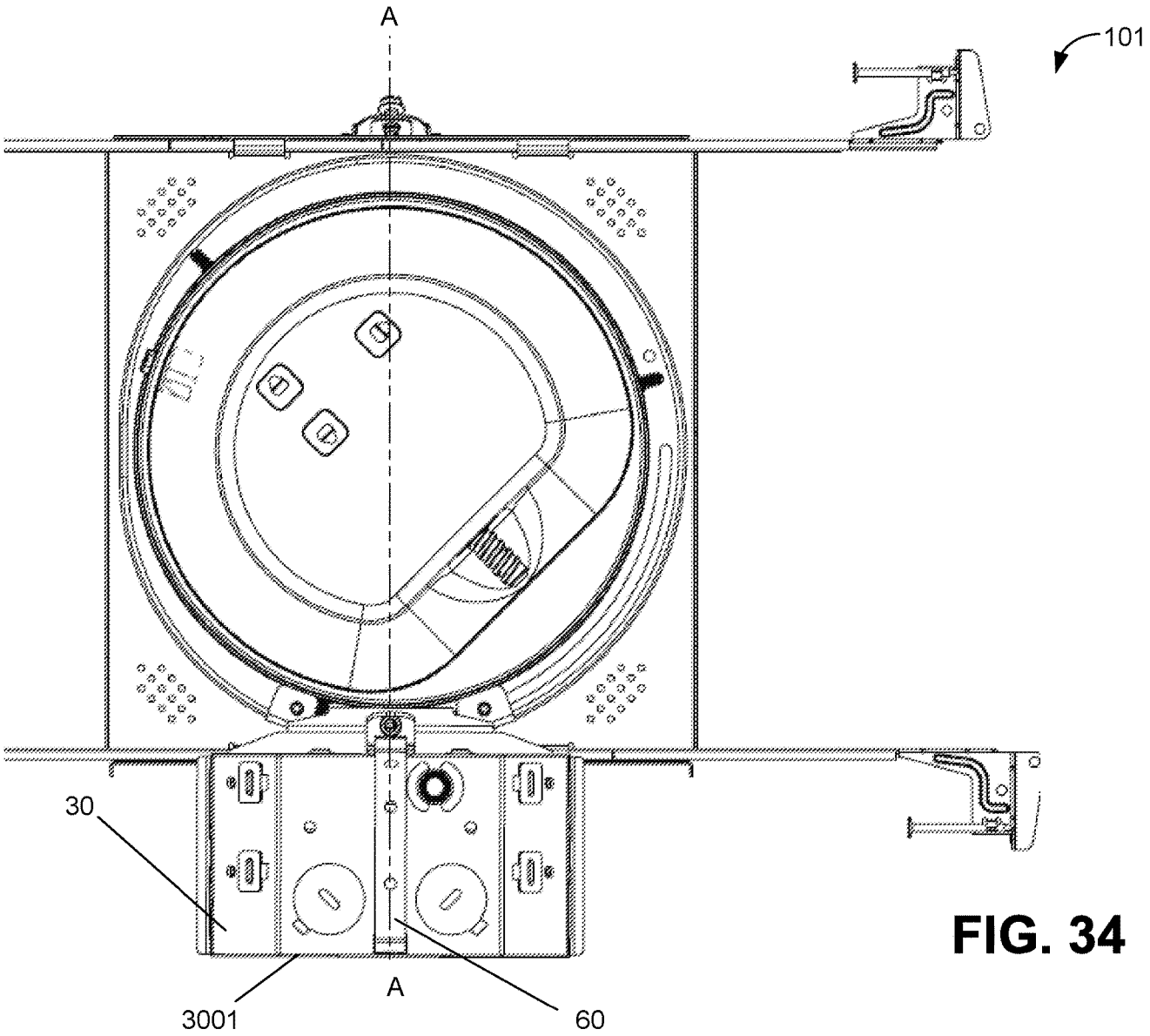
FIG. 34 illustrates a top view of the junction box when the junction box 30 closed.

Referring now to FIG. 34, this figure illustrates a top view of the junction box 30 when the junction box 30 is closed. As seen in this FIG. 34, an end of the spring 60 does not extend beyond a geometrical plane defined by the door 3001. In FIG. 34, the door 3001 and its respective geometrical plane are illustrated as a line in this top view.

Figure 35:
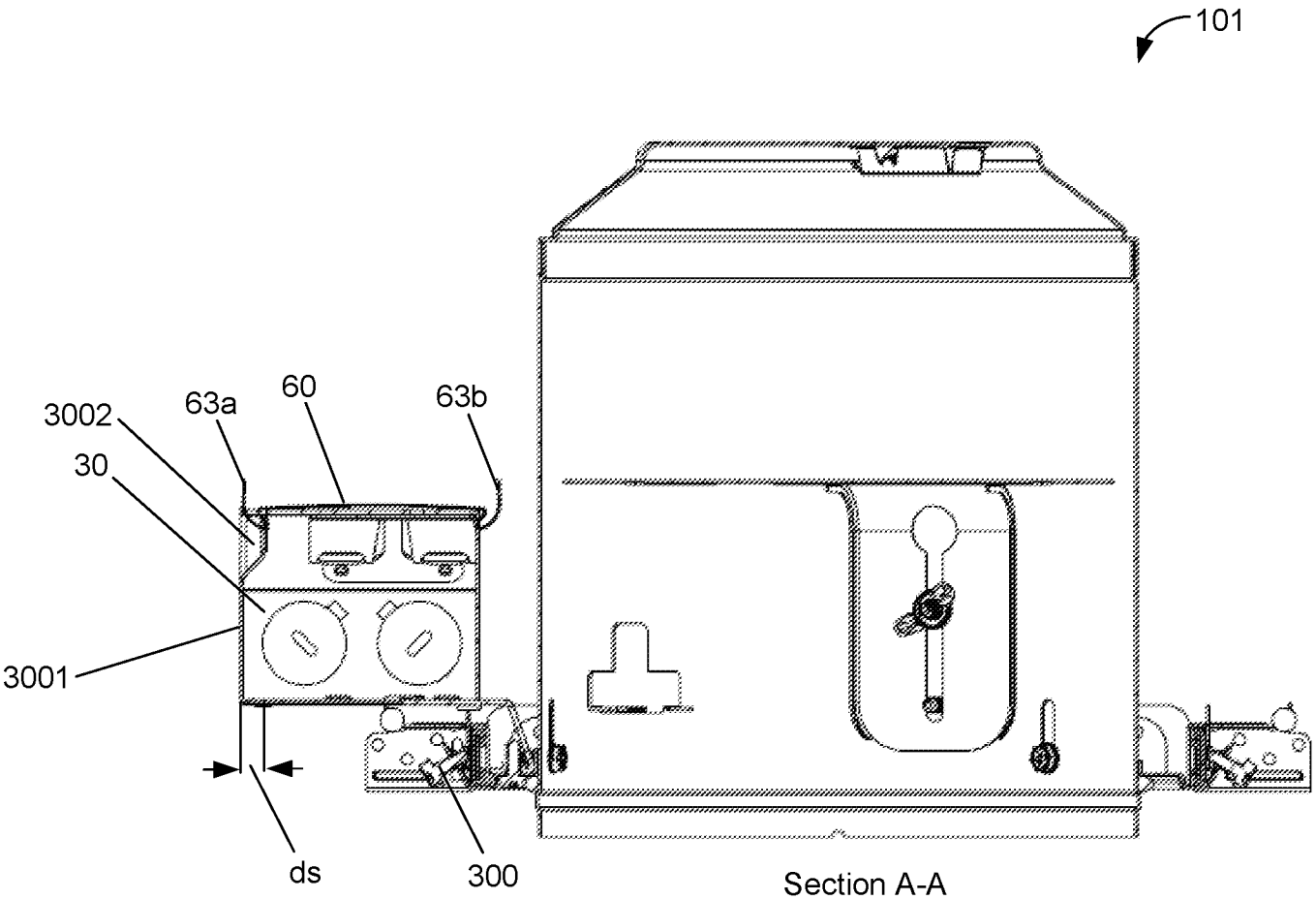
FIG. 35 is a cross-sectional view of FIG. 34 taken along the cut-line A-A of FIG. 34.

Referring now to FIG. 35, this figure is a cross-sectional view of FIG. 34 taken along the cut-line A-A of FIG. 34. The spring 60 may have a first end 63*a* and a second end 63*b*. The first end 63*a* may be positioned with the cavity 3002. The cavity 3002 formed within door 3001 may have a depth dimension ds. The depth dimension ds may comprise a magnitude of between about 0.10 and about 0.30 of an inch. However, other magnitudes are possible and are within the scope of the invention. As illustrated in FIG. 35, the spring 60 improves shipping. An extended spring end beyond a junction box 30 (not illustrated) may cause damage to shipping containers/boxes. The spring 60 helps improve installations of the system 101 in confined/narrow spaces/volumes.

Figure 36:
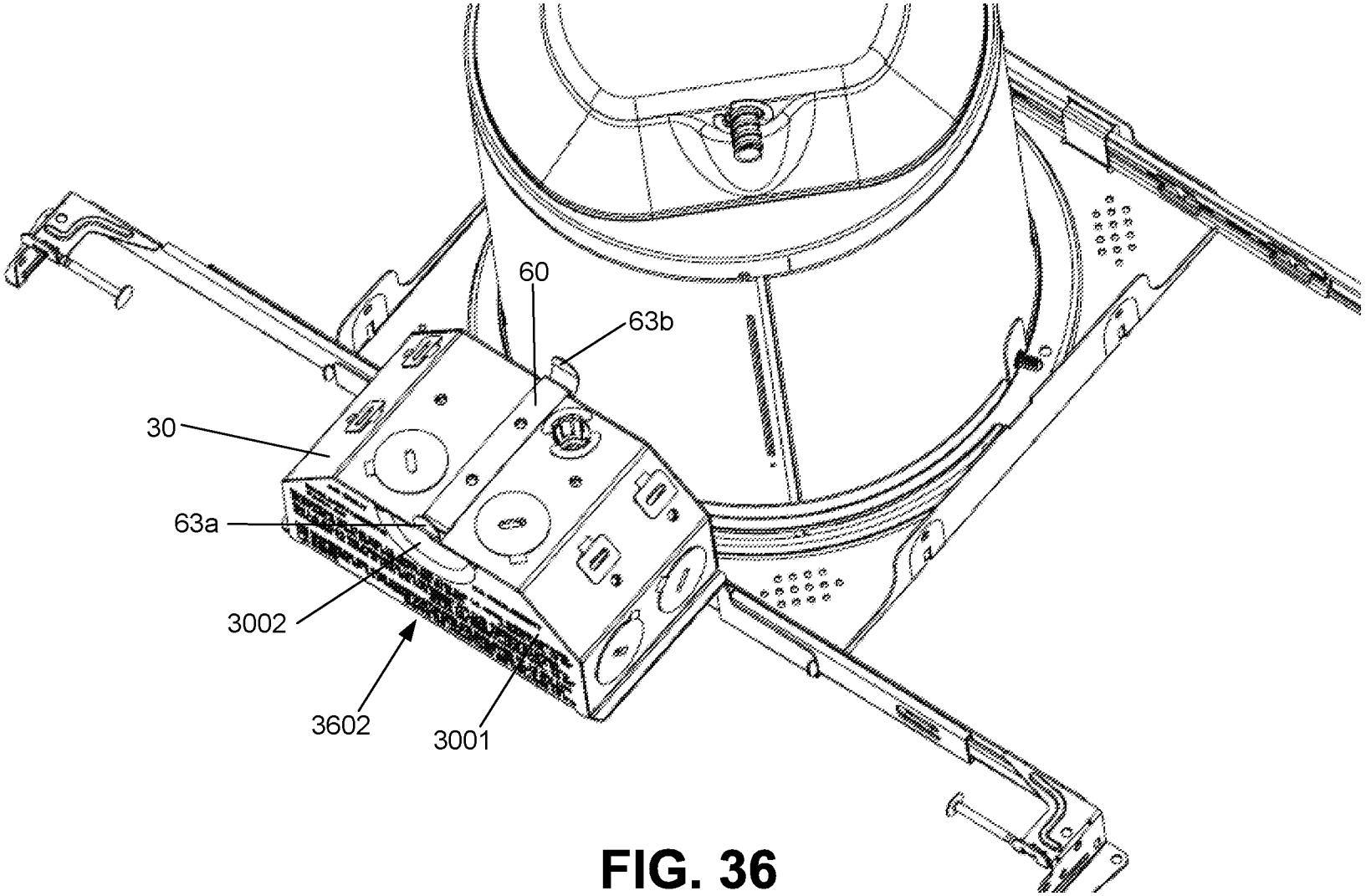
FIG. 36 illustrates a top, isometric view of the system and further details of the junction box according to one exemplary embodiment.

Referring now to FIG. 36, this figure illustrates a top, isometric view of the system 101 and further details of the junction box 30 according to one exemplary embodiment. As shown in this figure, the door 3001 may comprise a writing 3602 which may provide warning messages about the system 101. This writing 3602 may be stamped or applied via sticker. The geometry of the cavity 3002 is also more visible in this view. The cavity 3002 may comprise a semi-circular shape as seen in this figure. However, other geometries are possible and are included within the scope of this disclosure.

To re-capture an overview of the various subsystems for the inventive system, FIGS. 2-8 generally illustrate the ability to rotate or shift the position of the junction box 30 within the system 101. Meanwhile, FIGS. 9A-17, these figures illustrate how hanger bar assemblies 20 may comprise telescoping members where each member may be broken-off/removed from the assembly 20 so that the bars may be shortened depending upon the unique space provided for a mount. See particularly FIGS. 12-13, where subsection 1204*b* is bent and broken off from the entire assembly 20.

FIGS. 18-19B show an improved proposed hanger bar design, where the first segment 1805 of the hanger bar 20 is extended horizontally from the hanger bar end 20, while the second segment 1810 is bent vertically down from the first segment 1805. The fastener or nail 1800 is held by partial loops 1900, and in on exemplary embodiment, by three partial loops 1900. The friction is between the inside loop surface 1900 and the nail outside surface 1800. The friction can be adjusted by changing the loops 1900 width at no cost to the part. The nail 1800 is guided by the partial loops 1900. No additional guides are needed.

FIGS. 20-23 illustrate how a "V"-shape part 2002 acts as a spring to compensate any clearances before bars 20 are in a "locked" condition, where the locked condition is created by the locking screw 2000. One V-shaped spring 2002A may be solid while in another exemplary embodiment, the V-shaped spring 2002B may comprise an aperture or hole for the locking screw 2000. Depending of the positions of the bars 20, clearances between bars 20 and the plaster frame loops are usually not constant. The "V"-shaped spring 2002 may reduce these gaps.

FIGS. 24-25 illustrate further details and functions for the mounting tabs 50 are illustrated. The mounting tabs 50 may bent downward from a wall 45 of the plaster plate 40 when hanger bars 20 are not needed for a particular space/mount. Both sets of hanger bars 20 are removed for the exemplary embodiment illustrated in FIG. 25.

FIGS. 26-32 depict an improved thermal protector case 2600 and improved coupling features/mechanisms 14 on the top 12 of the can/housing 10 are illustrated. Because of the unique tabs/mechanical lips provided with coupling features 14 and tabs 2601 provided on the thermal protector case 2600, the thermal protector case 2600 is easier to install on the inside of can/housing 10, while also maintaining an air-tight seal to comply with an industry standard for luminaires.

Once installed on the top/roof 12 of the housing 10, a first set of thermal protector case tabs 2601 engage the outside surface of the coupling mechanisms 14 and a second set 2602 of thermal protector case tabs 2602 cover the openings 2704. The tabs 2601/2602, coupling mechanisms/features 14, and case 2600 maintain a relatively air-tight seal once installed. These figures illustrate the specific, yet exemplary embodiments of the tabs with their unique angles for facilitating the ease of installation of the case 2600 on the can 10.

And FIGS. 33-36 illustrate an improved spring 60 for the junction box 30. The end of spring 60 is regressed in a cavity 3002 of a door 3001. The end of the spring 60 is not protruding beyond the door 3001 when the door 3001 is in a vertical position. As illustrated in FIG. 35, the spring 60 improves shipping—an extended spring end beyond a junction box 30 (not illustrated) may cause damage to shipping containers/boxes. The spring 60 helps improve installations of they system 101 in confined/narrow spaces/volumes.

FIGS. 1-36 contain sufficient detail to enable one of ordinary skill in the art to make and build the inventive method and system as illustrated. That is, these drawings are self-enabling as understood by one of ordinary skill in the art.

Figure 37:
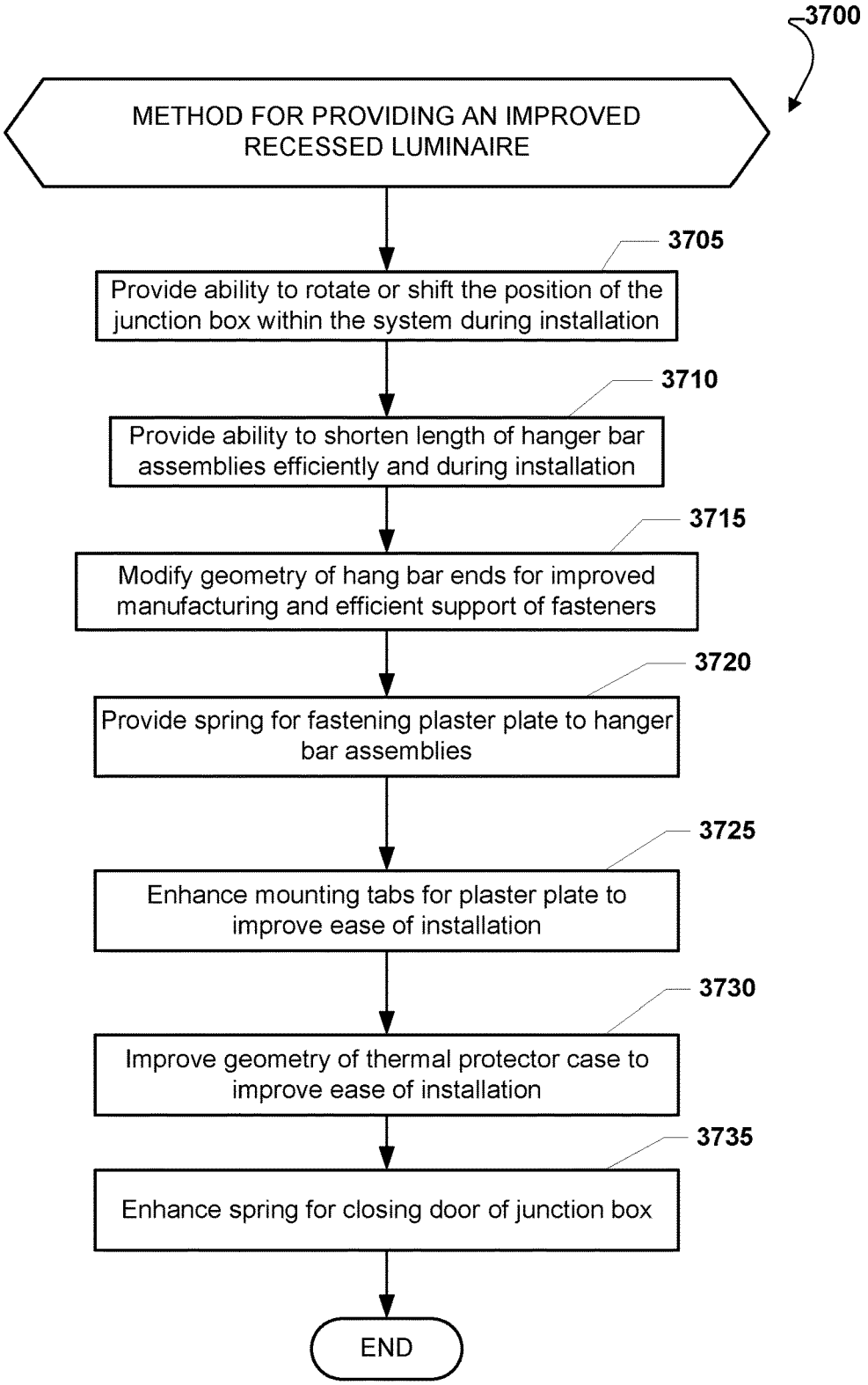
FIG. 37 illustrates a flow chart of a method for providing an improved recessed luminaire according to one exemplary embodiment.

FIG. 37 illustrates a flow chart of a method for providing an improved recessed luminaire according to one exemplary embodiment. In step 3705, which is the first step of method 3700, the system 101 is provided with the ability to rotate or shift the position of the junction box 30 within the system 101. This ability is illustrated in FIGS. 2-8.

Next, in step 3710, the system 101 is provided with the ability to shorten lengths of the hanger bar assemblies in an efficient manner during installation of the luminaire. FIGS. 9A-17 illustrate how hanger bar assemblies 20 may comprise telescoping members where each member may be broken-off/removed from the assembly 20 so that the bars may be shortened depending upon the unique space provided for a mount. See particularly FIGS. 12-13, where subsection 1204*b* is bent and broken off from the entire assembly 20.

Next, in step 3715, a geometry of the end of the hangar bar assemblies is modified to provide a more efficient design that also helps support fasteners. Specifically, FIGS. 18-19B illustrate how a first segment 1805 of the hanger bar 20 is extended horizontally from the hanger bar end 20, while the second segment 1810 is bent vertically down from the first segment 1805. The fastener or nail 1800 is held by partial loops 1900, and in on exemplary embodiment, by three partial loops 1900. The friction is between the inside loop surface 1900 and the nail outside surface 1800. The friction can be adjusted by changing the loops 1900 width at no cost to the part. The nail 1800 is guided by the partial loops 1900. No additional guides are needed.

Subsequently, in step 3720, an enhanced spring 2002 is provided for locking the plaster plate 40 with the hanger bar assemblies 20. Specifically, FIGS. 20-23 illustrate a "V"-shape part 2002 acts as a spring to compensate any clearances before bars 20 are in a "locked" condition, where the locked condition is created by the locking screw 2000. One V-shaped spring 2002A may be solid while in another exemplary embodiment, the V-shaped spring 2002B may comprise an aperture or hole for the locking screw 2000. Depending of the positions of the bars 20, clearances between bars 20 and the plaster frame loops are usually not constant. The "V"-shaped spring 2002 may reduce these gaps.

Next, in step 3725, enhanced mounting tabs 50 for the plaster plate 40 may be provided. Specifically, FIGS. 24-25 illustrate details and functions for improved mounting tabs 50. The mounting tabs 50 may bent downward from a wall 45 of the plaster plate 40 when hanger bars 20 are not needed for a particular space/mount. Both sets of hanger bars 20 are removed for the exemplary embodiment illustrated in FIG. 25.

In step 3730, an improved thermal protector case 2600 which can be easily installed within a can 10 is provided. Specifically, FIGS. 26-32 show an improved thermal protector case 2600 and improved coupling features/mechanisms 14 on the top 12 of the can/housing 10 are illustrated. Because of the unique tabs/mechanical lips provided with coupling features 14 and tabs 2601 provided on the thermal protector case 2600, the thermal protector case 2600 is easier to install on the inside of can/housing 10, while also maintaining an air-tight seal to comply with an industry standard for luminaires.

Once installed on the top/roof 12 of the housing 10, a first set of thermal protector case tabs 2601 engage the outside surface of the coupling mechanisms 14 and a second set 2602 of thermal protector case tabs 2602 cover the openings 2704. The tabs 2601/2602, coupling mechanisms/features 14, and case 2600 maintain a relatively air-tight seal once installed. These figures illustrate the specific, yet exemplary embodiments of the tabs with their unique angles for facilitating the ease of installation of the case 2600 on the can 10.

Subsequently, in step 3735, an improved spring 60 for closing a door 3001 of the junction box may be provided. FIGS. 33-36 depict an improved spring 60 for the junction box 30. The end of spring 60 is regressed in a cavity 3002 of a door 3001. The end of the spring 60 is not protruding beyond the door 3001 when the door 3001 is in a vertical position. As illustrated in FIG. 35, the spring 60 improves shipping—an extended spring end beyond a junction box 30 (not illustrated) may cause damage to shipping containers/ boxes. The spring 60 helps improve installations of the system 101 in confined/narrow spaces/volumes. After step 3735, the process/method 3700 may then end.

It is noted that while method 3700 illustrates several inventive elements/steps that form system 101, only one element of system 101/or one step of method 3700 is needed to practice the invention. That is, the invention is operable with all, several, or only one of the steps/elements present as understood by one of ordinary skill in the art.

Certain steps in the processes or process flows enabled by the mechanical drawings in this specification and the appendix naturally precede others for the invention to function as described. However, the invention is not limited to the order of the steps described if such order or sequence does not alter the functionality of the invention. That is, it is recognized that some steps may performed before, after, or parallel (substantially simultaneously with) other steps without departing from the scope and spirit of the invention. In some instances, certain steps may be omitted or not performed without departing from the invention.

The materials for the parts illustrated in the several figures, such as the can 10 and junction box 30 may be made of metal, such as aluminum or steel. Other metals may be employed without departing from the scope of this disclosure. Other metals include, but are not limited to, bronze, copper, tin, lead, and alloys/combinations thereof. Further, other materials besides metals are also possible and are included within the scope of this disclosure. Other materials besides metals include, but are not limited to, polymers (i.e. plastics), ceramics, composite materials, and any combination thereof.

Although a few embodiments have been described in detail above, those skilled in the art will readily appreciate that many modifications are possible in the embodiments without materially departing from this disclosure. Accordingly, such modifications are intended to be included within the scope of this disclosure as defined in the following claims.

For example, while several telescoping sections are illustrated for the hanger bar assemblies 20, it is possible that the functions/movement of these elements could be replaced/substituted by additional and/or fewer structures. Further, mechanical equivalents of any of the illustrated structures could be substituted for many of the structures illustrated in the several views as understood by one of ordinary skill in the art. Such substitutions of mechanical equivalent structures are included within the scope of this disclosure.

Similarly, in the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, sixth paragraph for any limitations of any of the claims herein, except for those in which the claim expressly uses the words 'means for' together with an associated function.

Therefore, although selected aspects have been illustrated and described in detail, it will be understood that various substitutions and alterations may be made therein without departing from the spirit and scope of the present invention, as defined by the following claims.

What is claimed is:

1. A system for providing a recessed luminaire, the system comprising:

a hanger bar assembly, the hanger bar assembly comprising:

a first channel section, the first channel section has a substantially concave cross-section, wherein the substantially concave cross-section comprises a substantially C-shaped geometry; and a second channel section that engages the first channel section for providing a telescoping action for the hanger bar assembly when the first channel section slides relative to the second channel section, the second channel section has a central bottom portion, the central bottom portion has a first cross-section comprising a substantially rectangular U-shaped geometry that fits within the C-shaped geometry of the first channel section, the second channel section further comprises an upper wall and a lower wall which extends from the rectangular U-shaped geometry of the central bottom portion, the upper and lower walls each comprise a first, a second, and a third cut-out section along a respective wall's length, each cut-out section comprises a U-shape, the central bottom portion comprises a second cross-section corresponding to each cut-out section, the second cross-section of the central bottom portion comprises at least one rectangular section that corresponds with a cut-out section;

each channel section comprising at least two score lines; the at least two score lines being positioned along a length of a channel section and at respective mirrored-opposite locations relative to each channel section;

the first and second cut-out sections being positioned between a first end of the second channel section and a first score line along a length of the second channel section, the third cut-out section being positioned between the second score line and a second end of the second channel section;

each channel section comprising an end section which supports a fastener;

one channel section comprising at least one segment that is removable relative to a respective channel section while both end sections with fasteners remain in near fully contracted positions or at fully contracted positions relative to the telescoping action for the hanger bar assembly.

2. The system of claim 1, wherein the one segment may be broken off at a score line that is provided within a respective channel section.

3. The system of claim 2, wherein the score line has a predetermined depth relative to a respective channel section.

4. The system of claim 1, wherein the second channel section comprises at least one bump-out for engaging the first channel section.

5. The system of claim 4, wherein the bump-out has a cross-shaped geometry.

6. A system for providing a recessed luminaire, the system comprising:

a hanger bar assembly, the hanger bar assembly comprising:

a first channel section, the first channel section has a substantially concave cross-section, wherein the substantially concave cross-section comprises a substantially C-shaped geometry; and a second channel section that engages the first channel section for providing a telescoping action for the hanger bar assembly when the first channel section slides relative to the second channel section, the second channel section has a central bottom portion, the central bottom portion has a first cross-section comprising a substantially rectangular U-shaped geometry that fits within the C-shaped geometry of the first channel section, the second channel section further comprises an upper wall and a lower wall which extends from the rectangular U-shaped geometry of the central bottom portion, the upper and lower walls each comprise a first, a second, and a third cut-out section along a respective wall's length, each cut-out section comprises a U-shape, the central bottom portion comprises a second cross-section corresponding to each cut-out section, the second cross-section of the central bottom portion comprises at least one rectangular section that corresponds with a cut-out section;

each channel section comprising at least two score lines; the at least two score lines being positioned along a length of a channel section and at respective mirrored-opposite locations relative to each channel section;

the first and second cut-out sections being positioned between a first end of the second channel section and a first score line along a length of the second channel section, the third cut-out section being positioned between the second score line and a second end of the second channel section;

each channel section comprising an end section which supports a fastener;

one channel section comprising means for breaking off at least one segment relative to a respective channel section while both end sections with fasteners remain in near fully contracted positions or in fully contracted positions relative to the telescoping action for the hanger bar assembly.

7. The system of claim 1, wherein the means for breaking off at least one segment comprises a score line that is provided within a respective channel section.

8. The system of claim 7, wherein the score line has a predetermined depth relative to a respective channel section.

9. The system of claim 1, wherein the second channel section comprises at least one bump-out for engaging the first channel section.

10. A system for providing a recessed luminaire, the system comprising:

a hanger bar assembly, the hanger bar assembly comprising:

a first channel section, the first channel section has a substantially concave cross-section, wherein the substantially concave cross-section comprises a substantially C-shaped geometry; and a second channel section that engages the first channel section for providing a telescoping action for the hanger bar assembly when the first channel section slides relative to the second channel section, the second channel section has a central bottom portion, the central bottom portion has a first cross-section comprising a substantially rectangular U-shaped geometry that fits within the C-shaped geometry of the first channel section, the second channel section further comprises an upper wall and a lower wall which extends from the rectangular U-shaped geometry of the central bottom portion, the upper and lower walls each comprise a first, a second, and a third cut-out section along a respective wall's length, each cut-out section comprises a U-shape, the central bottom portion comprises a second cross-section corresponding to each cut-out section, the second cross-section of the central bottom portion comprises at least one rectangular section that corresponds with a cut-out section;

each channel section comprising at least two score lines; the at least two score lines being positioned along a length of a channel section and at respective mirrored-opposite locations relative to each channel section;

the first and second cut-out sections being positioned between a first end of the second channel section and a first score line along a length of the second channel section, the third cut-out section being positioned between the second score line and a second end of the second channel section;

each channel section comprising an end, each end comprising a first segment and a second segment, the end defining a geometrical plane wherein the first segment extends in a perpendicular manner relative to the geometrical plane, the first segment providing a holder.

11. The system of claim 10, wherein the second segment also extends in a perpendicular manner relative both to the first segment and the geometrical plane.

12. The system of claim 10, wherein the holder comprises a loop portion.

13. The system of claim 10, wherein the first segment comprises a rib.

14. The system of claim 10, wherein the holder supports a fastener.

15. The system of claim 14, wherein the fastener comprises a nail.

16. The system of claim 10, wherein the holder comprises a loop portion and an edge section.

17. The system of claim 10, wherein the second segment comprises an aperture.

* * * * *